US012305383B2

(12) United States Patent
Ethier

(10) Patent No.: US 12,305,383 B2
(45) Date of Patent: May 20, 2025

(54) MODULAR BUILDING SYSTEM

(71) Applicant: Stephanie Ethier, Waltham, WA (US)

(72) Inventor: Stephanie Ethier, Waltham, WA (US)

(73) Assignee: Stephanie Ethier, Waltham, MA (US)

( * ) Notice: Subject to any disclaimer, the term of this patent is extended or adjusted under 35 U.S.C. 154(b) by 309 days.

(21) Appl. No.: 18/156,284

(22) Filed: Jan. 18, 2023

(65) Prior Publication Data

US 2024/0240446 A1 Jul. 18, 2024

(51) Int. Cl.

| | |
|---|---|
| ***E04B 1/343*** | (2006.01) |
| ***E04B 1/00*** | (2006.01) |
| ***E04B 1/38*** | (2006.01) |
| ***E04H 1/12*** | (2006.01) |

(52) U.S. Cl.

CPC ..... *E04B 1/34321* (2013.01); *E04B 1/34336* (2013.01); *E04B 1/38* (2013.01); *E04H 1/1205* (2013.01); *E04B 2001/0076* (2013.01)

(58) Field of Classification Search

CPC ..... E04B 1/34321; E04B 1/34336; E04H 1/1205; E04H 2001/1283; E04H 1/005; E04H 1/02

See application file for complete search history.

(56) References Cited

U.S. PATENT DOCUMENTS

| | | | | | |
|---|---|---|---|---|---|
| 2,160,225 | A * | 5/1939 | Newman | E04B 2/62 | 52/742.16 |
| 2,578,644 | A * | 12/1951 | Mautner | B65D 7/12 | 206/508 |
| 3,724,701 | A * | 4/1973 | Barkow | B65D 9/34 | 217/65 |
| 5,279,436 | A * | 1/1994 | Elliott | E04B 1/34321 | 52/801.1 |
| 5,449,081 | A * | 9/1995 | Sjostedt | B62D 29/045 | 220/666 |
| 5,762,222 | A * | 6/1998 | Liu | B65D 19/12 | 229/122.25 |
| 9,316,015 | B1 * | 4/2016 | Elliott | E04B 1/98 | |
| 9,995,034 | B2 * | 6/2018 | Rothenberg | E04H 1/1205 | |
| 10,072,411 | B1 * | 9/2018 | Moran | E04B 2/7401 | |
| 10,450,737 | B2 | 10/2019 | Bowron | | |
| 10,480,176 | B2 | 11/2019 | Unger | | |
| 10,655,350 | B2 | 5/2020 | Hartmann et al. | | |
| D927,965 | S | 8/2021 | Bowron | | |
| 11,174,630 | B2 | 11/2021 | Bowron | | |
| 11,479,962 | B2 | 10/2022 | Bowron | | |

(Continued)

*Primary Examiner* — Gisele D Ford

(74) *Attorney, Agent, or Firm* — Maschoff Brennan

(57) ABSTRACT

A building system including a frame that includes multiple columns and multiple bottom supports. Each of the bottom supports may be coupled to at least one of the multiple columns and each may include a flange extending into the frame. The frame may also include a trim plate pair including two parallel trim plates. The building system may include multiple floor panels and multiple wall panels. Each of the floor panels may include a first floor panel edge and a second floor panel edge that are each configured to span between the flanges the bottom supports. Each of the multiple wall panels may include a first end configured to rest between the two parallel trim plates of the trim plate pair and the first end of at least one of the plurality of wall panels may be in direct contact with at least one of the plurality of floor panels.

20 Claims, 36 Drawing Sheets

(56) References Cited

U.S. PATENT DOCUMENTS

| | | | | |
|---|---|---|---|---|
| 2016/0160515 | A1* | 6/2016 | Wallance | E04F 10/10 52/745.02 |
| 2016/0305123 | A1* | 10/2016 | Ljubicic Rubio | H01R 24/76 |
| 2017/0089061 | A1* | 3/2017 | Rothenberg | E04H 1/1205 |
| 2017/0130474 | A1* | 5/2017 | Rebollar Buldain | E04H 5/02 |
| 2018/0109163 | A1* | 4/2018 | Paine | E04H 5/04 |
| 2018/0274254 | A1* | 9/2018 | Fan | E04H 1/04 |
| 2019/0010691 | A1* | 1/2019 | Moran | E04B 1/3483 |
| 2019/0078321 | A1 | 3/2019 | Bowron | |
| 2019/0376303 | A1* | 12/2019 | Wolff | E04B 1/348 |
| 2020/0284024 | A1* | 9/2020 | Segall | E04B 1/02 |
| 2021/0054613 | A1* | 2/2021 | Peck | E04B 1/3483 |

* cited by examiner

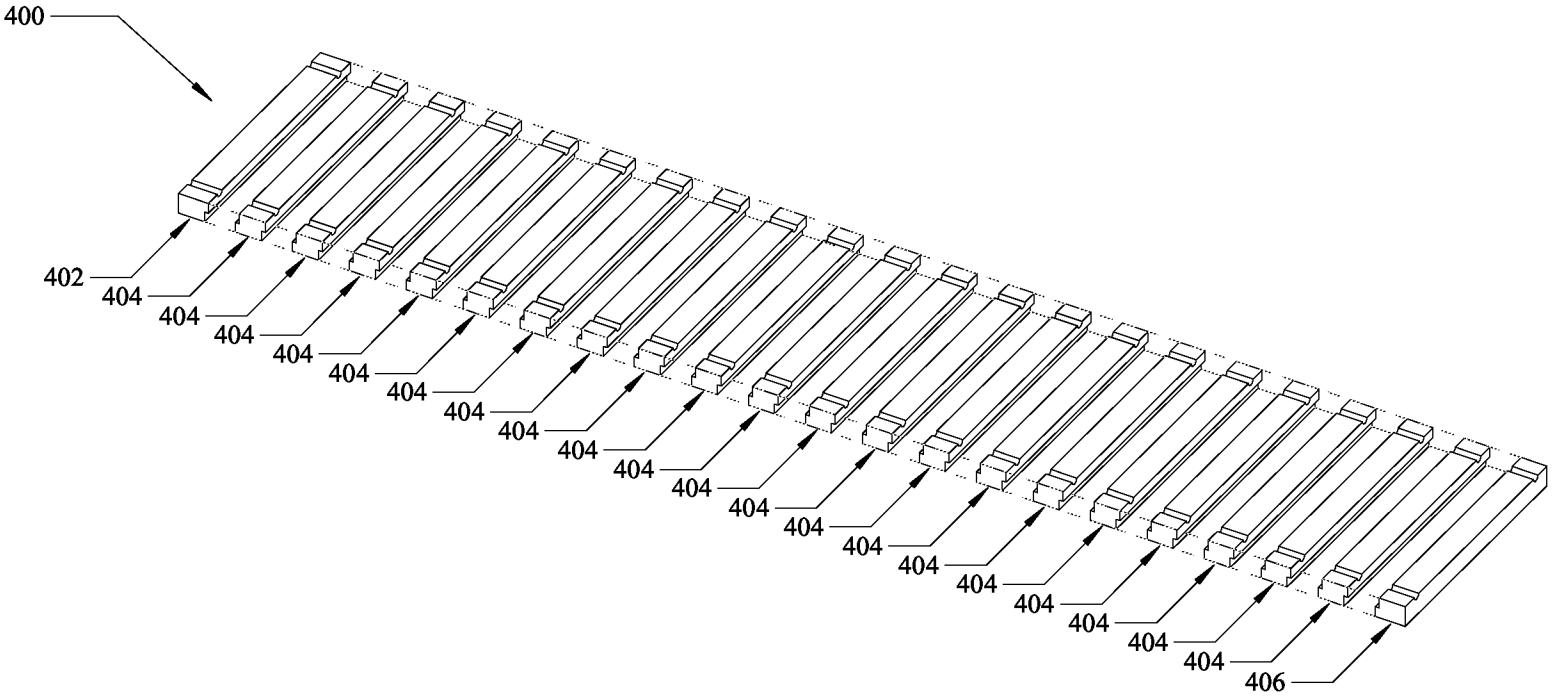
400
402
404
404
404

MODULAR BUILDING SYSTEM

FIELD

The embodiments discussed herein are related to a modular building system.

BACKGROUND

Many existing modular structures may require skilled labor on site for construction, transportation of raw construction materials to the site of use, multiple days to complete each structure with skilled labor, and many different components to construct. Further many modular structures are not relocatable or transportable; and cannot be disassembled.

The subject matter claimed herein is not limited to embodiments that solve any disadvantages or that operate only in environments such as those described above. Rather, this background is only provided to illustrate one example technology area where some embodiments described herein may be practiced.

SUMMARY

A building system including a frame that includes multiple columns and multiple bottom supports. Each of the bottom supports may be coupled to at least one of the multiple columns and each may include a flange extending into the frame. The frame may also include a trim plate pair including two parallel trim plates where the trim plate pair is coupled between two of the plurality of columns. The building system may also include multiple floor panels and multiple wall panels. Each of the floor panels may include a first floor panel edge and a second floor panel edge that are each configured to span between the flange of a first one of the bottom supports to the flange of a second one of the bottom supports. Each of the multiple wall panels may include a first end configured to rest between the two parallel trim plates of the trim plate pair and the first end of at least one of the plurality of wall panels may be in direct contact with at least one of the plurality of floor panels.

BRIEF DESCRIPTION OF THE DRAWINGS

Example embodiments will be described and explained with additional specificity and detail through the use of the accompanying drawings in which:

FIG. 4A illustrates an example exploded view of a roof panel assembly.

DESCRIPTION OF EMBODIMENTS

Modular buildings may be used when shelter is established for occupants. Users may include but not be limited to the military, emergency and disaster relief, and civilian construction. The military may use modular buildings for training or in deployed environments to shelter troops. In emergency and disaster relief situations, modular buildings may be needed to shelter civilians, refugees and/or immigrants. In civilian construction, modular buildings may be used to construct affordable housing.

Current modular buildings include but may not be limited to various military huts, tents, shipping containers, and trailers. The current modular buildings may be improved upon in designing for functionality, affordability, adaptability, sustainability, and/or durability for short and/or long term use.

A modular building unit described in some embodiments in this disclosure may offer an improved design. In some embodiments, the modular building unit may be designed to be assembled with minimal tools and machinery and may have the ability to be disassembled and repurposed to extend its lifetime use. A frame and size of the modular building unit may allow the modular building unit to be universally transported the same as a standard shipping container by sea, air, land, and rail. The assembly difficulty and number of components necessary to construct a modular building unit as described in some embodiments in this disclosure may be reduced to limit the need for highly skilled labor in construction.

Furthermore, in some embodiments, the components of the modular building unit may be designed with standardized increments and sizes to maximize their adaptability when connecting or attaching to other components. Standardized components may allow the modular building unit to be adaptable and multifunctional with various arrangements of floor plans. The modular building unit may be designed with sustainable and eco-friendly materials such as aircrete which may be recyclable and resistant to fire, water, rot, mold, and pests. The energy efficiency of a modular building unit may be improved by using aircrete which provides great insulation and sound resistance. Alternately or additionally, aircrete may be a lightweight material allowing the components of the modular building unit to be easily lifted by hand and assembled together. Alternately or additionally, the modular building units may be designed to attach horizontally and vertically with other units to create large scale buildings to serve multifunctional purposes. The modular building unit described may provide improved living and working conditions for the occupants.

Figure 1A:
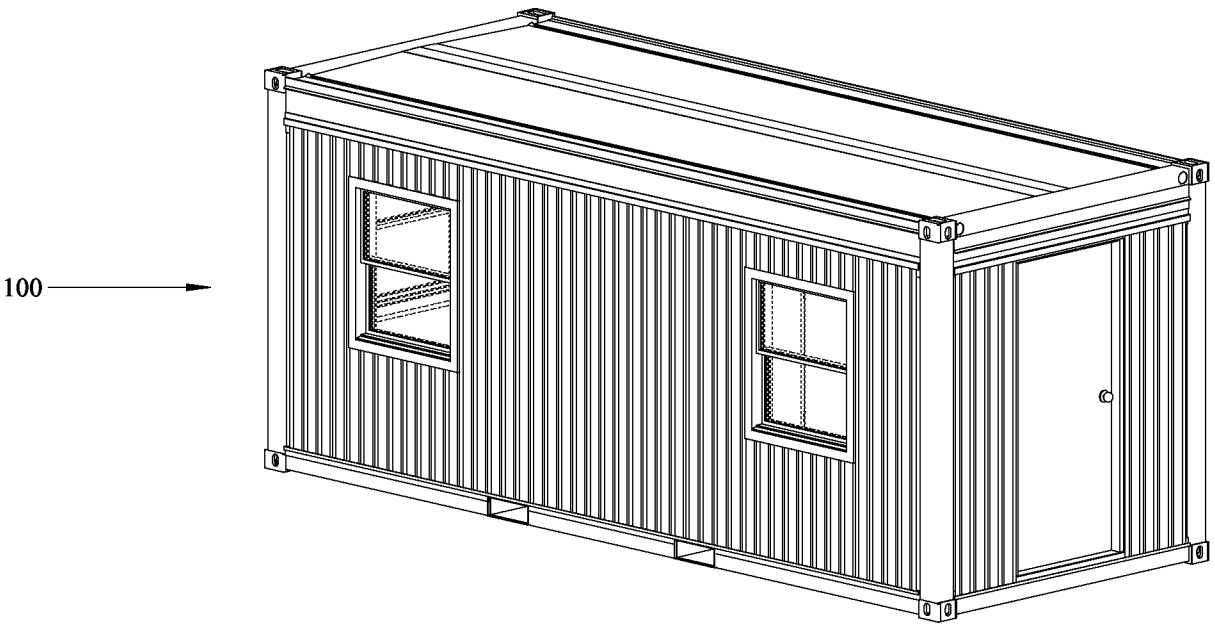
FIG. 1A illustrates an example modular building unit.

Turning to the figures, FIG. 1A illustrates an example modular building unit 100. The modular building unit 100 may be arranged in accordance with at least one embodiment described in the present disclosure. The modular building unit 100 may be constructed as described with respect to other figures in the disclosure. The modular building unit 100 may generally include a frame that includes multiple columns. The modular building unit 100 may also include multiple bottom supports. In these and other embodiments, each of the bottom supports may be coupled to at least one of the columns and may each include a flange extending into the frame. The modular building unit 100 may also include multiple top supports. Each of the top supports may be coupled to at least one of the columns and each may include a flange extending into the frame.

The modular building unit 100 may also include a trim plate pair including two parallel trim plates. In some embodiments, the trim plate pair may be coupled between two of the columns. The modular building unit 100 may also include a second trim plate pair including two parallel trim plates. The second trim plate pair may be coupled between the two of the columns.

The modular building unit 100 may also include multiple floor panels. In some embodiments, each of the floor panels may include a first floor panel edge and a second floor panel edge that are each configured to span between the flange of a first one of the bottom supports to the flange of a second one of the bottom supports. In these and other embodiments, each of the floor panels may include a first floor joining piece extending along the first floor panel edge and a second floor joining piece extending along the second floor panel edge. Alternately or additionally, each of the first floor joining pieces may be configured to contact and support the second flooring joining piece of another one of the floor panels. In some embodiments, a width, a length, and a thickness of each of the floor panels may be the same and the first floor joining piece extending along the first floor panel edge may be symmetrical to the second floor joining piece extending along the second floor panel edge.

The modular building unit 100 may also include multiple roof panels. In some embodiments, each of the roof panels may include a first roof panel edge and a second roof panel edge that are each configured to span between the flange of a first one of the top supports to the flange of a second one of the top supports, In these and other embodiments, each of the roof panels may include a first roof joining piece extending along the first roof panel edge and a second roof joining piece extending along the second roof panel edge. Alternately or additionally, each of the first roof joining pieces may be configured to contact and support the second roof joining piece of another one of the roof panels. In these and other embodiments, the roof panels may include a first end and a second end opposite the first end. The first end may be configured to be supported by the flange of the first one of the top supports and the second end may be configured to be supported by the flange of the second one of the top supports.

In some embodiments, the roof panels may include a first channel along the first end and a second channel along the second end. In these and other embodiments, the first channel and the second channel may extend perpendicular to the first roof panel edge and the second roof panel edge. In some embodiments, a width, a length, and a thickness of each of the roof panels may be the same and the first roof joining piece extending along the first roof panel edge may be symmetrical to the second roof joining piece extending along the second roof panel edge.

The modular building unit 100 may also include multiple wall panels. In some embodiments, each of the wall panels may include a first end, a second end opposite the first end, a first wall panel edge, a second wall panel edge, a first wall joining piece extending along the first wall panel edge, and a second wall joining piece extending along the second wall panel edge. In these and other embodiments, each of the first wall joining pieces may be configured to contact and support the second wall joining piece of another one of the wall panels and the first end of each of the wall panels may be configured to rest between the two parallel trim plates of the trim plate pair. In these and other embodiments, the second end of each of the wall panels may be configured to rest between the two parallel trim plates of the second trim plate pair. In some embodiments, a width, a length, and a thickness of each of the wall panels may be the same and the first wall joining piece extending along the first wall panel edge may be symmetrical to the second wall joining piece extending along the second wall panel edge. In some embodiments, each of the floor panels, the roof panels, and the wall panels may be formed of the same material, such as aircrete.

Figure 1B:
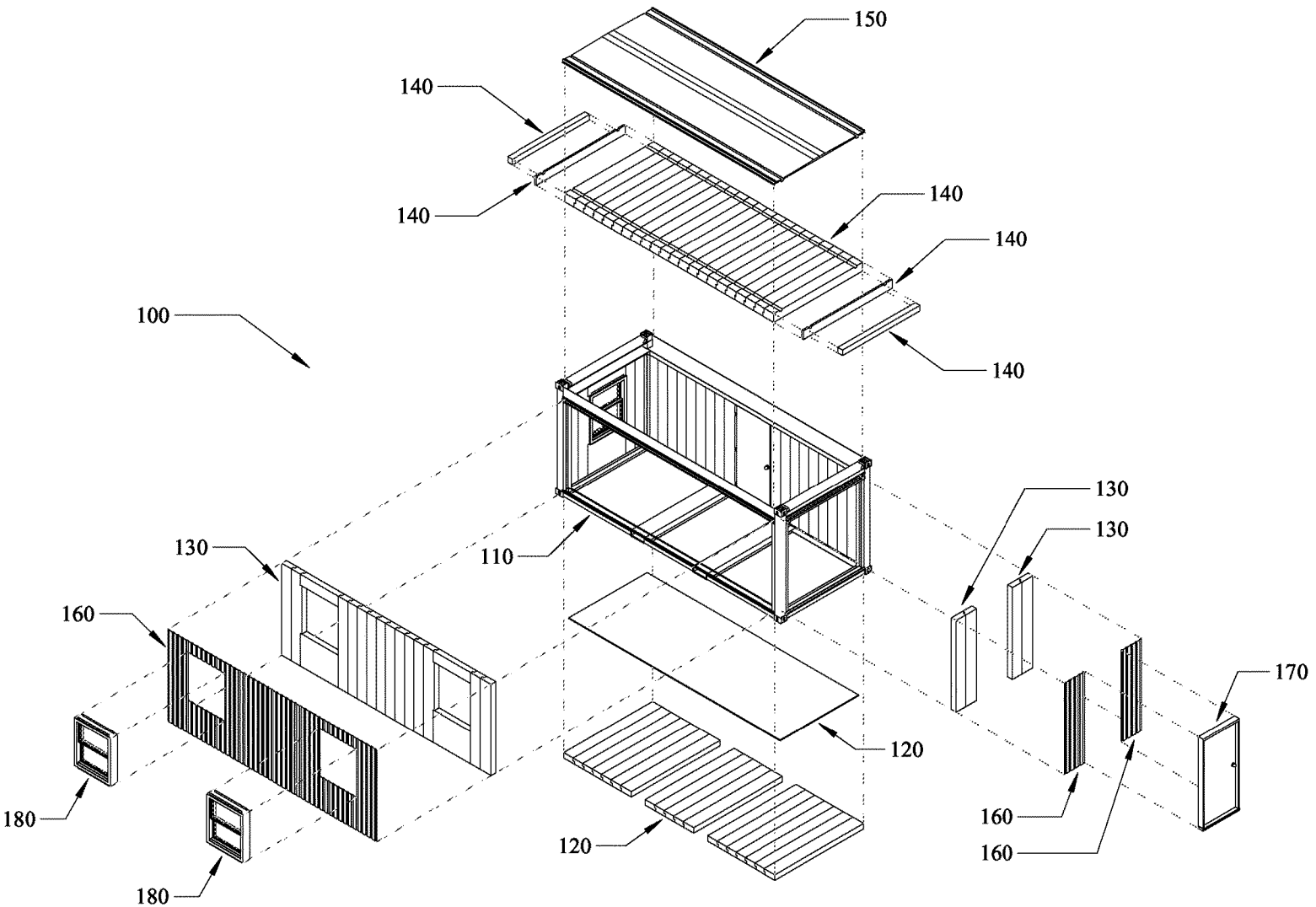
FIG. 1B illustrates an example exploded view of the modular building unit of FIG. 1A.

FIG. 1B illustrates an exploded view of the modular building unit 100 of FIG. 1A. The modular building unit 100 may be comprised of one or more component assemblies including a frame 110, floor panels 120, wall panels 130, roof panels 140, exterior roof panels 150, exterior siding panels 160, doors 170 and windows 180. The illustrated components assembled together may construct a modular building unit 100.

In some embodiments, all components of the modular building unit 100 may be transported on one or more pallets or shipping containers to the construction site. Shipping methods may include sea, air, land and rail. The components may be efficiently arranged together and secured on one or more pallets or shipping containers in an effort in minimize the number of pallets and shipping containers necessary to ship the components. Alternatively, a partially or entirely assembled modular building unit 100 may be used as the container to ship components. Partially or entirely assembled modular building units 100 may be shipped to site to minimize the construction necessary upon arrival to the site. A partially or entirely assembled modular building unit 100 may minimize the remaining assembly time on site to quickly prepare the unit for its intended function(s). Furniture, tools and additional components necessary for construction and interior set up may be shipped inside the modular building unit 100 or on additional pallets and shipping containers. Modular building units 100 may be prepared for shipping by wrapping or covering the exterior with a protective cover of any material to minimize damage to the unit and components. The components may be packed tightly together and secured for shipping to minimize movement and damage during transportation.

Figure 2A:
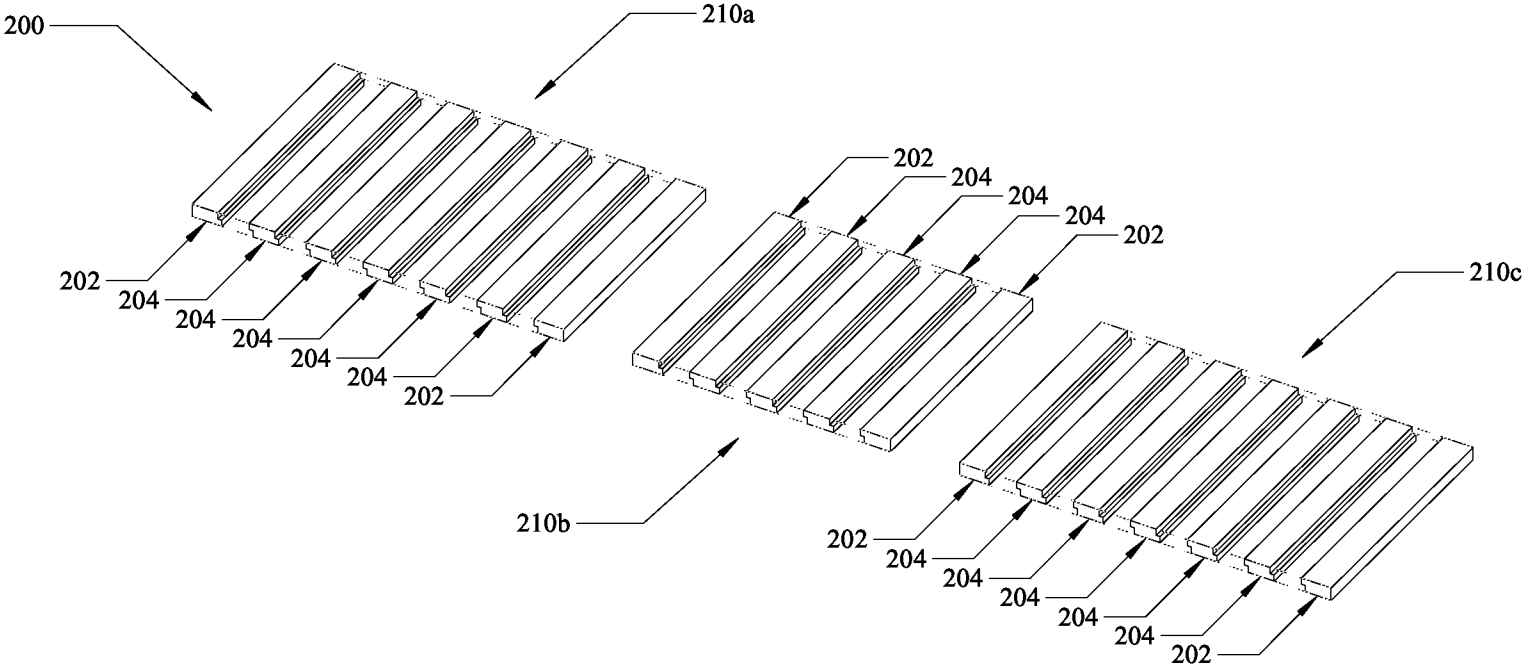
FIG. 2A illustrates an example exploded view of a floor panel assembly.

FIG. 2A illustrates an example exploded view of a floor assembly 200 of a modular building unit. The floor assembly 200 may be arranged in accordance with at least one embodiment described in the present disclosure. The floor assembly 200 may include a first floor section 210*a*, a second floor section 210*b*, and a third floor section 210*c*, referred to as the floor sections 210. In some embodiments, the number of sections of the floor assembly 200 may correspond with a configuration of a frame of a modular building unit, such as the frame 110 of the modular building unit 100 of FIG. 1B. Thus, in some embodiments, the number of sections may be more or fewer than three as illustrated.

In some embodiments, each of the floor sections 210 may include two floor end panels 202 and one or more floor panels 204. A number of floor panels 204 may vary and may be determined based on the opening size of the frame into which the floor panels 204 are to be installed. Two floor end panels 202 may be placed on opposite sides of a floor section 210 and any number of floor panels 204 may be placed between to fill the remaining space in an opening of the frame. Floor end panels 202 may be placed at the ends of a floor section 210 due to their flat end surface which may rest flat against the frame. The floor end panels 202 and the floor panels 204 may be arranged and fitted together to create a flat surface for the floor assembly 200.

In some embodiments, the panels of the floor assembly 200, such as the floor end panel 202 and the floor panel 204, may be made of any material including wood, concrete, aircrete, high density foam, aluminum and metal or any combination of the listed materials or other materials. Panels made of materials such as concrete or aircrete may have steel bars and/or wire mesh reinforcement within the panels. For example, in some embodiments, the floor end panels 202 and the floor panels 204 may be made from aircrete. In these and other embodiments, the floor end panels 202 and the floor panels 204 may be individually constructed or constructed from a mold at a manufacturing facility. By using aircrete, the floor end panels 202 and the floor panels 204 may provide strength to the building but may also allow people to easily lift and install the floor end panels 202 and the floor panels 204 without heavy machinery or needing multiple different construction components. As an example, the floor end panels 202 and the floor panels 204 may weigh 15 pounds to 150 pounds per panel.

In some embodiments, a width of the floor end panels 202 and the floor panels 204 may be configured such that the length of the frame and the width of the floor end panels 202 and the floor panels 204 are compatible such that the length of the frame divided by the width of the floor end panels 202 and the floor panels 204 may be an integer value. The length, width, and depth of the panels may vary and may be based on the dimensions of the frame into which the panels may be installed.

In some embodiments, the floor end panels 202 may have a length ranging from 1 foot to 10 feet, a width ranging from 4 inches to 4 feet, and a depth ranging from 2 inches to 10 inches. The floor end panel 202 may include a notch in one end of the panel that may form a flange. The flange may be mated with a flange of a floor panel 204 to join the floor end panel 202 and the floor panel 204 together. The notch may extend the entire length of floor end panel 202 and may begin on the width surface. The notch may be 0.5 inches to 5 inches in depth into the floor end panel 202 to approximately a center the depth of the floor end panel 202 and may be 0.5 inches to 8 inches in width. The notch may occur on one side of the floor end panel 202 to allow for a flat surface on the other end. Floor end panel 202 may have a width ranging from 4 inches to 4 feet on one surface and a smaller width on the opposite surface with the notch.

In some embodiments, the floor panels 204 may have a length ranging from 1 foot to 10 feet, a width ranging from 4 inches to 4 feet, and a depth ranging from 2 inches to 10 inches. The floor panel 204 may have a notch in both sides of the floor panel 204 that may form a flange on both sides of the floor panel 204. The flange may be configured to join or mate with a flange of another floor panel 204 or floor end panel 202. The flange may mate with another flange by extending over the other flange such that a surface area of the flanges are in contact and support each other. The notch may extend the entire length of floor panel 204 and begins on the width surface. The notch may be 0.5 inches to 5 inches in depth into the floor panel 204 to approximately a center the depth of the floor panel 204 and may be 0.5 inches to 8 inches in width. The notch may occur on opposite sides of both width surfaces of floor panel 204. Floor panel 204 may have a width ranging from 4 inches to 4 feet on both surfaces with the notch at opposite sides.

Figure 2B:
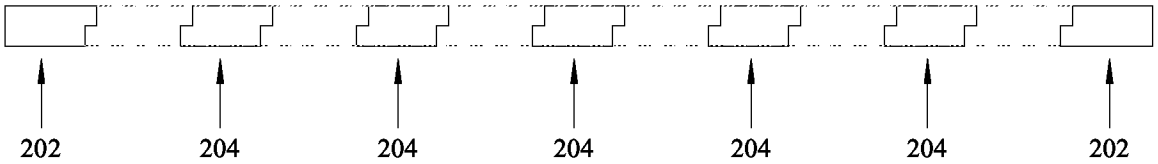
FIG. 2B illustrates an example plan view of the joinery of floor panels.

FIG. 2B illustrates an example of the floor end panels 202 and the floor panels 204 of FIG. 2A from a different perspective. The number of panels may vary from the illustration. A number of panels assembled together may be determined based on the dimensions of the floor assembly 200. The floor end panels 202 and the floor panels 204 are assembled together using the notches to join each end. For example, the notches of two floor panels 204 may be rested on top or below each other. Floor end panels 202 may be placed with the notch facing opposite directions, such as one facing up and another facing down, on both ends of the floor section 210. Floor panels 204 may be placed in the remaining space with each floor panel 204 including a first notch resting on top of a notch of another floor panel 204 and a second notch being below are carrying another notch of another floor panel 204. During construction of the floor assembly 200, the floor end panels 202 and the floor panels 204 may be placed one after another within a frame to form the floor assembly 200. Floor panels 204 may be joined to other floor panels 204 from either side of the floor panels 204.

In some embodiments, an orientation of the floor panels 204 during construction may not be important because the floor panels 204 are symmetrically designed such that floor panels 204 have the same configuration regardless of the orientation of the floor panels 204. As a result of the symmetric design, the construction burden may be reduced. Thus, the design of the floor end panels 202 and the floor panels 204 may allow for joinery with reduced complexity and easier installation.

In some embodiments, the floor assembly 200, wall panels 300 and roof assembly 400 may be assembled similarly. The panels may have the same installation and joinery method as illustrated in FIG. 2B. In some instances, the panels may vary in size but the assembly method remains the same throughout the panel types. The joinery on the ends of the panels such as the notches may be one of many other shapes used to join panels together. Various other shapes and sizes of end joints may be used to connect panels together. For example, another joinery method of panels may be with a male and female design where the end of one panel may be inserted into an opening in the end of the panel next to it. Alternatively, panels may have flat ends with a frame around one or more sides of each panel and the ends of the panel frames may connect the panels together, holding the panels into place.

In some embodiments, the floor end panels 202 and the floor panels 204 may be set into a frame one or more at a time. The floor end panels 202 and the floor panels 204 may rest on a bottom flange of an angle, such as bottom angle 950*a*, illustrated in FIG. 9D, positioned perpendicular to the placement of the floor end panels 202 and the floor panels 204 and along the long side of the frame. The bottom flange of the angle 950*a* may support the floor end panels 202 and the floor panels 204. For example, the bottom flange may support from 1 inch to 8 inches of the floor end panels 202 and the floor panels 204.

Figure 9A:
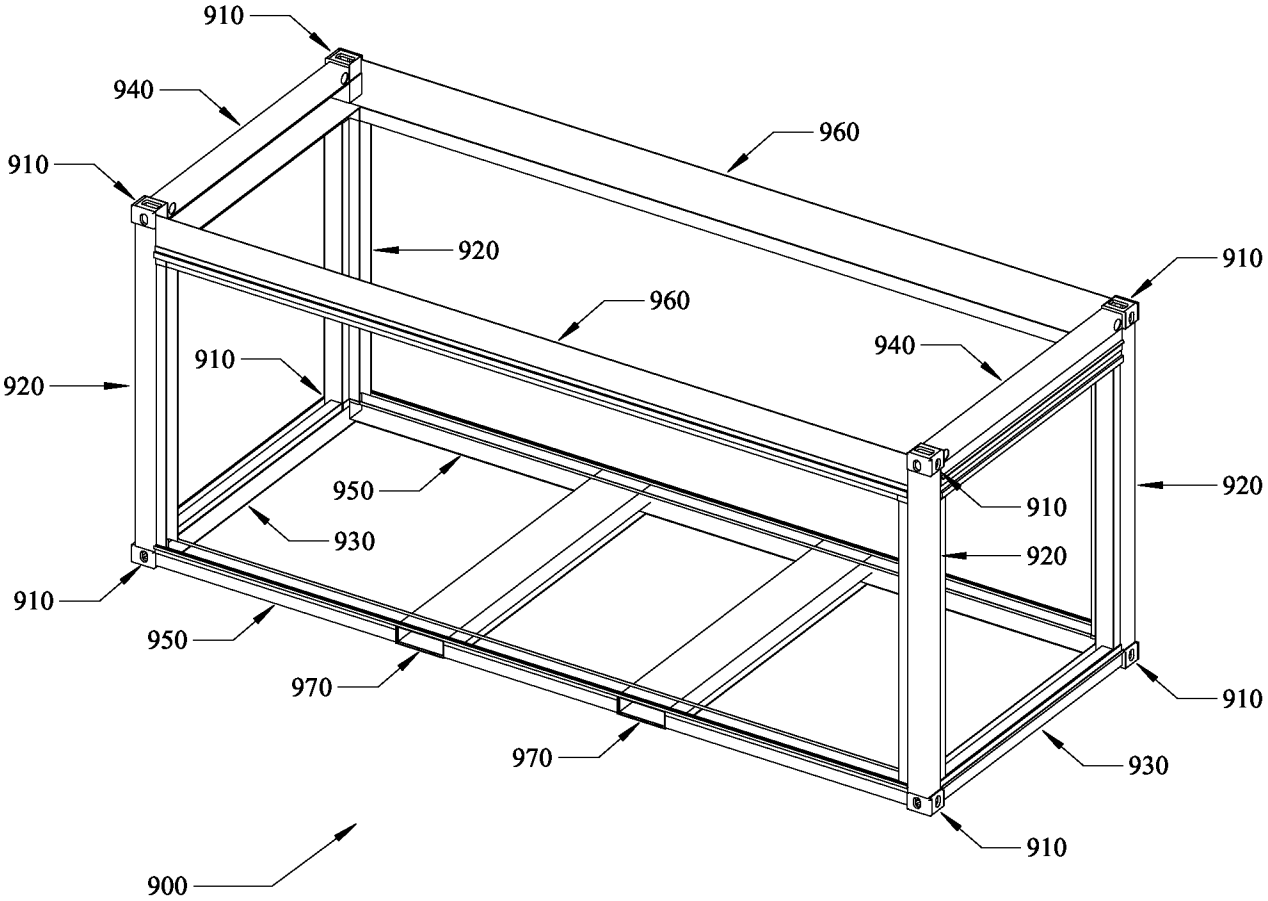
FIG. 9A illustrates an example view of a frame assembly.
Figure 9B:
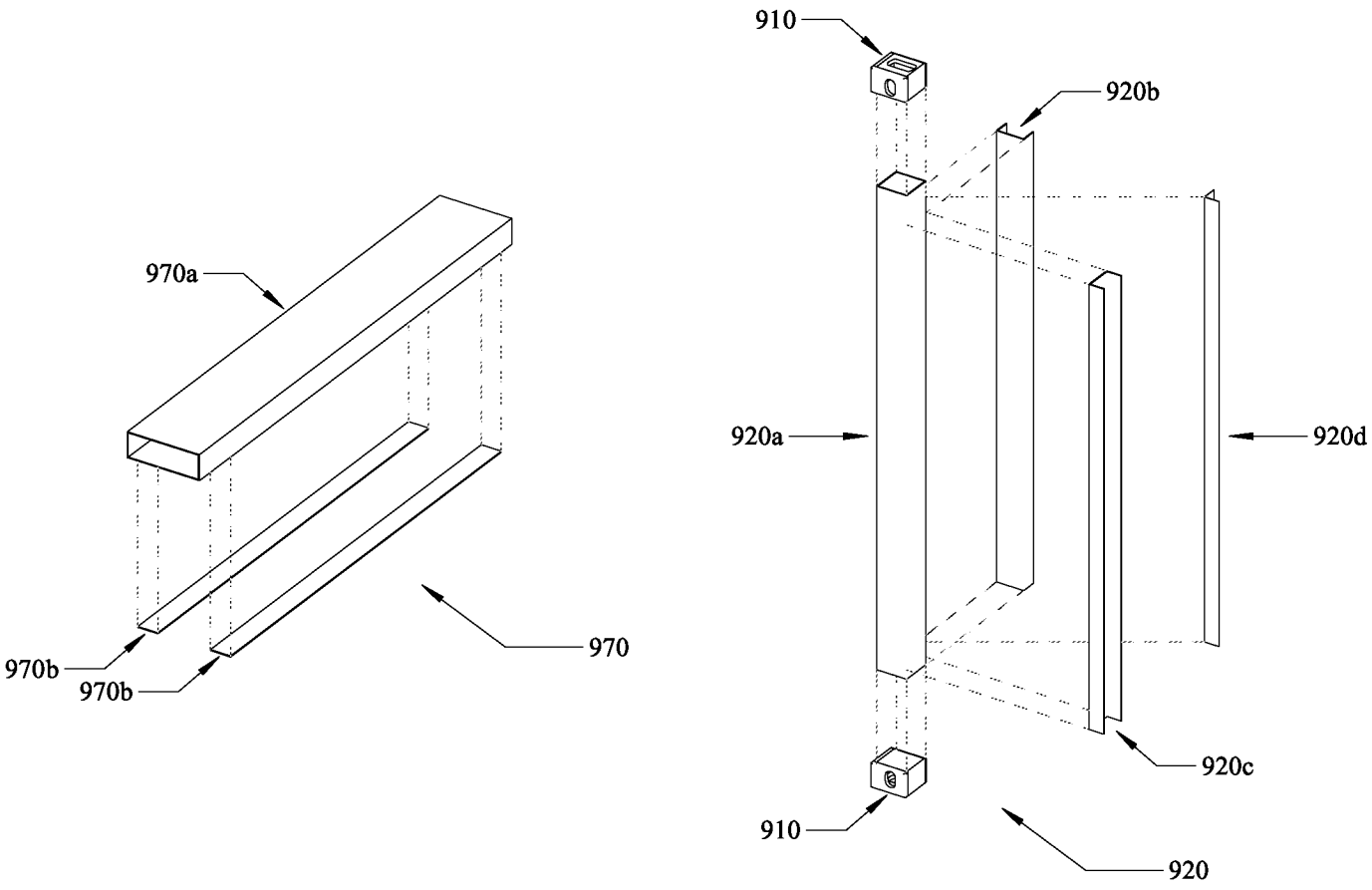
FIG. 9B illustrates an example exploded view of a forklift pocket assembly and a corner column assembly.
Figure 9C:
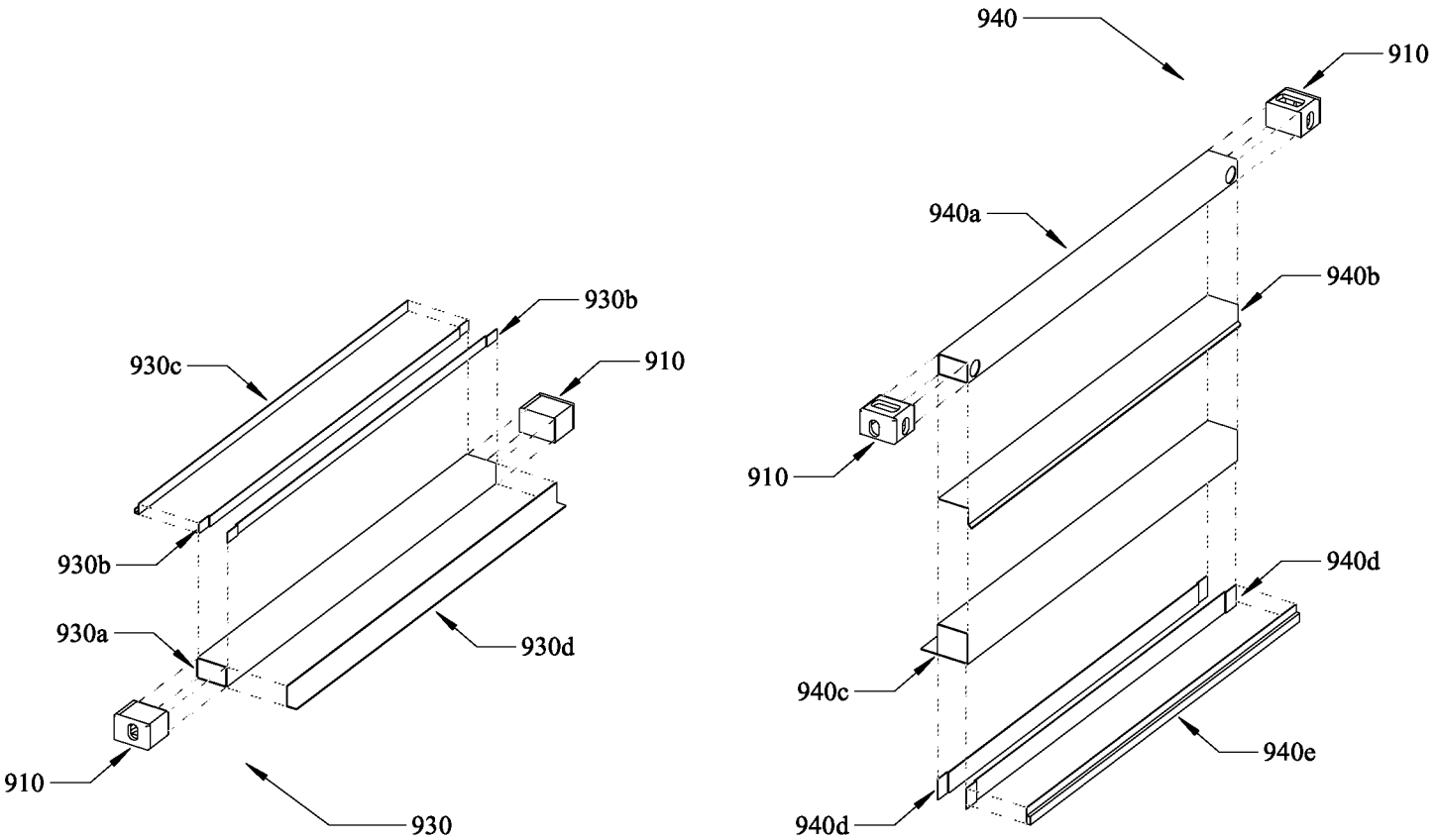
FIG. 9C illustrates an example exploded view of the bottom and top frame assembly on the short side of the modular building unit.

In some embodiments, the floor end panels 202 may rest on a bottom flange of an angle, such as an angle base trim 930*d*, illustrated in FIG. 9C, positioned parallel to the floor section 210 along a side of the frame. The bottom flange of the angle may support the floor end panels 202 from 1 inch to 4 inches of the floor end panels 202. In some embodiments, a lower opening of the frame 110 may include two forklift pockets, such as the forklift pockets 970 illustrated in FIG. 9B, which may extend through the entirety of the frame 110 dividing it into three openings. Floor end panels 202 and the floor panels 204 may be placed one at a time within the three openings of the frame 110 extending horizontally and parallel to the short side of the frame 110. The floor end panels 202 next to the forklift pockets may rest on a plate, such as forklift plates 970*b*, positioned parallel to the floor end panels 202 and attached to the forklift HSS tube 970*a*. The plate may support from 1 inch to 4 inches of floor end panels 202. The frame 110 may support the weight of the floor assembly 200.

In some embodiments, a floor end panel 202 may be placed at each end of the floor assembly 200 to create a flat surface close to the frame side. The floor end panel 202 may be rotated 180 degrees to be placed with the notch facing up or down. One floor end panel 202 may have a notch facing up and another floor end panel 202 may have a notch facing down with any number of floor panels 204 in between to complete the floor assembly 200 for an entirely flat floor surface.

Figure 2C:
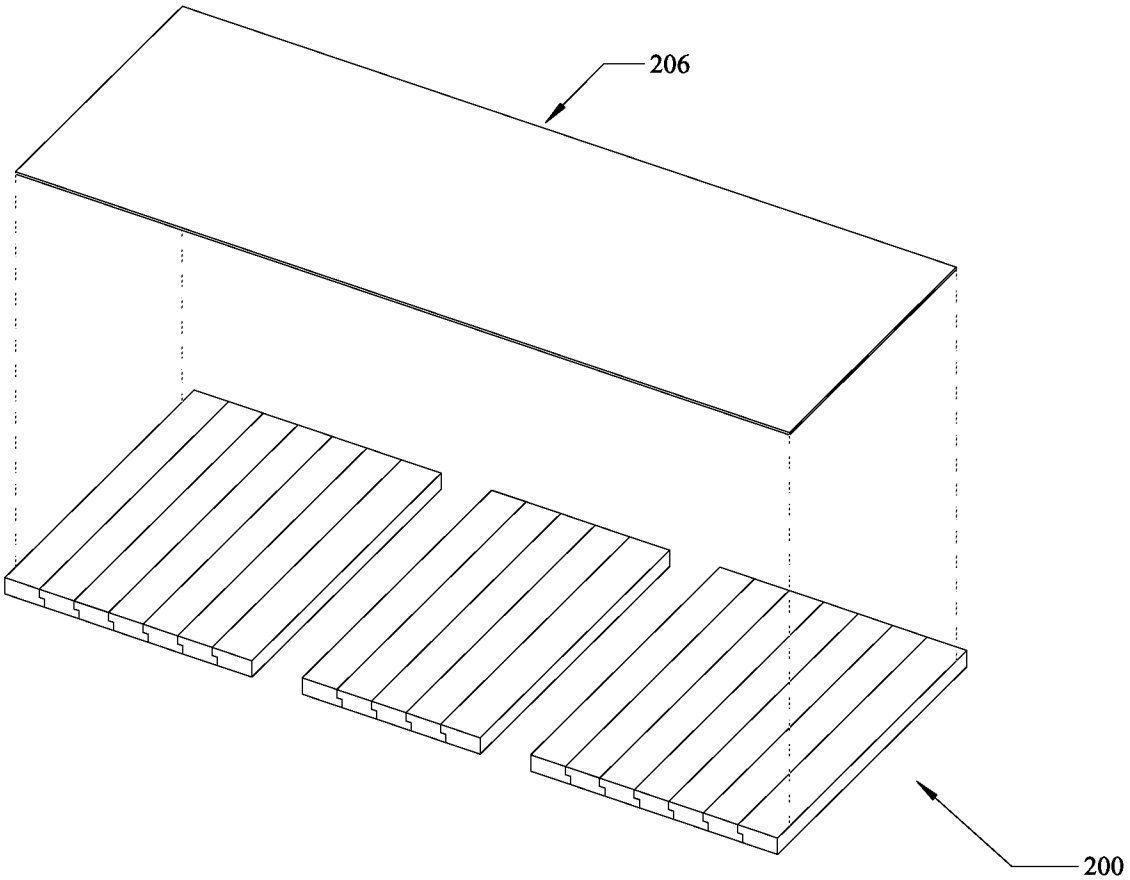
FIG. 2C illustrates an example exploded view of a floor panel assembly and subflooring assembly.

FIG. 2C illustrates an example exploded view of a floor assembly 200 of a modular building unit that includes secondary flooring 206. The floor assembly 200 may be arranged in accordance with at least one embodiment described in the present disclosure. In some embodiments, after the floor sections 210 are aligned into position, a secondary flooring 206 may be installed on top of the floor sections 210. The secondary flooring 206 may be installed in accordance with typical flooring construction practices which may vary based on the finished material of choice. The secondary flooring may be a plywood sub-flooring, a water barrier and a finished flooring material installed on top. There may be round or rectangular openings in the floor end panels 202, floor panels 204 and secondary flooring 206 to allow MEP systems to be installed inside the unit.

Figure 3A:
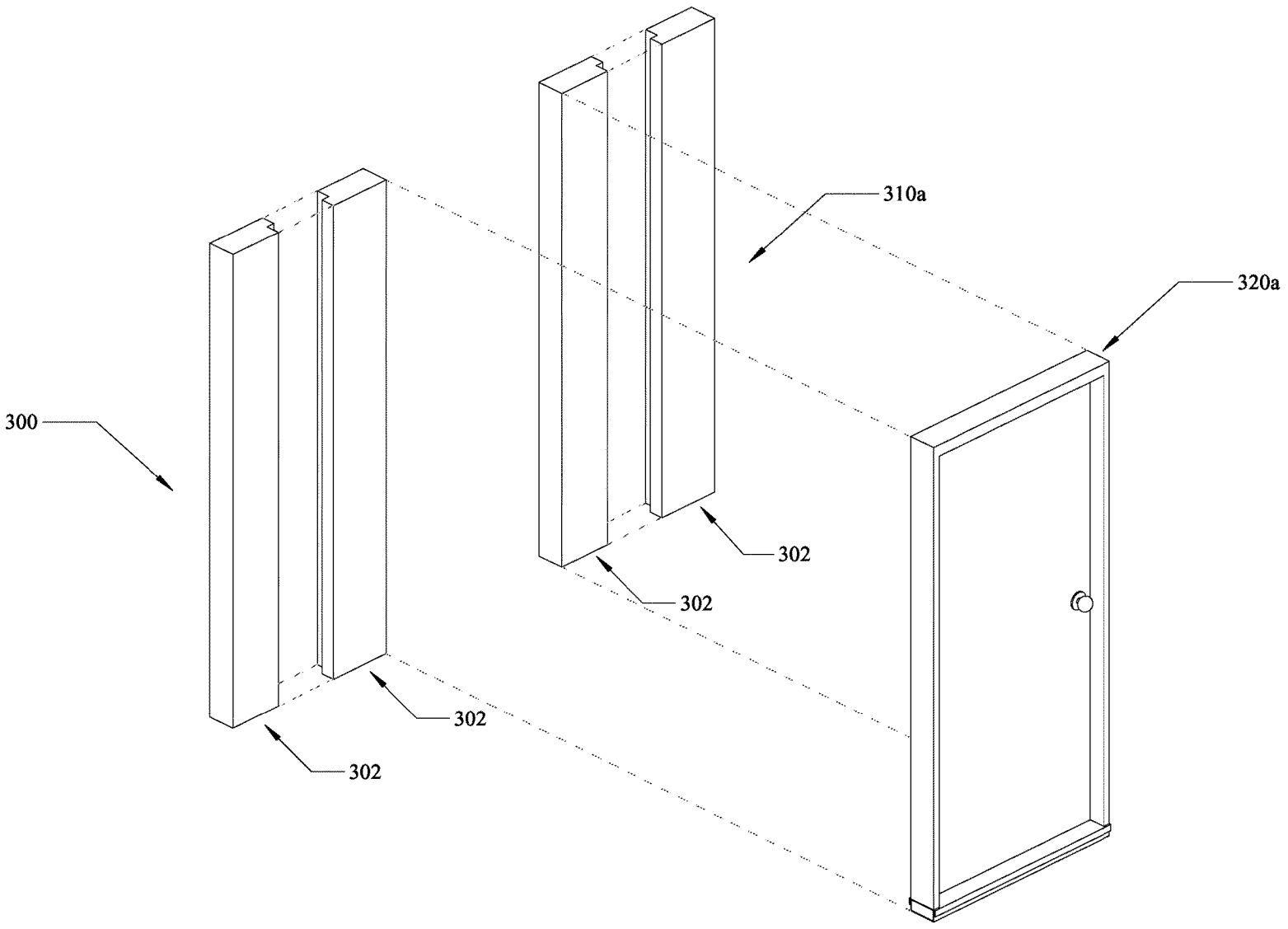
FIG. 3A illustrates an example exploded view of a wall panel assembly with a door.
Figure 3B:
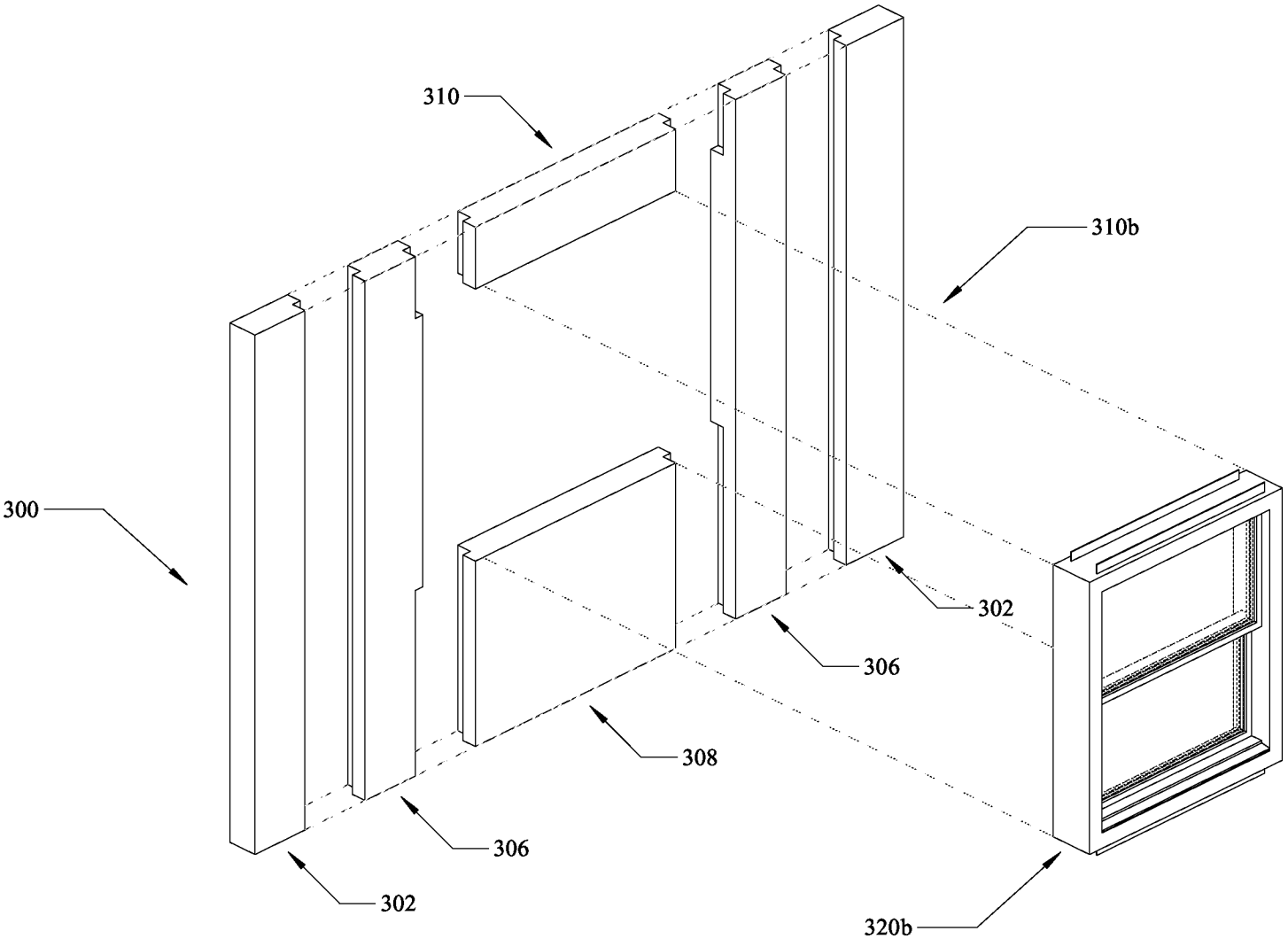
FIG. 3B illustrates an example exploded view of a wall panel assembly with a window.
Figure 3C:
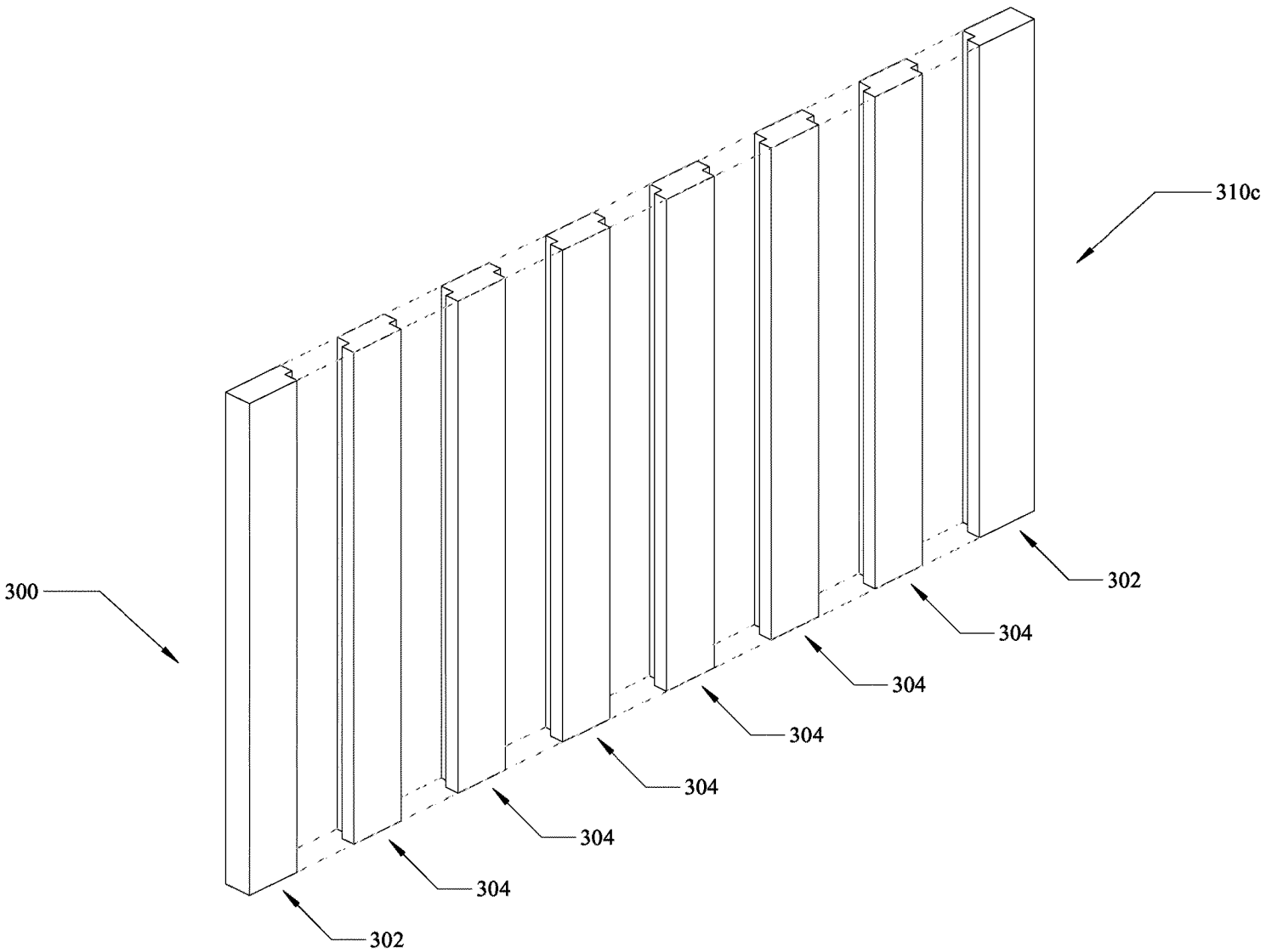
FIG. 3C illustrates an example exploded view of a solid wall panel assembly.

FIGS. 3A-3C illustrates an example exploded view of wall assemblies 310 of a modular building unit built using wall panels 300. The wall assemblies 310 may be arranged in accordance with at least one embodiment described in the present disclosure. FIGS. 3A-3C illustrate a wall assembly 310*a* configured for a door, a wall assembly 310*b* configured for a window, and a solid wall assembly 310*c*, referred to collectively as the wall assemblies 310.

In some embodiments, the number of the wall assemblies 310 configured for a door and/or a window that may be used in a modular building unit may vary and correspond with different configurations of the modular building unit floor plan, as illustrated in FIGS. 11A-11D. Thus, in some embodiments, the wall panels 300 may be joined in other various assemblies than those illustrated in wall assemblies 310. The wall assemblies 310 may be arranged in accordance with at least one embodiment described in the present disclosure. The wall assemblies 310 may include one or more wall panels 300 including a wall end panel 302, a wall panel 304, a window side panel 306, a window base panel 308, and a window top panel 310. Included in the wall assemblies 310 may be one or more openings such as a door opening 320*a* or a window opening 320*b*. In some embodiments, the number of wall panels 300 may correspond with a configuration of a frame of the modular building unit, such as the frame 110 of the modular building unit 100 of FIG. 1B.

In some embodiments, the number of doors 320*a* and/or windows 320*b* included in the wall assemblies 310 may vary and correspond with different configurations of the modular building unit floor plan, as illustrated in FIGS. 11A-11D. The number of wall panels 300 may vary and may be determined based on the length of the short side or long side wall of a frame. During construction, two wall end panels 302 may be placed on opposite sides of frame 110 with their notches facing opposite directions. Any number of wall panels including 302, 304, 306, 308 and 310 may be placed between the two wall end panels 302 to fill the remaining space and create openings for doors 320*a* and/or windows 320*b*. Wall end panels 302 may be placed at the ends of the wall assembly 310 due to their flat end surface which may rest flat against the frame. The wall panels 300 may be arranged and fitted together to such that the wall panels 300 when assembled in a wall assembly 310 include a flat surface on one or both sides of the wall assembly 310.

In some embodiments, the wall panels 300 of the wall assemblies 310, such as the wall end panel 302, the wall panel 304, the window side panel 306, the window base panel 308 and the window top panel 310 may be made of any material including wood, concrete, aircrete, high density foam, aluminum and metal or any combination of the listed materials or other materials. Panels made of materials such as concrete or aircrete may have steel bars and/or wire mesh reinforcement within the panels. For example, in some embodiments, the panels may be made from aircrete. In these and other embodiments, the wall panels 300 may be individually constructed or constructed from a mold at a manufacturing facility. By using aircrete, the panels may provide strength to the building but allow people to easily lift and install the wall panels 300 without heavy machinery or needing multiple different construction components. Wall panels 300 may weigh 15 pounds to 150 pounds per panel.

In some embodiments, a width of the wall panels 300 may be configured such that the length of the frame and the width of the wall panels 300 are compatible, such that the length of the frame divided by the width of the wall panels 300 may be an integer value. The length, width, and depth of the panels may vary and may be based on the dimensions of the frame into which the panels may be installed.

FIG. 3A illustrates an example exploded view of a wall assembly 310*a* of a modular building unit. The illustrated wall assembly 310*a* may be an example of a wall with a door 320*a*. The number of openings in the completed wall assembly within the frame for doors 320*a* may vary and correspond with different configurations of the modular building unit floor plan, as illustrated in FIGS. 11A-11D.

In some embodiments, the wall assembly 310*a* may include wall end panels 302 and a door 320*a*. The number of wall panels 300 may vary based on the sizing of the frame and the number of doors 320*a* may vary and correspond with different configurations of the modular building unit floor plan, as illustrated in FIGS. 11A-11D. Wall end panels 302 may be arranged to leave an opening in the center for a door 320*a*. Wall end panels 302 may be joined together on either side of door 320*a* which may be centered in the wall assembly 310*a*. Wall end panels 302 may be joined together with their notches facing inward and the flat end surface facing outward to rest against the frame and the door 320*a*. Two wall panels 300 may be joined by mating the flanges of the two notches together. The wall assembly 310*a* may be an example of one or more configurations of a wall that may be assembled using wall panels 300 and wall end panels 302.

In some embodiments, the wall panels 300 may be positioned into a frame one panel at a time. Wall panels 300 may be installed similarly on the short and long sides of the frame 110. Before installing wall panels 300 on the short side of the frame, trim plates, such as trim plates 930*b* and 940*d* illustrated in FIG. 9C, may be installed on either the top or bottom of the frame 110. Before installing wall panels 300 on the long side of the frame, trim plates, such as trim plates 950*b*, 950*c* and 960*b* illustrated in FIG. 9D, may be installed on either the top or bottom of the frame 110. Trim plates may be attached perpendicular to a c-channel, such as a c-channel 920*b* or *c*-channel 920*c* illustrated in FIG. 9B, at the top and bottom. Trim plates may cover 1 inch to 8 inches of the top surface and/or bottom surface of wall panels 300. To position wall panels 300 into place within frame 110, wall panels 300 may be inserted between the trim plates first at the top or bottom before positioning the opposite side of the panel. By attaching the trim plates to the c-channel before installing the wall panels 300, the trim plates may provide a more secure installation to keep wall panels 300 from moving out of position. The wall end panels 302 may be placed into the c-channels 920*b* or 920*c* positioned parallel to the placement of the wall panels 300 and along the frame. The c-channels 920*b* or 920*c* may cover 1 inch to 8 inches of the surface of the wall end panel 302. The remaining wall panels 300 may be positioned into place on top of hollow structural sections (HSS) on the short side frame, such as a HSS 930*a* illustrated in FIG. 9C or on top of floor assembly 200 on the long side and within the trim plates. The remaining trim plates may be installed on the top or bottom remaining locations, attaching to the perpendicular c-channel. By attaching the trim plates, the wall panels 300 may be secured into place to restrict their movement.

In some embodiments, the wall end panels 302 may have a length ranging from 1 foot to 10 feet, a width ranging from 4 inches to 4 feet, and a depth ranging from 2 inches to 10 inches. Wall end panel 302 may have a notch in one end of the panel that may form a flange. The flange may be mated with a flange of other wall panels 300 to join panels together in a similar manner as the floor end panels 202 and the floor panels 204 may be joined together. The notch may extend the entire length of wall end panel 302 and begins on the width surface. The notch may be 0.5 inches to 5 inches in depth into the wall end panel 302 to approximately a center the depth of the wall end panel 302 and may be 0.5 inches to 8 inches in width. The notch may occur on one side of the wall end panel 302 to allow for a flat surface on the other end. Wall end panel 302 may have a width ranging from 4 inches to 4 feet on one surface and a smaller width on the opposite surface with the notch.

FIG. 3B illustrates an example exploded view of a wall assembly 310*b* of a modular building unit. The illustrated wall assembly 310*b* may be an example of a wall with a window 320*b*. The number of openings for windows 320*b* may vary and correspond with different configurations of the modular building unit floor plan, as illustrated in FIGS. 11A-11D.

In some embodiments, wall assembly 310*b* may include wall end panels 302, window side panels 306, window base panels 308, window top panels 310 and a window 320*b*. The number of wall panels 300 may vary based on the sizing of the frame and the number of windows 320*b* may vary and correspond with different configurations of the modular building unit floor plan, as illustrated in FIGS. 11A-11D. Wall end panels 302 may be positioned at the ends of the wall assembly 310*b* to rest the flat end with the frame. Wall end panels 302 may be joined with window side panels 306 to allow for the placement of a window 320*b*. The notch of wall end panel 302 and the notch along the entire length of window side panel 306 may be joined. Window base panel 308 and window top panel 310 may be placed in the center of the wall assembly 310*b* and joined with window side panel 306 to create an opening for a window 320*b* to be installed. The notch of window base panel 308 may be joined with the lower notch of window side panel 306. The notch of window top panel 310 may be joined with the upper notch of window side panel 306. Two wall panels 300 may be joined by mating the flanges of the two notches together. The wall assembly 310*b* may be an example of one or more configurations of the wall that may be assembled using wall panels 300.

In some embodiments, the window side panels 306 may have a length ranging from 1 foot to 10 feet, a width ranging from 4 inches to 4 feet, and a depth ranging from 2 inches to 10 inches. Window side panel 306 may have a lower and upper notch in one end of the window side panel 306 that may form a flange to be joined with other wall panels 300. The lower notch may extend 1 foot to 4 feet up from the lower length of window side panel 306 and begins on the width surface. The upper notch may extend 1 foot to 4 feet down from the upper length of the window side panel 306 and begins on the width surface. The lower and upper notch may leave a flat surface on one end of the panel between the two notches. This flat end surface may range from 1 foot to 4 feet and may remain for the installation of a window 320*b*. The lower and upper notches may be 0.5 inches to 5 inches in depth into the window side panel 306 to approximately a center the depth of the window side panel 306 and may be 0.5 inches to 8 inches in width. Window side panel 306 may have a notch in the opposite end of the window side panel 306 that may form a flange to be joined with other wall panels 300. The notch may extend the entire length of window side panel 306 and begins on the width surface. The notch may be 0.5 inches to 5 inches in depth into the window side panel 306 to approximately a center the depth of the window side panel 306 and may be 0.5 inches to 8 inches in width. The notch may be on opposite ends and of various lengths on both width surfaces of window side panel 306. Window side panel 306 may have a width ranging from 4 inches to 4 feet on both surfaces with the notch at opposite ends.

In some embodiments, the window base panels 308 may have a length ranging from 1 foot to 4 feet, a width ranging from 4 inches to 4 feet, and a depth ranging from 2 inches to 10 inches. Window base panel 308 may have a notch in both ends of the window base panel 308 that may form a flange to be joined with other wall panels 300. The notch may extend the entire length of window base panel 308 and begins on the width surface. The notch may be 0.5 inches to 5 inches in depth into the window base panel 308 to approximately a center the depth of the window base panel 308 and may be 0.5 inches to 8 inches in width. The notch may occur on opposite ends of both width surfaces of window base panel 308. Window base panel 308 may have a width ranging from 4 inches to 4 feet on both surfaces with the notch at opposite ends.

The window top panels 310 may have a length ranging from 1 foot to 4 feet, a width ranging from 4 inches to 4 feet, and a depth ranging from 2 inches to 10 inches. Window top panel 310 may have a notch in both ends of the window top panel 310 that may form a flange to be joined with other wall panels 300. The notch may extend the entire length of window top panel 310 and begins on the width surface. The notch may be 0.5 inches to 5 inches in depth into the window top panel 310 to approximately a center the depth of the window top panel 310 and may be 0.5 inches to 8 inches in width. The notch may occur on opposite ends of both width surfaces of window top panel 310. Window top panel 310 may have a width ranging from 4 inches to 4 feet on both surfaces with the notch at opposite ends.

FIG. 3C illustrates an example exploded view of a solid wall assembly 310*c* of a modular building unit. The illustrated wall assembly 310*c* may be an example of a solid wall without any openings.

In some embodiments, wall assembly 310*c* may include wall end panels 302 and wall panels 304. The number of wall panels 300 may vary based on the sizing of the frame. Wall end panels 302 may be joined with wall panels 304 to create a solid wall. Wall end panels 302 may be joined to wall panels 304 with their notches facing inward and the flat end surface facing outward to rest against the frame. One or more wall panels 304 may be joined together on either side of the wall panel 304. Two wall panels 300 may be joined by mating the flanges of the two notches together. The wall assembly 310*c* may be an example of one or more configurations of the wall that may be assembled using wall panels 300.

In some embodiments, the wall panels 304 may have a length ranging from 1 foot to 10 feet, a width ranging from 4 inches to 4 feet, and a depth ranging from 2 inches to 10 inches. Wall panel 304 may have a notch in both ends of the wall panel 304 that may form a flange to be joined with other wall panels 300. The notch may extend the entire length of wall panel 304 and begins on the width surface. The notch may be 0.5 inches to 5 inches in depth into the wall panel 304 to approximately a center the depth of the wall panel 304 and may be 0.5 inches to 8 inches in width. The notch may occur on opposite ends of both width surfaces of wall panel 304. Wall panel 304 may have a width ranging from 4 inches to 4 feet on both surfaces with the notch at opposite ends.

In some embodiments, an orientation of the wall panels 304 during construction may not be important because the wall panels 304 are symmetrically designed such that wall panels 304 have the same configuration regardless of the orientation of the wall panels 304. As a result of the symmetric design, the construction burden may be reduced. Thus, the design of the wall end panels 302, wall panels 304, window side panels 306, window base panels 308 and window top panels 310 may allow for joinery with reduced complexity and easier installation.

In some embodiments, the interior of the wall panels 300 may be finished with a coat of plaster and paint directly over the aircrete surface. Alternatively, drywall may be installed over the wall panels 300, followed by plaster and paint over the drywall to finish the walls surface. There may be round or rectangular openings in the drywall and/or wall panels 300 to allow MEP systems to be installed inside the unit.

FIG. 4A illustrates an exploded view of a roof assembly 400 of a modular building unit. The roof assembly 400 may be arranged in accordance with at least one embodiment described in the present disclosure. The roof assembly 400 may include a roof top end panel 402, a roof panel 404 and a roof bottom end panel 406. The roof top end panel 402, the roof panel 404 and the roof bottom end panel 406, may be referred to collectively as the roof panels 402, 404, and 406. In some embodiments, the number of roof panels 404 of the roof assembly 400 may correspond with a configuration of a frame of the modular building unit, such as the frame 110 of the modular building unit 100 illustrated in FIG. 1B.

In some embodiments, the roof assembly 400 may include one or more roof top end panels 402 and one or more roof bottom end panels 406. A number of roof panels 404 may vary and may be determined based on the opening size of the frame into which the roof panels 404 are to be installed. Roof top end panel 402 and roof bottom end panel 406 may be placed on opposite sides of roof assembly 400 and any number of roof panels 404 may be placed between to fill the remaining space in an opening of the frame. Roof top end panel 402 may be placed at one end of roof assembly 400 and roof bottom end panel 406 may be placed at the opposite end of roof assembly 400. Roof top end panel 402 and roof bottom end panel 406 may be placed at the ends of the roof assembly 400 due to their flat end surface which may rest flat against the frame. Roof top end panels 402 and roof bottom end panels 406 may be placed with the flat width surface facing down and with the gutter channel facing up when placed in the frame. The roof panels 402, 404, and 406 may be arranged and fitted together to create a flat surface for the roof assembly 400. The design of the roof panels 402, 404, and 406 may allow for joinery with reduced complexity and easier installation.

In some embodiments, each of the roof panels 402, 404, and 406 may have one or more gutter channels on a surface, such as a width surface. The gutter channel may be in the shape of a semi-circle or half circle where half of the diameter may be cut through the roof panels 402, 404, and 406. In some embodiments, first and second gutter channels may be cut into the same width surface of the roof panels 402, 404, and 406 on opposite sides of the roof panels 402, 404, and 406. A gutter channel may be cut through the roof panels 402, 404, and 406 and may have a diameter of 1 inch to 8 inches. As an example, a gutter channel may begin 2 inches to 18 inches from the sides of the roof panels 402, 404, and 406 to a center point of the gutter channel along the width surface of the roof panels 402, 404, and 406. A gutter channel may cut through the entire width of the roof panels 402, 404, and 406. Gutter channels of the panels 402, 404, and 406 may face up when placed into the frame. The gutter channels may be located near ends of the panels 402, 404, and 406. Alternately or additionally, the gutter channels may be located such that at least a distance there between is within a range of 40 to 99 percent of the length of the panels 402, 404, and 406. For example, the gutter channels may be located such that at least a distance there between is at least 40, 50, 60, 70, 80, or 90 percent of the length of the panels 402, 404, and 406. For example, if the length of a panel is 5 ft, the gutter channels may be located such that 80 percent of the length of the panel, i.e. 4 is positioned there between such that the gutter channels are located 6 inches from the edges of the panel.

In some embodiments, the gutter channel in the roof panels 402, 404, and 406 may serve a function for water drainage off the roof. The slope of the roof and the gutter channel may range in size based on the climate the modular building unit 100 is located. For example, some climates may need a smaller or larger gutter based on the annual rainfall. The gutter channel may be on both ends of roof assembly 400 due to the slope of the roof. The roof peak may be in the center of the modular building unit 100 and slopes out towards the long sides of the frame which may lead water to drain into the gutter channel. The roof slope on the far edges of the roof assembly 400 may slope towards the center of the roof which may lead water to drain into the gutter channel from the opposite direction. The water in the gutter channel may drain through the circular opening in HSS tube 940*a*, illustrated in FIG. 9C, and down to the ground. The number of gutter channels and roof peaks may vary based on the desired level of drainage and desired roof slope.

In some embodiments, the roof panels 402, 404, and 406 of the roof assembly 400, such as the roof top end panel 402, the roof panel 404 and the roof bottom end panel 406 may be made of any material including wood, concrete, aircrete, high density foam, aluminum and metal or any combination of the listed materials or other materials. Panels made of materials such as concrete or aircrete may have steel bars and/or wire mesh reinforcement within the panels. For example, in some embodiments, the roof top end panels 402, the roof panels 404 and the roof bottom end panels 406 may be made from aircrete. In these and other embodiments, the roof top end panels 402, the roof panels 404 and the roof bottom end panels 406 may be individually constructed or constructed from a mold at a manufacturing facility. By using aircrete, the roof top end panels 402, the roof panels 404 and the roof bottom end panels 406 provide strength to the building but allow people to easily lift and install the roof top end panels 402, the roof panels 404 and the roof bottom end panels 406 without heavy machinery or needing multiple different construction components. Roof panels 402, 404, and 406 may weigh 25 pounds to 200 pounds per panel.

In some embodiments, a width of the roof panels 402, 404, and 406 may be configured such that the length of the frame and the width of the roof panels 402, 404, and 406 are compatible, such that the length of the frame divided by the width of the roof panels 402, 404, and 406 may be an integer value. The length, width, and depth may vary and may be based on the dimensions of the frame into which the panels may be installed.

In some embodiments, the roof top end panels 402 may have a length ranging from 1 foot to 10 feet, a width ranging from 4 inches to 4 feet, and a depth ranging from 2 inches to 14 inches. The roof top end panel 402 may include a notch in one end of the panel that may form a flange. The flange may be mated with a flange of the roof panel 404 to join panels together. This notch may be on the opposite width surface as roof bottom end panel 406 and may be on the flat width surface, opposite of the gutter channel at the top of the panel. The notch may extend the entire length of roof top end panel 402 and begins on the width surface. The notch may be 0.5 inches to 7 inches in depth into the roof top end panel 402 to approximately a center the depth of the roof top end panel 402 and may be 0.5 inches to 8 inches in width. The notch may occur on one side of the roof top end panel 402 to allow for a flat surface on the other end. Roof top end panel 402 may have a width ranging from 4 inches to 4 feet on one surface and a smaller width on the opposite surface with the notch.

In some embodiments, the roof panels 404 may have a length ranging from 1 foot to 10 feet, a width ranging from 4 inches to 4 feet, and a depth ranging from 2 inches to 14 inches. The roof panel 404 may have a notch in both sides of the roof panel 404 that may form a flange on both sides of the roof panel 404. The flange may be configured to join or mate with a flange of another roof panel 404, roof top end panel 402 or roof bottom end panel 406. The flange may mate with another flange by extending over the other flange such that a surface area of the flanges are in contact and support each other. The notch may extend the entire length of roof panel 404 and begins on the width surface. The notch may be 0.5 inches to 7 inches in depth into the roof panel 404 to approximately a center the depth of the roof panel 404 and may be 0.5 inches to 8 inches in width. The notch may occur on opposite sides of both width surfaces of roof panel 404. Roof panel 404 may have a width ranging from 4 inches to 4 feet on both surfaces with the notch at opposite sides.

In some embodiments, the roof bottom end panels 406 may have a length ranging from 1 foot to 10 feet, a width ranging from 4 inches to 4 feet, and a depth ranging from 2 inches to 14 inches. The roof bottom end panel 406 may include a notch in one end of the panel that may form a flange. The flange may be mated with a flange of the roof panel 404 to join panels together. This notch may be in the opposite width surface as roof top end panel 402 and may be on the width surface of the gutter channel at the top of the panel. The notch may extend the entire length of roof bottom end panel 406 and begins on the width surface. The notch may be 0.5 inches to 7 inches in depth into the roof bottom end panel 406 to approximately a center the depth of the roof bottom end panel 406 and may be 0.5 inches to 8 inches in width. The notch may occur on one side of the roof bottom end panel 406 to allow for a flat surface on the other end. Roof bottom end panel 406 may have a width ranging from 4 inches to 4 feet on one surface and a smaller width on the opposite surface with the notch.

In some embodiments, an orientation of the roof panels 404 during construction may not be important because the roof panels 404 are symmetrically designed such that roof panels 404 have the same configuration regardless of the orientation of the roof panels 404. As a result of the symmetric design, the construction burden may be reduced. Thus, the design of the roof top end panels 402, the roof panels 404 and the roof bottom end panels 406 may allow for joinery with reduced complexity and easier installation.

In some embodiments, the interior surface of the roof assembly 400 may be finished with a coat of plaster and paint directly over the aircrete surface. Alternatively, drywall may be installed over the underside of roof assembly 400, followed by plaster and paint over the drywall to finish the ceiling. There may be round or rectangular openings in the drywall and/or roof assembly 400 to allow MEP systems to be installed inside the unit.

Figure 4B:
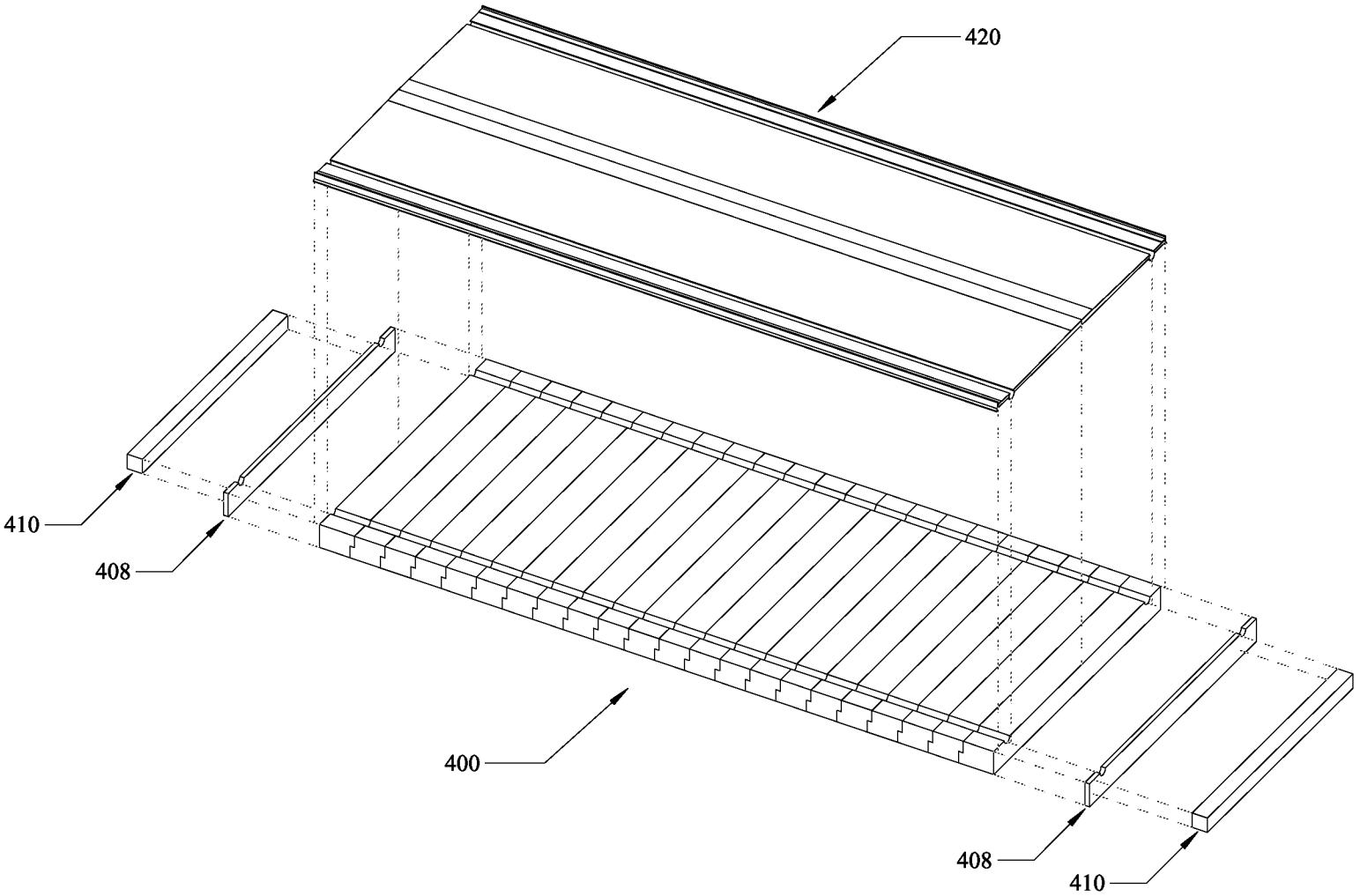
FIG. 4B illustrates an example exploded view of a roof panel assembly and exterior roof panel assembly.

FIG. 4B illustrates an example exploded view of roof assembly 400 and exterior roof assembly 420. Roof assembly 400 may include roof filler panel 408 and roof end filler panel 410. Exterior roof assembly 420 may be assembled on top of roof assembly 400. The roof filler panels 408 and roof end filler panels 410 may be used to close the gap in remaining spaces.

In some embodiments, the roof panels 408 and 410 of the roof assembly 400, such as the roof filler panel 408 and roof end filler panel 410 may be made of any material including wood, concrete, aircrete, high density foam, aluminum and metal or any combination of the listed materials or other materials. Panels made of materials such as concrete or aircrete may have steel bars and/or wire mesh reinforcement within the panels. For example, in some embodiments, the roof filler panels 408 may be made from honeycomb aluminum and roof end filler panels 410 may be made from aircrete. In these and other embodiments, the roof filler panels 408 and roof end filler panels 410 may be individually constructed or constructed from a mold at a manufacturing facility. By using honeycomb aluminum and/or aircrete, the roof panels 408 and 410 provide strength to the building but allow people to easily lift and install the roof filler panels 408 and roof end filler panels 410 without heavy machinery or needing multiple different construction components. Roof panels 408 and 410 may weigh 1 pound to 75 pounds per panel.

In some embodiments, the roof filler panels 408 may have a length ranging from 1 foot to 10 feet, a width ranging from 0.5 inches to 2 feet, and a depth ranging from 2 inches to 14 inches. The roof filler panel 408 may have a gutter channel cut into the top of the panel. The gutter channel may align with the location and dimensions of the gutter channel in roof panels 402, 404 and 406. Roof filler panel 408 may fill the remaining space between the frame 110 and the roof assembly 400. The roof filler panel 408 may be used to prevent roof panels 402, 404, and 406 from shifting within frame 110 and to seal the roof from water. The roof filler panels 408 dimensions may vary based on the remaining space to fill.

In some embodiments, the roof end filler panels 410 may have a length ranging from 1 foot to 10 feet, a width ranging from 0.5 inches to 2 feet, and a depth ranging from 2 inches to 14 inches. Roof end filler panel 410 may fill the remaining space inside a c-channel tube, such as the c-channel tube 940*c*, illustrated in FIG. 9C. The roof end filler panel 410 may be used to insulate the opening within c-channel tube 940*c*. The roof end filler panels 410 dimensions may vary based on the remaining space to fill.

In some embodiments, a number of roof panels 402, 404, and 406 assembled together may be determined based on the dimensions of the frame. The roof panels 402, 404, and 406 are assembled together using the notches to join each end. For example, the notches of two roof panels 402, 404, and 406 may be rested on top or below each other. Roof top end panels 402 may be placed with the notch on top of the panel next. Roof bottom end panels 406 may be placed with the notch below the panel next. Roof panels 404 may be placed in the remaining space with each roof panel 404 including a first notch resting on top of a notch of another roof panel 404 and a second notch being below are carrying another notch of another roof panel 404. During construction of the roof assembly 400, roof panels 402, 404, 406 may be placed one after another within the frame 110 to form the roof assembly 400. Roof filler panels 408 and roof end filler panels 410 may be placed into the frame before, during or after the roof panels 402, 404 and 406 are installed. Roof panels 404 may be joined to other roof panels 404 from either side of the roof panels 404. Roof panels 402, 404, 406 may be placed with the gutter channel facing up and the flat surface down within the frame 110. Roof panels 402, 404, 406 may be rotated to join the panel next but not flipped so that the gutter channel faces down.

In some embodiments, the roof panels 402, 404, and 406 may be set into the frame one or more panels at a time. The roof panels 402, 404, 406 may rest on an angle, such as angle 960*a* illustrated in FIG. 9D, positioned perpendicular to the placement of the roof panels 402, 404, 406 and along the long side of the frame. The bottom flange of the angle 960*a* may support the roof panels 402, 404, 406 by 1 inch to 8 inches.

In some embodiments, the roof top end panel 402 and the roof bottom end panel 406 may rest on a c-channel tube, such as the c-channel tube 940*c* illustrated in FIG. 9C, positioned parallel to the placement of the roof panels 402, 404, 406 and along the short side of the frame. The bottom flange of the c-channel tube may support the roof top end panels 402 and the roof bottom end panels 406 by 1 inch to 8 inches.

In some embodiments, a roof top end panel 402 and roof bottom end panel 406 may be placed at opposite ends of the roof assembly 400 to create a flat surface close to the frame side. Any number of roof panels 404 may be placed in between to complete the roof assembly 400 for an entirely flat roof surface. One or more roof filler panels 408 may be placed on either side of the outermost panel of the roof assembly 400 to fill the roof opening of frame 110. One or more roof end filler panels 410 may be placed next to roof filler panels 408 and inside of c-channel tube 940*c* to fill the opening inside.

Figure 5A:
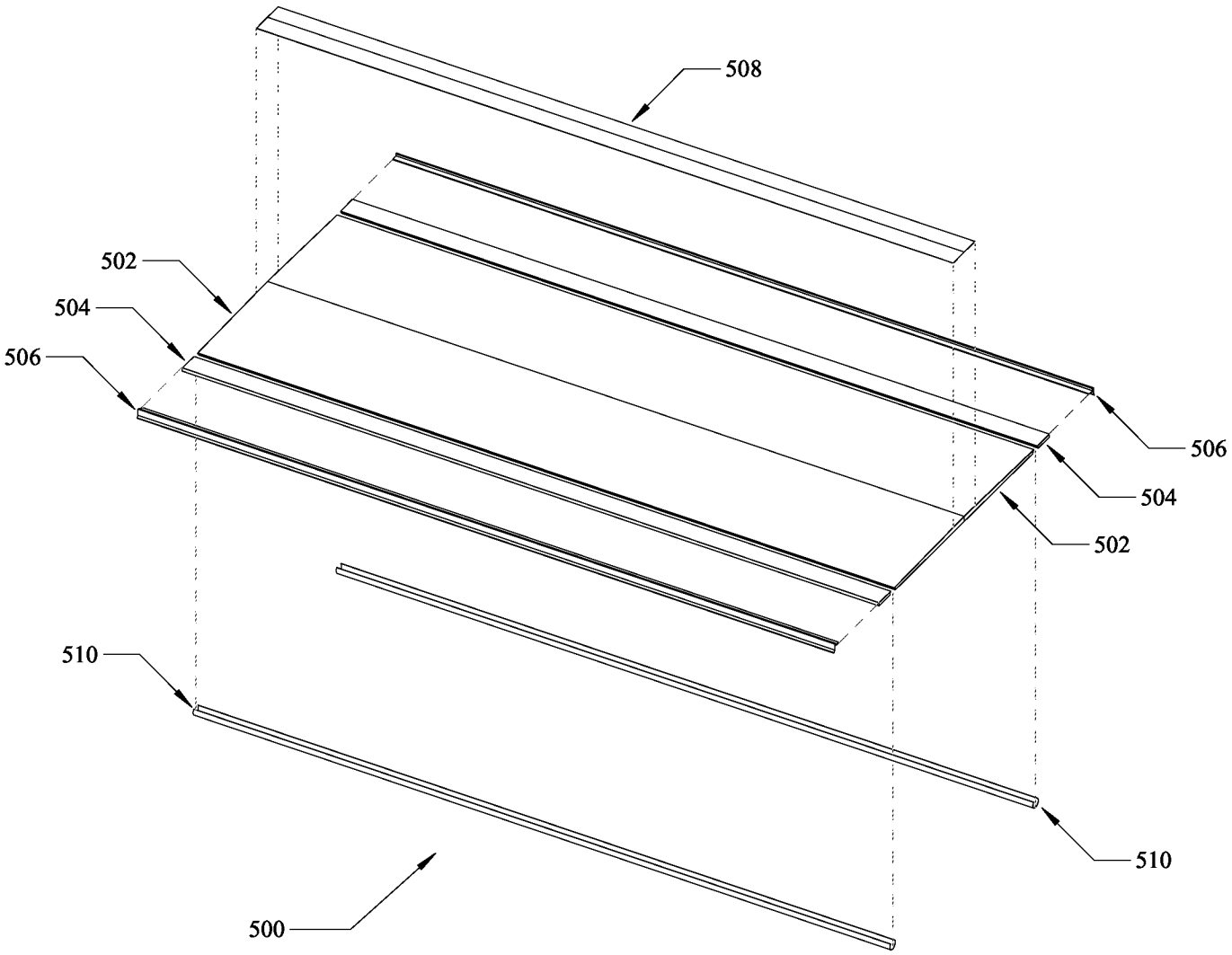
FIG. 5A illustrates an example exploded view of an exterior roof panel assembly.

FIG. 5A illustrates an example exploded view of an exterior roof assembly 500 of a modular building unit. The exterior roof assembly 500 may be arranged in accordance with at least one embodiment described in the present disclosure. Exterior roof assembly 500 may include exterior center roof panel 502, exterior end roof panel 504, roof drip edge cover 506, roof ridge 508 and roof gutter channel 510.

In some embodiments, after the roof assembly 400 is aligned into position, the exterior roof assembly 500 may be installed on top of the roof assembly 400. The exterior roof assembly 500 may be attached to the roof assembly 400 and/or the frame assembly 900 using screws or nuts and bolts of various sizes. Vapor barrier membranes and materials may be installed with the exterior roof assembly 500 as necessary to prevent water from getting inside the unit.

In some embodiments, the exterior roof assembly 500 including, exterior center roof panel 502 and exterior end roof panel 504, may have joinery at the ends of one or more panels similar to the floor assembly 200, wall panels 300 and roof assembly 400 and may be assembled similarly. The panels may have a similar installation and joinery method as illustrated in FIG. 2B. In some instances, the panels may vary in size but the assembly may remain the same throughout the panel types. The joinery on the ends of the panels such as the notches may be one of many shapes used to join panels together. Various other shapes and sizes of end joints may be used to connect panels together. For example, another joinery method of panels may be with a male and female design where the end of one panel may be inserted into an opening in the end of the panel next to it. Alternatively, panels may have flat ends with a frame around one or more sides of each panel and the ends of the panel frames may connect the panels together, holding the panels into place.

In some embodiments, the exterior roof assembly 500 may include the exterior center roof panel 502, exterior end roof panel 504, roof drip edge cover 506, roof ridge 508 and roof gutter channel 510. The exterior roof assembly 500 may be made of any material including wood, concrete, aircrete, high density foam, aluminum and metal or any combination of the listed materials or other materials. Panels made of materials such as concrete or aircrete may have steel bars and/or wire mesh reinforcement within the panels. For example, in some embodiments, the exterior roof assembly 500 may be made from honeycomb aluminum. In these and other embodiments, the exterior roof assembly 500 may be individually constructed or constructed from a mold at a manufacturing facility. By using honeycomb aluminum, the exterior roof assembly 500 may provide strength to the building but allow people to easily lift and install the exterior roof assembly 500 without heavy machinery or needing multiple different construction components. The exterior roof assembly 500 may weigh 1 pound to 75 pounds per component.

In some embodiments, exterior center roof panel 502 may have a length ranging from 2 feet to 20 feet, a width ranging from 1 foot to 8 feet and a depth ranging from 0.5 inches to 4 inches. Exterior center roof panel 502 may have one or more sides with a slope ranging from 0 inches to 4 inches per 1 foot. There may be one or more sides on the width ends of exterior center roof panel 502 which may be curved with a radius ranging from 0.5 inches to 3 inches. There may be one or more sides on the width ends of exterior center roof panel 502 which may be taller in height than the other side. The exterior center roof panel 502 may have a top layer with a thickness ranging from 1/32 inch to 1/2 inch which may extend over one or more sides of the panel. The top layer of exterior center roof panel 502 may extend 1/16 inch to 2 inches in length over the width side and 1/8 inch to 3 inches in height down the depth of the exterior center roof panel 502. The top layer of exterior center roof panel 502 may have an angled edge ranging from 5 degrees to 90 degrees and may serve a function as a drip edge into the roof gutter channel 510. Exterior center roof panel 502 may serve a function to seal roof assembly 400 below from water.

In some embodiments, exterior end roof panel 504 may have a length ranging from 2 feet to 20 feet, a width ranging from 1 foot to 4 feet and a depth ranging from 0.5 inches to 4 inches. Exterior end roof panel 504 may have one or more sides with a slope ranging from 0 inches to 4 inches per 1 foot. There may be one or more sides on the width ends of exterior end roof panel 504 which may be curved with a radius ranging from 0.5 inches to 3 inches. There may be one or more sides on the width ends of exterior end roof panel 504 which may be taller in height than the other side. The exterior end roof panel 504 may have a top layer with a thickness ranging from 1/32 inch to 1/2 inch which may extend over one or more sides of the panel. The top layer of exterior end roof panel 504 may extend 1/16 inch to 2 inches in length over the width side and 1/8 inch to 3 inches in height down the depth of the panel. The top layer of exterior end roof panel 504 may have an angled edge ranging from 5 degrees to 90 degrees and may serve a function as a drip edge into the roof gutter channel 510. Exterior end roof panel 504 may serve a function to seal roof assembly 400 below from water.

In some embodiments, the exterior roof assembly 500 may include one or more exterior center roof panels 502 and one or more exterior end roof panels 504. A number and size of exterior center roof panels 502 and exterior end roof panels 504 may vary and may be determined based on the size of the roof assembly 400 below onto which the exterior center roof panels 502 and exterior end roof panels 504 are installed. Exterior center roof panels 502 may be placed in the center of roof assembly 400 and perpendicular to roof panels 402, 404, and 406. The curved ends of exterior center roof panels 502 may face out towards the ends of the roof assembly 400 and may align with the gutter channel radius in roof panels 402, 404, and 406. Exterior end roof panels 504 may be placed on the ends of roof assembly 400 and perpendicular to roof panels 402, 404, and 406. The curved ends of exterior end roof panels 504 may face in towards the center of the roof assembly 400 and may align with the gutter channel radius in roof panels 402, 404, and 406. Exterior center roof panel 502 and exterior end roof panels 504 may be attached to the frame 110 and roof assembly 400 with screws or nuts and bolts of various sizes.

In some embodiments, roof drip edge cover 506 may have a length ranging from 2 feet to 20 feet and a thickness ranging from 1/32 inch to 1/2 inch. Roof drip edge cover 506 may have multiple segments of various lengths. Roof drip edge cover 506 may be placed over the vertical flange of angle 960*a*, illustrated in FIG. 9D, and over the top surface of exterior end roof panel 504. The segment which may cover exterior end roof panel 504 may have a length ranging from 1 inch to 8 inches and may have a slope ranging from 0 inches to 4 inches per 1 foot. The segment which may extend up from exterior end roof panel 504 may have a length ranging from 1/2 inch to 4 inches and there may be a segment extending over the top flange of 960*a* ranging from 1/16 inch to 2 inches. The segment which may extend down the exterior side of angle 960*a* may have a length ranging from 1 inch to 8 inches. The end of the segment down the exterior length of angle 960*a* may be angled ranging from 5 degrees to 90 degrees with a length ranging from 1/2 inch to 4 inches. The end segments of roof drip edge cover 506 may have an angled edge ranging from 5 degrees to 90 degrees. The roof drip edge cover 506 may seal the long edge of the roof assembly 400 from water.

In some embodiments, roof ridge 508 may have a length ranging from 2 feet to 20 feet, a width ranging from 1 foot to 4 feet and a thickness ranging from 1/32 inch to 1/2 inch. Roof ridge 508 may have one or more sides with a slope ranging from 0 inches to 4 inches per 1 foot. There may be one or more width segments of roof ridge 508 ranging from 2 inches to 2 feet. The width segments of roof ridge 508 may be angled with a slope ranging from 0 inches to 4 inches per 1 foot to match the slope of the exterior roof assembly 500. Roof ridge 508 may be placed over exterior center roof panels 502 and may serve a function to seal the seam between exterior center roof panels 502 from water.

In some embodiments, the roof gutter channel 510 may have a length ranging from 2 feet to 20 feet and a thickness ranging from 1/32 inch to 1/2 inch. Roof gutter channel 510 may be curved with a radius ranging from 0.5 inches to 3 inches. The edges of roof gutter channel 510 ends may be angled ranging from 5 degrees to 90 degrees. Roof gutter channel 510 may be placed in the gutter channel of roof panels 402, 404, and 406. Exterior center roof panel 502 and exterior end roof panel 504 may be placed over roof gutter channel 510. Roof gutter channel 510 may serve a function to seal roof assembly 400 below from water.

In some embodiments, the exterior roof assembly 500 may include one or more roof drip edge cover 506, roof ridge 508 and roof gutter channel 510. Roof drip edge cover 506 may be placed on top of exterior end roof panel 504 and over the vertical flange of angle 960*a*. Roof ridge 508 may be placed in the center of exterior roof assembly 500 and parallel over the seam between exterior center roof panels 502 to seal the roof from water. Roof gutter channel 510 may be placed to align into the gutter channel of roof panels 402, 404, and 406 and between exterior center roof panel 502 and exterior end roof panel 504 which may be placed over top to complete the gutter radius. Roof gutter channel 510 may be sloped from the center out to the ends or from one end to the other ranging from 1/16 inch to 1 inch per 1 foot to allow water to flow through and out through the opening in HSS tube 940*a*, illustrated in FIG. 9C. Roof drip edge cover 506 and roof ridge 508 may be attached to the frame 110, exterior center roof panels 502 and exterior end roof panels 504 with screws or nuts and bolts of various sizes. Roof gutter channel 510 may be attached to the frame 110, roof assembly 400, exterior center roof panels 502 and exterior end roof panels 504 with screws or nuts and bolts of various sizes.

In some embodiments, on top of the exterior roof assembly 500 there may be an ethylene propylene diene terpolymer (EPDM) roof installed over exterior center roof panels 502, exterior end roof panels 504 and roof gutter channel 510. The roof drip edge cover 506 and roof ridge 508 may be installed over the EPDM roof to secure it in place. The EPDM roof perimeter may extend over all the perimeter edges and seal all the roof edges to prevent water from leaking inside. The EPDM roof may be installed through the entire length of the roof gutter channel 510 to allow water to flow through easily. The EPDM roof may continue through the round gutter opening in HSS tube 940*a* to seal the opening from any water leakage.

In some embodiments, gutters and drain systems may be attached and installed on the modular building unit 100 to shed the rainwater away from the unit 100. The gutter may be attached to the exterior roof assembly 500 and/or the frame assembly 900 as necessary for install. The roof gutter channel 510 may flow water through the channel into a gutter below attached to HSS tube 940*a* on the short sides of the frame 110. The gutter may flow water down a drain attached to the sides of corner columns 920*a*, illustrated in FIG. 9B, and down to the ground below. Gutters and drains from multiple modular building units 100 next to each other may be attached as one larger system for the entire building.

Figure 6A:
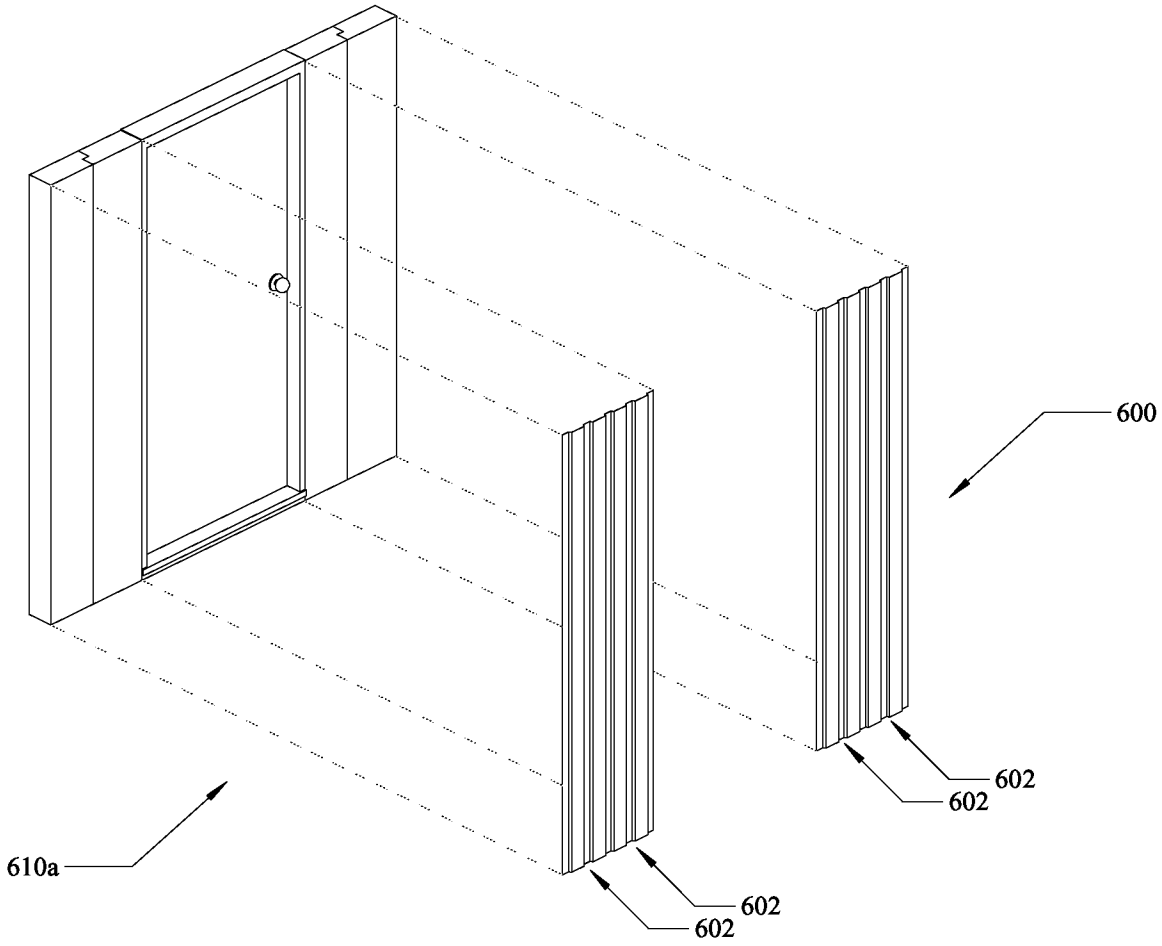
FIG. 6A illustrates an example exploded view of an exterior siding panel assembly and a wall assembly with a door.
Figure 6B:
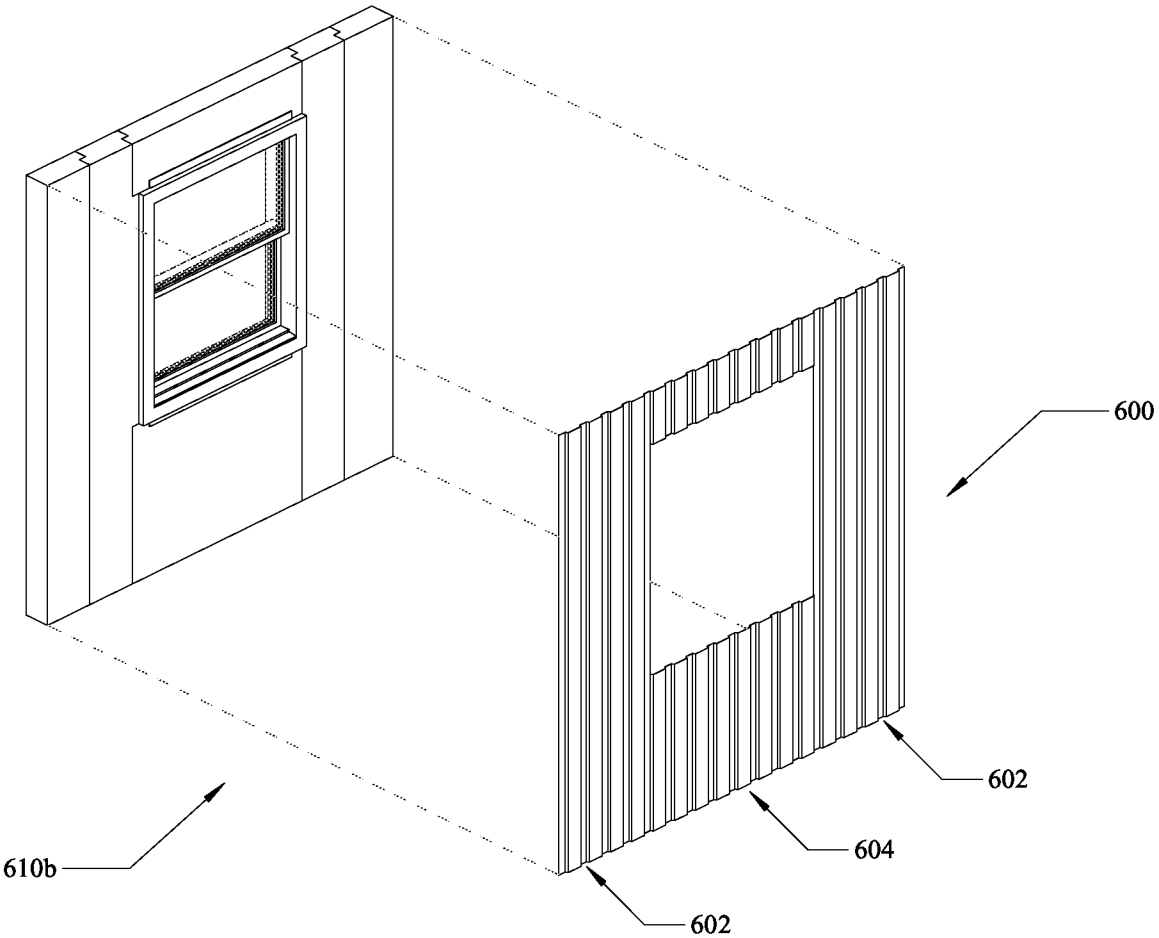
FIG. 6B illustrates an example exploded view of an exterior siding panel assembly and a wall assembly with a window.
Figure 6C:
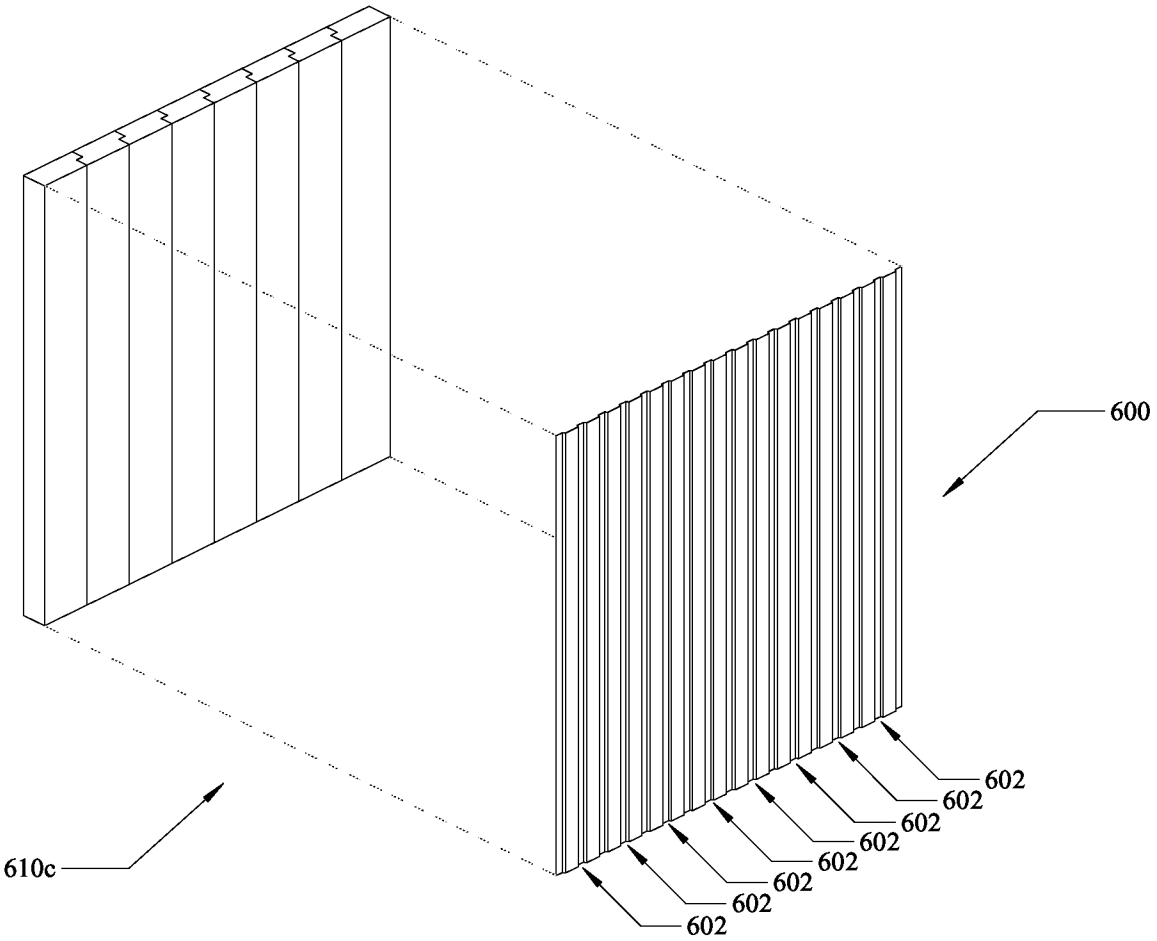
FIG. 6C illustrates an example exploded view of an exterior siding panel assembly and a solid wall assembly.

FIGS. 6A-6C illustrates an example exploded view of exterior siding assemblies 610 of a modular building unit built using exterior siding panels 600. The exterior siding assemblies 610 may be arranged in accordance with at least one embodiment described in the present disclosure. FIGS. 6A-6C illustrate an exterior siding assembly 610*a* configured for a door, an exterior siding assembly 610*b* configured for a window, and a solid exterior siding assembly 610*c*, referred to collectively as the exterior siding assemblies 610.

In some embodiments, the number of the exterior siding assemblies 610 configured for a door and/or a window that may be used in a modular building unit 100 may vary and correspond with different configurations of the modular building unit floor plan, as illustrated in FIGS. 11A-11D. Thus, in some embodiments, the exterior siding panels 600 may be joined in other various assemblies than those illustrated in exterior siding assemblies 610. The exterior siding assemblies 610 may be arranged in accordance with at least one embodiment described in the present disclosure. The exterior siding assemblies 610 may include one or more of exterior siding panels 602 and exterior window siding panels 604. Included in the exterior siding assemblies 610 may be one or more openings such as a door or window, such as door 170 or window 180, of FIG. 1B. In some embodiments, the number of exterior siding panels 600 may correspond with a configuration of a frame of the modular building unit, such as the frame 110 of the modular building unit 100 of FIG. 1B.

In some embodiments, the number of doors and/or windows included in the exterior siding assemblies 610 may vary and correspond with different configurations of the modular building unit floor plan, as illustrated in FIGS. 11A-11D. The number of exterior siding panels 600 may vary and may be determined based on the length of the short side or long side wall of the frame 110. During construction, two exterior siding panels 602 may be placed on opposite sides of the frame 110. Any number of exterior siding panels 602 and exterior window siding panels 604 may be placed between the two exterior siding panels 602 to fill the remaining space and create openings for doors and/or windows.

In some embodiments, the exterior siding panels 600 of the exterior siding assemblies 610, such as the exterior siding panel 602 and the exterior window siding panel 604 may be made of any material including wood, vinyl, high density foam, aluminum and metal or any combination of the listed materials or other materials. For example, in some embodiments, the panels may be made from corrugated aluminum. In these and other embodiments, the exterior siding panels 600 may be individually constructed or constructed from a mold at a manufacturing facility. By using corrugated aluminum, the panels provide strength to the building but allow people to easily lift and install the exterior siding panels 600 without heavy machinery or needing multiple different construction components. Exterior siding panels 600 may weigh 1 pound to 50 pounds per panel.

In some embodiments, the exterior siding panels 600 may be arranged and fitted together to such that the exterior siding panels 600 when assembled in an exterior siding assembly 610 are joined at the ends within the corrugation of the exterior siding panels 600.

In some embodiments, exterior siding panels 600 may be in different shapes and sizes as illustrated in FIGS. 6A-6D based on the desired appearance of the unit. The corrugation increments may be of various dimensions based on the panel shape. Alternatively, the exterior siding panels 600 may be curved, angled or flat with various increment dimensions. The ends of the panels may have different shapes to overlap, join and/or lock panels together based on the panel design. The exterior siding panels 600 may be assembled together side by side or one on top of the other based on the material of the panels and the shape of the panels design.

In some embodiments, a modular building unit 100 may not use exterior siding panels 600 for an exterior wall finish. In this case, exterior siding panels 600, bottom c-channel 930*c*, top c-channel 940*e*, bottom channel plate 950*d*, and top channel plate 960*c*, illustrated in FIG. 9C and FIG. 9D, may not be required to complete construction. The exterior of the wall panels 300 may be finished with a vapor membrane such as a layer of liquid rubber sealant or may be finished with a layer of stucco to prevent water from leaking inside. Various other exterior siding materials and finishes may be used as alternatives over a vapor barrier including pressure treated wood siding, vinyl siding or any combination of the listed materials or other materials.

Figure 6D:
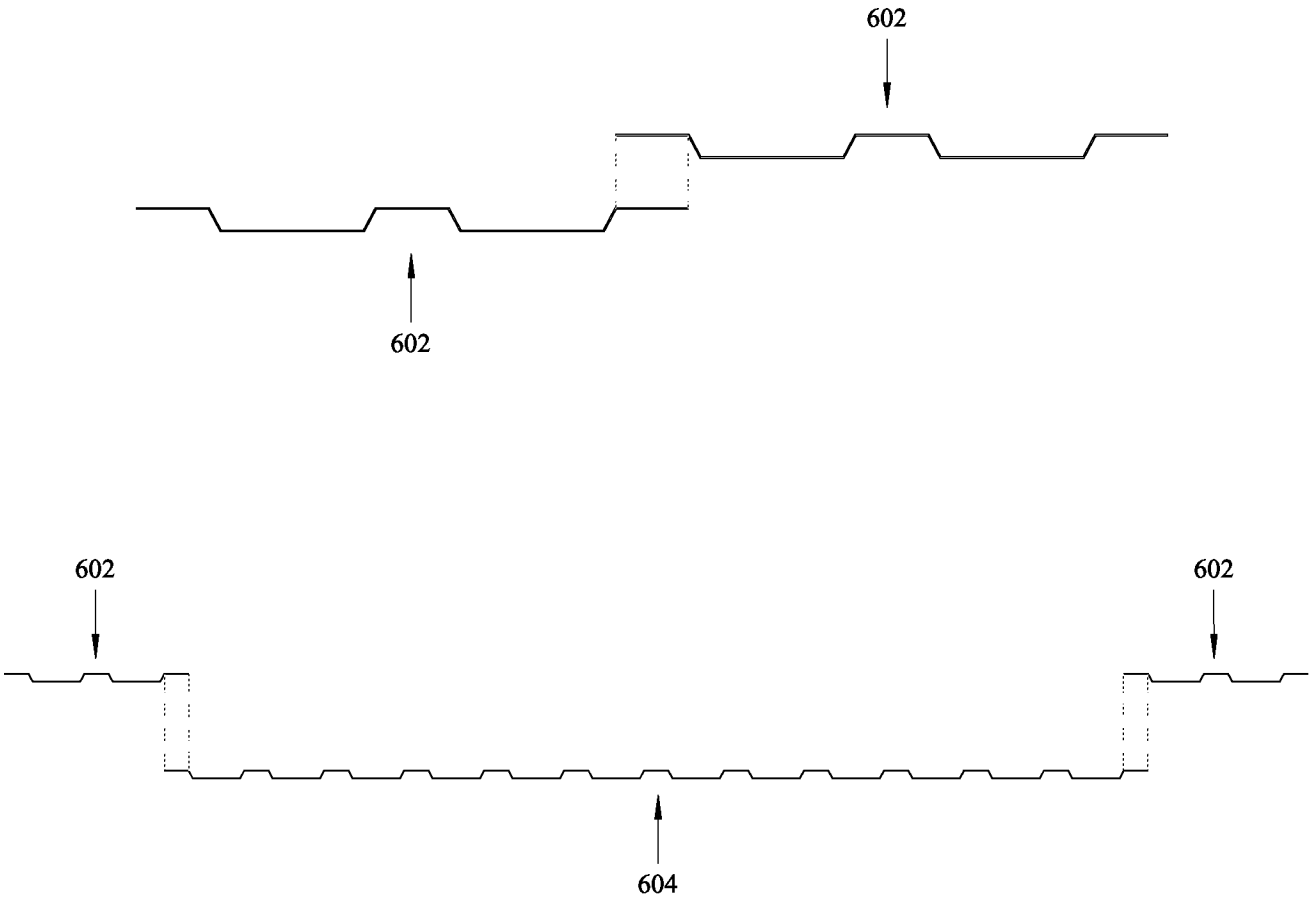
FIG. 6D illustrates an example plan view of the joinery of exterior siding panels.

In some embodiments, the exterior siding panels 600 may be positioned into the frame one panel at a time. Before installing exterior panels 600, bottom c-channel 930*c* or bottom channel plate 950*d* and top c-channel 940*e* or top channel plate 960*c* may be installed into place within the frame 110. To position exterior siding panels 600 into place within frame, exterior siding panels 600 may be first be inserted up within the channel opening of top c-channel 940*e* or top channel plate 960*c* and then down into the channel opening of bottom c-channel 930*c* or bottom channel plate 950*d*. The channel openings of top c-channel 940*e* and top channel plate 960*c* may be larger in depth than the channel openings of bottom c-channel 930*c* and bottom channel plate 950*d* in order to have space to lower exterior siding panels 600 into the channel below. The channel flanges or plates of bottom c-channel 930*c*, bottom channel plate 950*d*, top c-channel 940*e* and top channel plate 960*c* may cover ¼ inch to 8 inches of the surface of the exterior siding panels 600 when installed. Exterior siding panels 600 may be secured into place by resting within the channel openings to restrict their movement. Exterior siding panels 600 may be attached to other exterior siding panels 600, wall panels 300 and/or frame assembly 900 using screws or nuts and bolts of various sizes if necessary. The exterior siding panels 600 may be installed in any order so long as the ends of each exterior siding panel 600 overlap as illustrated in FIG. 6D. The exterior siding panels 600 may be installed after the frame assembly 900, the floor assembly 200 and the wall panels 300 are partially or entirely assembled.

FIG. 6A illustrates an example exploded view of an exterior siding assembly 610*a* of a modular building unit. The illustrated exterior siding assembly 610*a* may be an example of an exterior wall with a door. The number of openings in the completed exterior siding assembly 610*a* within the frame for doors may vary and correspond with different configurations of the modular building unit floor plan, as illustrated in FIGS. 11A-11D.

In some embodiments, the exterior siding assembly 610*a* may include exterior siding panel 602. The number of exterior siding panels 600 may vary based on the sizing of the frame and the number of doors may vary and correspond with different configurations of the modular building unit floor plan, as illustrated in FIGS. 11A-11D. Exterior siding panels 602 may be arranged to leave an opening in the center for a door. Exterior siding panels 602 may be joined together on either side of door 700, illustrated in FIG. 7B, which may be centered in the exterior siding assembly 610*a*. Exterior siding panels 602 may be joined by overlapping at the width ends of the corrugated panels. Two exterior siding panels 600 may be joined by overlapping the corrugated panel ends. The exterior siding assembly 610*a* may be an example of one or more configurations of exterior siding that may be assembled using exterior siding panels 600.

In some embodiments, the exterior siding assemblies 610 may include one or more exterior siding panels 602 and one or more exterior window siding panels 604. A number of exterior siding panels 600 may vary and may be determined based on the size of the wall and/or the number of openings for doors and/or windows.

In some embodiments, the exterior siding panel 602 may have a length ranging from 1 foot to 10 feet, a width ranging from 6 inches to 4 feet, a depth ranging from ⅛ inch to 4 inches and a thickness ranging from 0 inches to 2 inches. The exterior siding panel 602 may be corrugated and may have repeated corrugated segments ranging from ½ inch to 2 feet in width. The angle of the exterior siding panel 602 between corrugated segments may range from 5 degrees to 90 degrees. The corrugated segments may be the same or of different widths throughout exterior siding panels 602.

FIG. 6B illustrates an example exploded view of an exterior siding assembly 610*b* of a modular building unit. The illustrated exterior siding assembly 610*b* may be an example of an exterior wall with a window. The number of openings in the completed exterior siding assembly 610*b* within the frame for windows may vary and correspond with different configurations of the modular building unit floor plan, as illustrated in FIGS. 11A-11D.

In some embodiments, the exterior siding assembly 610*b* may include exterior siding panel 602 and exterior window siding panel 604. The number of exterior siding panels 600 may vary based on the sizing of the frame and the number of windows may vary and correspond with different configurations of the modular building unit floor plan, as illustrated in FIGS. 11A-11D. Exterior siding panels 602 may be arranged to leave an opening in the center for a window. Exterior window siding panels 604 may be installed with the opening in the panel to fit around the window 800, illustrated in FIG. 8A. Exterior siding panels 602 may be joined on either side of exterior window siding panel 604 which may be centered in the exterior siding assembly 610*b*. Exterior siding panels 602 may be joined with exterior window siding panels 604 by overlapping at the width ends of the corrugated panels. Two exterior siding panels 600 may be joined by overlapping the corrugated panel ends. The exterior siding assembly 610*b* may be an example of one or more configurations of exterior siding that may be assembled using exterior siding panels 600.

In some embodiments, the exterior window siding panel 604 may have a length ranging from 1 foot to 10 feet, a width ranging from 3 feet to 9 feet, a depth ranging from ⅛ inch to 4 inches and a thickness ranging from 0 inches to 2 inches. The exterior window siding panel 604 may be corrugated and may have repeated corrugated segments ranging from ½ inch to 2 feet in width. The angle of the exterior siding panel 602 between corrugated segments may range from 5 degrees to 90 degrees. The corrugated segments may be the same or of different widths throughout exterior window siding panel 604. There may be an opening in exterior window siding panel 604 for the installation of a widow. The opening in exterior window siding panel 604 may have a width ranging from 1 foot to 5 feet and a height ranging from 1 foot to 5 feet and may be centered in the width of the panel. The opening in exterior window siding panel 604 may begin 1 foot to 4 feet from the bottom of the panel and the opening may end 6 inches to 4 feet from the top of the panel.

FIG. 6C illustrates an example exploded view of a solid exterior siding assembly 610*c* of a modular building unit. The illustrated exterior siding assembly 610*c* may be an example of a solid exterior wall without any openings.

In some embodiments, the exterior siding assembly 610*c* may include exterior siding panel 602. The number of exterior siding panels 600 may vary based on the sizing of the frame and may vary and correspond with different configurations of the modular building unit floor plan, as illustrated in FIGS. 11A-11D. Exterior siding panels 602 may be joined by overlapping at the width ends of the corrugated panels. Two exterior siding panels 600 may be joined by overlapping the corrugated panel ends. The exterior siding assembly 610*c* may be an example of one or more configurations of exterior siding that may be assembled using exterior siding panels 600.

FIG. 6D illustrates an example of the exterior siding panels 600 of FIGS. 6A-6C from a different perspective. The number of exterior siding panels 600 may vary from the illustration. A number of exterior siding panels 600 assembled together may be determined based on the dimensions of the exterior siding assemblies 610. Exterior siding panels 602 and exterior window siding panels 604 may be joined by overlapping at the width ends of the corrugated panels. Two exterior siding panels 600 may be joined by overlapping the corrugated panel ends ranging from ½ inch to 2 feet. During construction of the exterior siding assembly 610, exterior siding panels 600 may be placed one after another within the frame to form the exterior siding assembly 610. Exterior siding panels 602 and exterior window siding panels 604 may be joined to each other from either side of the exterior panels 600. The exterior siding panels 602 are designed symmetrically such that the panels may be the same dimensions regardless of the panel facing up or down during construction. As a result of the symmetric design, the construction burden may be reduced. Thus, the design of the exterior siding panels 602 and exterior window siding panels 604 may allow for joinery with reduced complexity and easier installation.

Figure 7A:
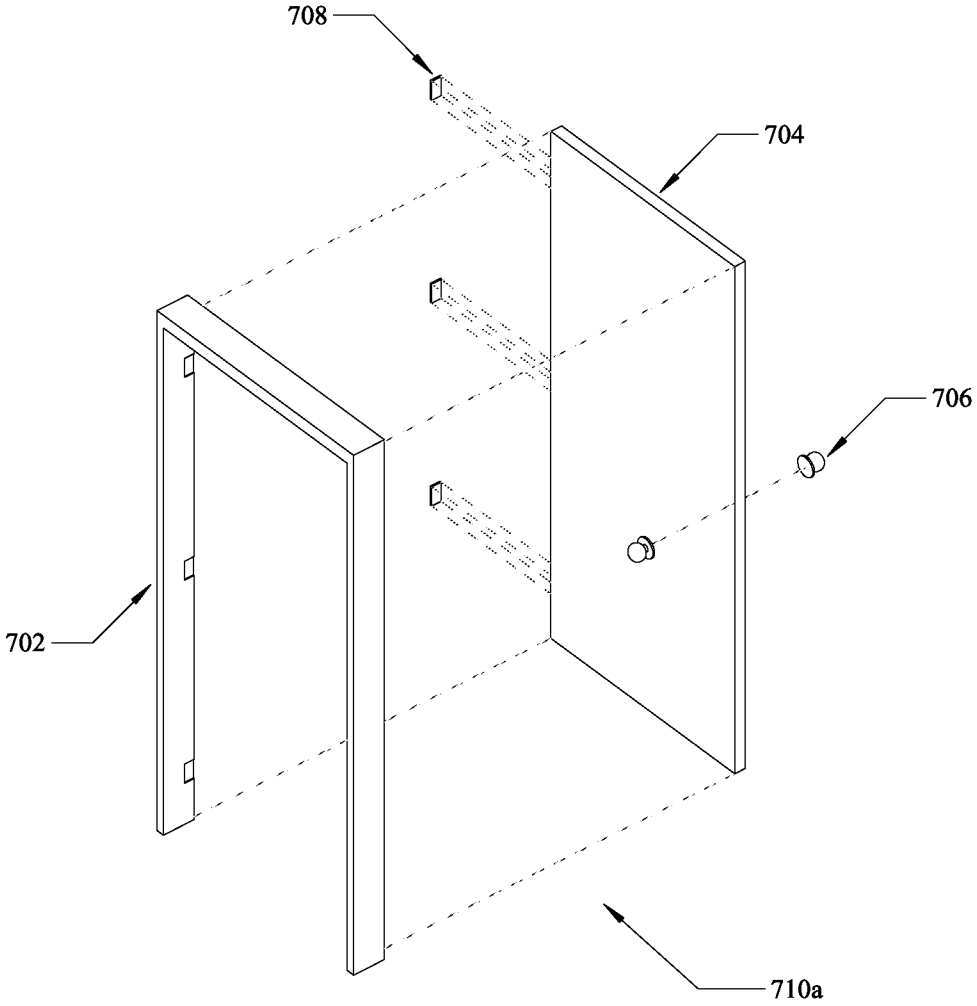
FIG. 7A illustrates an example exploded view of a door assembly.
Figure 7B:
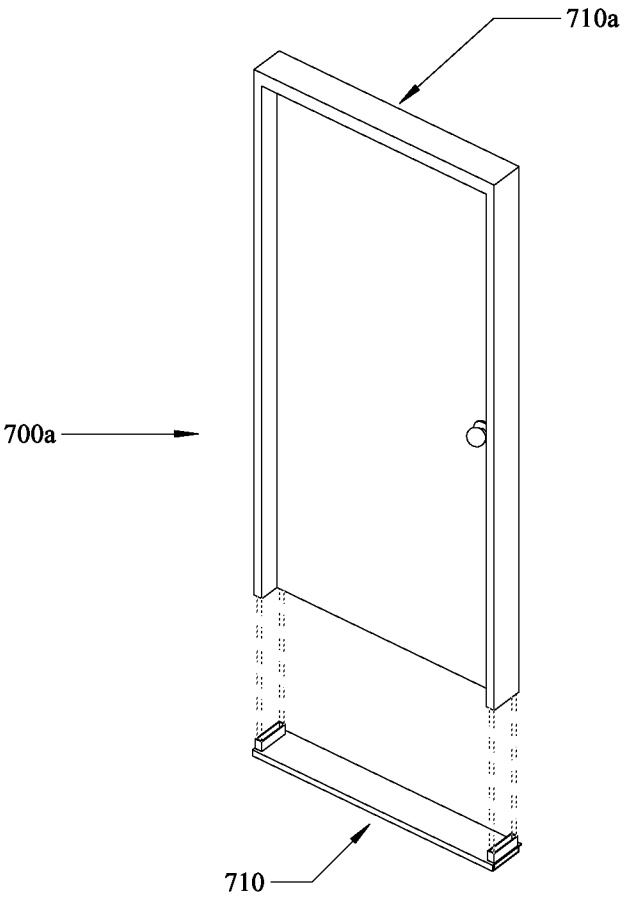
FIG. 7B illustrates an example exploded view of a door assembly and base frame.
Figure 7C:
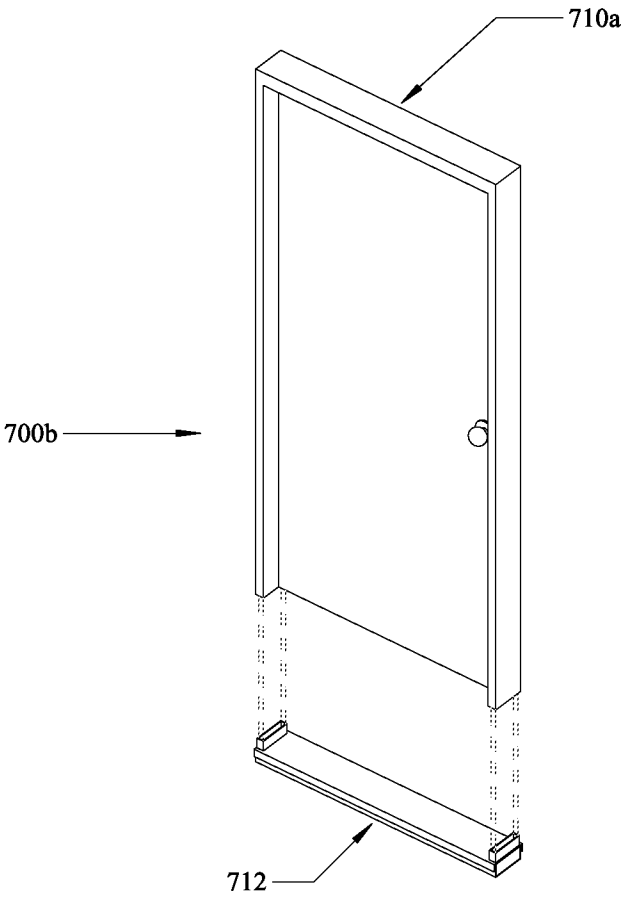
FIG. 7C illustrates an example exploded view of a door assembly and another base frame.

FIG. 7A illustrates an example exploded view of a door assembly 710*a* for a modular building unit. The door assembly 710*a* may be arranged in accordance with at least one embodiment described in the present disclosure. FIGS. 7A-7C illustrate a door 700*a* and 700*b*, a door assembly 710*a*, a door frame small base 710 and a door frame large base 712. Use of the term door 700 may refer to either the door 700*a* or the 700*b*.

The discussion and the illustration in FIGS. 7A-7C of a door 700 provides an illustration of the door without providing all the details of a door. Further elements of a door may be added in an implementation without deviating from the scope of this disclosure.

In some embodiments, the number of the doors 700 may vary and correspond with different configurations of the modular building unit floor plan, as illustrated in FIGS. 11A-11D. Thus, in some embodiments, the doors 700 may be joined in other various assemblies than those illustrated. The doors 700 may be arranged in accordance with at least one embodiment described in the present disclosure. The door assembly 710*a* may include one or more door frame 702, door panels 704, door handle 706 and door hinge 708. The doors 700 may include one or more door frame small base 710 and door frame large base 712. In some embodiments, the number of doors 700 may correspond with a configuration of a frame of the modular building unit, such as the frame 110 of the modular building unit 100 of FIG. 1B.

In some embodiments, the number of doors 700 may be based on the design of the modular building unit. The number of doors 700 may vary and may be determined based on the length of the short side or long side wall of the frame.

In some embodiments, the doors 700 including door assembly 710*a*, door frame small base 710 and door frame large base 712 may be made of any material including wood, laminate, fiberglass, stainless steel, aluminum and hollow metal or any combination of the listed materials or other materials. For example, in some embodiments, the doors 700 may be made from fiberglass. In these and other embodiments, the doors 700 may be individually constructed or constructed from a mold at a manufacturing facility. By using fiberglass, the door 700 may provide a long lasting and protective barrier between the outside and inside of the building. Doors 700 may weigh 10 pounds to 150 pounds per door.

In some embodiments, the doors 700 may be installed by first positioning either the door frame small base 710 or the door frame large base 712 into position and then inserting the bottom of door frame 702 of door assembly 710*a* into the door base. Door frame small base 710 may be positioned on top of floor assembly 200 and between bottom trim plate 950*b* and bottom trim plate 950*c*. Door frame large base 712 may be positioned on top of HSS 930*a* and between bottom trim plates 930*b*. Door assembly 710*a* may be inserted up in between top trim plates 940*d* on the short side or top trim plates 960*b* on the long side. The top of door frame 702 of door assembly 710*a* may be attached to the top trim plates using screws or nuts and bolts of various sizes. The sides of the door frame 702 of door assembly 710*a* may rest flat against wall end panels 302 on either side.

In some embodiments, the door frame 702 may have an exterior frame size with a height ranging from 3 feet to 9 feet, a width ranging from 2 feet to 4 feet, a depth ranging from 4 inches to 8 inches and a thickness ranging from ¾ inch to 4 inches. Door frame 702 may be a fiberglass frame with a thickness ranging from 1/16 inch to ¼ inch. The door frame 702 may be hollow inside and the base of the door frame 702 may be inserted into door frame small base 710 or door frame large base 712. Within one or more interior sides of door frame 702 there may be one or more rectangular cut outs used to attach door hinges 708. The rectangular cut outs may have a length ranging from 2 inches to 8 inches, a width ranging from 1 inch to 6 inches and a thickness ranging from 1/16 inch to 2 inches. The cut outs for the door hinges 708 may be positioned with one in the center of the door frame 702, one spaced off the base of the frame ranging from 6 inches to 2 feet, and one spaced off the top of the frame ranging from 6 inches to 2 feet. The spacing between each of the door hinge 708 cut outs may range from 1 foot to 3 feet. The cut outs may not go through the entire depth of the door frame 702 but for example, may start on one edge and cut through approximately half of the door frame depth, enough to fit the size of the door hinge 708. The door hinges 708 may be inserted into the rectangular opening and attaches with screws or nuts and bolts of various sizes. The door frame 702 may be fitted with a standard strike plate for the doors lock and latch.

In some embodiments, the door panel 704 may have a height ranging from 3 feet to 9 feet, a width ranging from 2 feet to 4 feet and a thickness ranging from ¾ inch to 4 inches. The door panel 704 may be sized to fit within door frame 702. The door panel 704 may be a single flat panel or may have alternative designs including multiple panels and/or glass window pane inserts. The door panel 704 may have door hinges 708 attached to the edge of one side to allow the door panel 704 to be attached to the door frame 702. Within one or more sides of door panel 704 there may be one or more rectangular cut outs used to attach door hinges 708. The rectangular cut outs may have a length ranging from 2 inches to 8 inches, a width ranging from 1 inch to 6 inches and a thickness ranging from 1/16 inch to 2 inches. The cut outs for the door hinges 708 may be positioned with one in the center of the door panel 704, one spaced off the base of the panel ranging from 6 inches to 2 feet, and one spaced off the top of the panel ranging from 6 inches to 2 feet. The spacing between each of the door hinge 708 cut outs may range from 1 foot to 3 feet. The cut outs may only partially go through the depth of the door panel 704 for example, may start on one edge and cut through approximately 1/16 inch to 2 inches of the door frame depth, enough to fit the size of the door hinge 708. The door hinges 708 may be inserted into the rectangular opening and attaches with screws or nuts and bolts of various sizes. The door panel 704 may be fitted with a standard handle, face plate, lock and latch assembly.

In some embodiments, the door handle 706 may be a round knob with a radius ranging from ½ inch to 2 inches. The door handle may alternatively be in various standard shapes and designs. The door handle may be placed in the center of one side of the door panel 704 in order to allow the door to be easily installed since there is not an up or downside to the door. The door handle may be positioned ranging from 2 feet 6 inches to 4 feet 6 inches from the base of the door panel 704. The door handle 706 may be attached to the door panel 704 using screws or nuts and bolts of various sizes. The door handle 706 may be fitted with a standard lock and latch assembly.

In some embodiments, the door hinge 708 may have a length ranging from 2 inches to 8 inches, a width ranging from 1 inch to 6 inches and a thickness ranging from 1/16 inch to 2 inches. One or more door hinges 708 may be used to secure the door panel 704 to the door frame 702. One or more door hinges 708 may be attached to the door frame 702 and the door panel 704 using screws or nuts and bolts of various sizes.

In some embodiments, the edges of doors 700 may be sealed as necessary to prevent water and air from leaking through any remaining gaps. A waterproof sealant or similar may be used to seal the edges and/or any remaining space around the perimeter of the doors 700, the opening between wall panels 300 and/or the frame assembly 900. Additionally, there may be extra components attached along the perimeter of the doors 700 to seal the frame 702 as necessary.

FIG. 7B illustrates an example exploded view of a door 700*a* with door frame small base 710 of a modular building unit. In some embodiments, the door assembly 710*a* assembled with the door frame small base 710 may be used for the long side of the frame 110.

In some embodiments, with respect to FIG. 7A, the door frame small base 710 may have an overall size with a length ranging from 2 feet to 4 feet, a width ranging from 2 inches to 8 inches, and a depth ranging from 2 inches to 8 inches. The bottom of door frame small base 710 is made of a HSS tube positioned horizontally with a length ranging from 2 feet to 4 feet, a width ranging from 2 inches to 8 inches, a depth ranging from ¼ inch to 4 inches, and a thickness ranging from 1/16 inch to ¼ inch. On top and attached to the HSS tube is an angle positioned with the long flange on top of the HSS tube and the short flange facing down over the HSS tube and with a length to match the HSS tube ranging from 2 feet to 4 feet, a longer flange length ranging from 4 inches to 10 inches, a shorter flange length ranging from ¼ inch to 2 inches and a thickness ranging from 1/16 inch to ¼ inch. The long flange of the angle may be centered and welded to the top length of the HSS tube. On top of the angle may be a small HSS tube positioned vertically. The small HSS tube may have a height ranging from ½ inch to 4 inches, a length ranging from 2 inches to 8 inches, a width ranging from ½ inch to 4 inches and a thickness ranging from 1/16 inch to ¼ inch. The small HSS tube may be centered and welded onto the top of the angle and may be within 0 inches to 4 inches from the edge of the angle. There may be a small HSS tube centered and welded to both sides of the angle. The small HSS tube may be sized to be inserted into the bottom ends of door frame 702. The HSS tube, angle and small HSS tubes welded together create the door frame small base 710. The base of door frame 702 may be attached to the small HSS tubes of door frame small base 710 inside using screws or nuts and bolts of various sizes. The short flange of the angle may be attached to the bottom trim plates 950*b* using screws or nuts and bolts of various sizes.

FIG. 7C illustrates an example exploded view of a door 700*b* and door frame large base 712 of a modular building unit. In some embodiments, the door assembly 710*a* assembled with the door frame large base 712 may be used for the short side of the frame 110.

In some embodiments, with respect to FIG. 7A, the door frame large base 712 may have an overall size with a length ranging from 2 feet to 4 feet, a width ranging from 2 inches to 8 inches, and a depth ranging from 2 inches to 8 inches. The bottom of door frame large base 712 is made of a HSS tube positioned horizontally with a length ranging from 2 feet to 4 feet, a width ranging from 2 inches to 8 inches, a depth ranging from ½ inch to 4 inches, and a thickness ranging from 1/16 inch to ¼ inch. On top and attached to the HSS tube may be a c-channel positioned with the flanges facing down over the HSS tube and with a length to match the HSS tube ranging from 2 feet to 4 feet, a width ranging from 4 inches to 10 inches, flange lengths ranging from ¼ inch to 2 inches and a thickness ranging from 1/16 inch to ¼ inch. The c-channel may be centered and welded to the top length of the HSS tube. On top of the c-channel may be a small HSS tube positioned vertically. The small HSS tube may have a height ranging from ½ inch to 4 inches, a length ranging from 2 inches to 8 inches, a width ranging from ½ inch to 4 inches and a thickness ranging from 1/16 inch to ¼ inch. The small HSS tube may be centered and welded onto the top of the c-channel and may be within 0 inches to 4 inches from the edge of the c-channel. There may be a small HSS tube centered and welded to both sides of the c-channel. The small HSS tube may be sized to be inserted into the bottom ends of door frame 702. The HSS tube, c-channel and small HSS tubes welded together create the door frame large base 712. The base of door frame 702 may be attached to the small HSS tube of door frame large base 712 inside using screws or nuts and bolts of various sizes. The c-channel flanges may be attached to the bottom trim plates 930*b* using screws or nuts and bolts of various sizes.

Figure 8A:
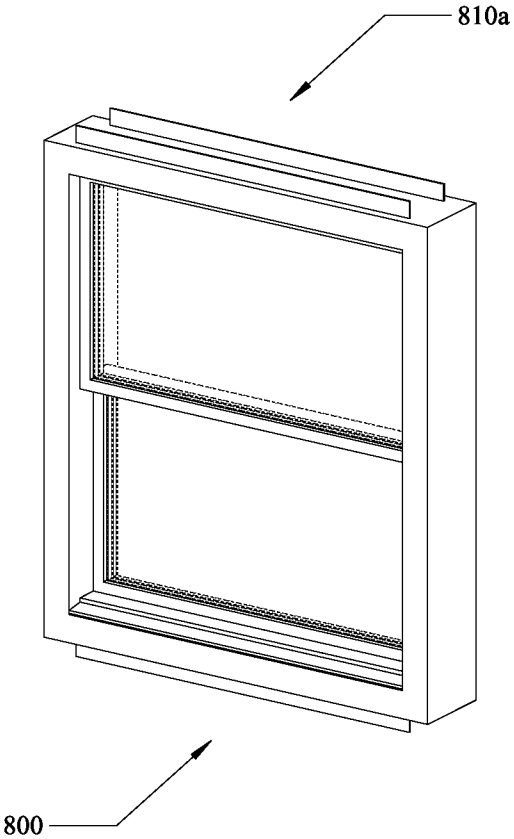
FIG. 8A illustrates an example view of a window assembly.

FIG. 8A illustrates an example view of a window 800 for a modular building unit. The window 800 may be arranged in accordance with at least one embodiment described in the present disclosure. The window 800 may include window assembly 810*a*.

Figure 8B:
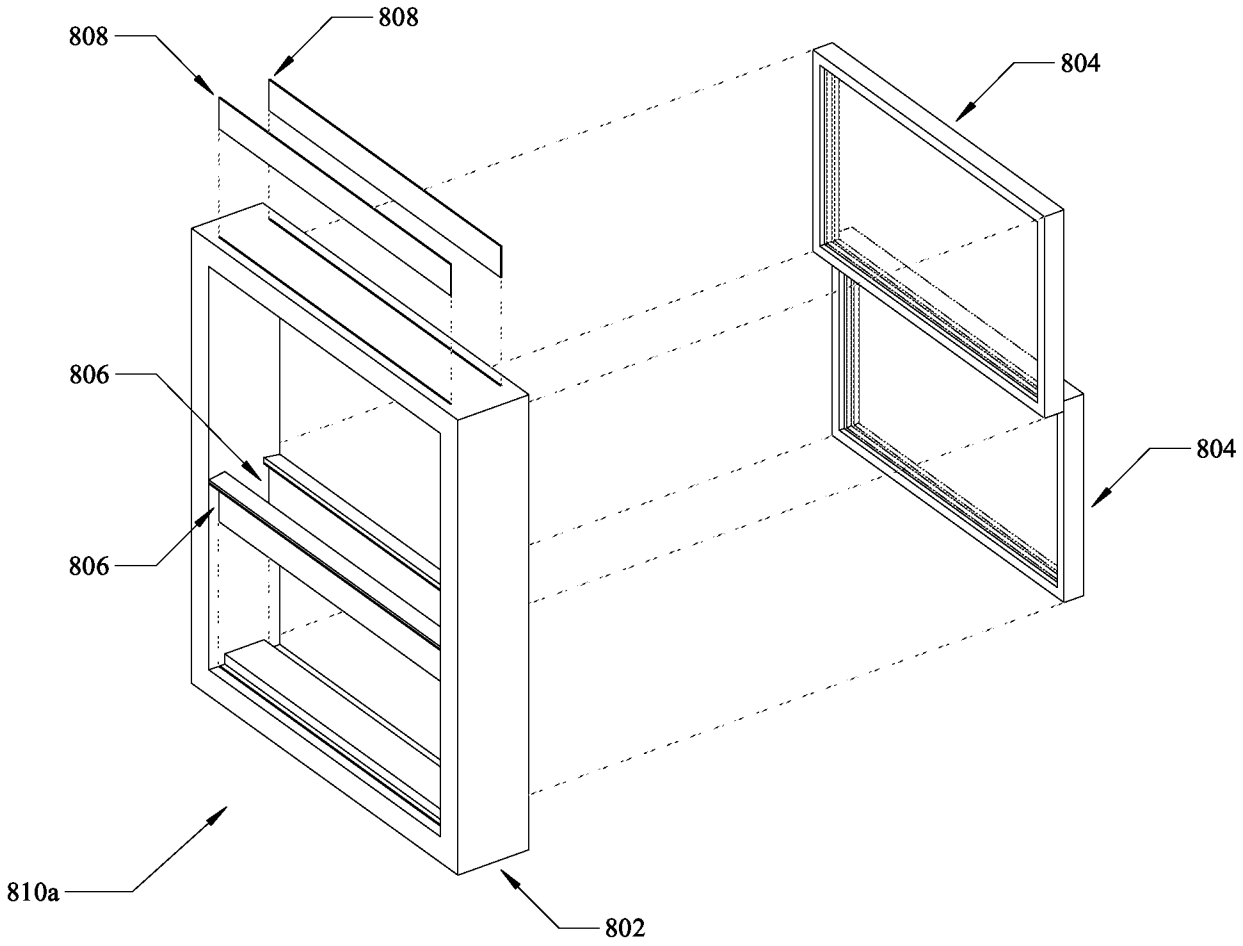
FIG. 8B illustrates an example exploded view of a window assembly.

In some embodiments, the discussion and the illustration in FIG. 8A and FIG. 8B of a window 800 provides an illustration of the window 800 without providing all the details of a window. Further elements of a window may be added in an implementation without deviating from the scope of this disclosure.

In some embodiments, the number of the windows 800 may vary and correspond with different configurations of the modular building unit floor plan, illustrated in FIGS. 11A-11D. Thus, in some embodiments, the windows 800 may be joined in other various assemblies than those illustrated. The windows 800 may be arranged in accordance with at least one embodiment described in the present disclosure. The windows 800 may include one or more window frame 802, window panels 804, window bottom plates 806 and window top plates 808. In some embodiments, the number of windows 800 may correspond with a configuration of a frame of the modular building unit, such as the frame 110 of the modular building unit 100 of FIG. 1B.

In some embodiments, the number of windows 800 may be based on the design of the modular building unit. The number of windows 800 may vary and may be determined based on the length of the short side or long side wall of the frame.

In some embodiments, the windows 800 may be made of any material including wood, laminate, fiberglass, vinyl, stainless steel, aluminum and hollow metal or any combination of the listed materials or other materials. For example, in some embodiments, the windows may be made from fiberglass. In these and other embodiments, the windows 800 may be individually constructed or constructed from a mold at a manufacturing facility. By using fiberglass, the window 800 provides a long lasting and protective barrier between the outside and inside of the building. Windows 800 may weigh 10 pounds to 150 pounds per window.

FIG. 8B illustrates an example exploded view of a window assembly 810*a* for a modular building unit. The window assembly 810*a* may be arranged in accordance with at least one embodiment described in the present disclosure. The window assembly 810*a* may include window frame 802, window panels 804, window bottom plates 806 and window top plates 808.

In some embodiments, the windows 800 may be installed by first inserting the window 800 into the opening within the wall panels 300. The base of window frame 802 may be positioned directly on the top of the window base panel 308 and the top of the window frame 802 may be positioned directly under window top panel 310. The sides of the window frame 802 may rest flat against window side panels 306. Once the window 800 is aligned within the opening of wall panels 300, the window bottom plates 806 and the window top plates 808 may be inserted within the bottom and top openings of both sides of window frame 802 from above. The window bottom plate 806 may be positioned against the surface of window base panel 308 and may be attached using screws or nuts and bolts of various sizes. The window top plates may be positioned against the surface of window top panel 310 and may be attached using screws and nuts or bolts of various sizes.

In some embodiments, the window frame 802 may have an exterior frame size with a height ranging from 1 foot 6 inches to 5 feet, a width ranging from 1 foot 6 inches to 5 feet, a depth ranging from 4 inches to 8 inches and a thickness ranging from ¾ inch to 4 inches. Window frame 802 may be a fiberglass frame with a thickness of 1/16 inch to ¼ inch and may be hollow inside. Within the top and bottom of the window frame 802 there may be an opening through the frame which may begin ¼ inch to 2 inches from the edge of the window frame 802. The openings in the bottom of the frame may extend through the entire depth of the frame and the openings in the top of the frame may extend partially through the depth of the frame. The opening may match the width of the inside of the window frame 802 and may have a thickness ranging from 1/16 inch to ½ inch. Window frame 802 may be secured within the wall panels 300 by inserting window bottom plates 806 and window top plates 808 into the openings of the frame.

In some embodiments, the window panels 804 may have a height ranging from 1 foot 6 inches to 5 feet, a width ranging from 1 foot 6 inches to 5 feet, a depth ranging from 4 inches to 8 inches and a thickness ranging from ¼ inch to 4 inches. The window panels 804 may be sized to fit within window frame 802. The window panels 804 may be sized as a double hung window or alternative such as a single hung, sliding, casement, awning, fixed or other window type. The window pane within the window panels 804 may be a double pane glass but alternatively may be a single or triple pane glass. The window pane may additionally use energy efficient materials such as a low-e coating, argon gas or other materials. There may be a frame around the window panels 804 holding the window pane in place. The window pane frame may have a width ranging from ¼ inch to 4 inches, a thickness ranging from ⅛ inch to 4 inches and may have a length extending around the perimeter of the window pane dimensions. The window pane glass within the frame may have a width and length to match the perimeter of the frame of the window panels 804 and a thickness ranging from 1/16 inch to ½ inch.

In some embodiments, the window bottom plates 806 may be a t-bar with a length ranging from 1 foot 6 inches to 5 feet, a bottom flange width ranging from 1 inch to 8 inches, a top flange width ranging from ½ inch to 6 inches and a thickness ranging from 1/16 inch to ¼ inch. Window bottom plates 806 may match the width of the interior window frame 802. The top flange may be on top of the bottom flange to create a T shape and the top flange may not be centered on top of the bottom flange. The t-bar with the shorter flange side may face towards the inside of the window frame 802. On top of the t-bar may be an angled sill plate with a height on one side ranging from ⅛ inch to 3 inches and a height on the other side ranging from 1/16 inch to 2 inches. The angle sill plate may be the same length as the t-bar and may be welded on the top flange of the t-bar. The window bottom plates 806 may be inserted into the window frame 802 openings on either side of the bottom frame and over the surface of window base panel 308.

In some embodiments, the window top plates 808 may be a flat plate with a length ranging from 1 foot 6 inches to 5 feet, a width ranging from 1 inch to 8 inches and a thickness ranging from 1/16 inch to ¼ inches. Window top plates 808 may match the width of the interior window frame 802. The window top plates 808 may be inserted into the opening of window frame 802 and attached to window top panel 310 using screws or nuts and bolts of various sizes. Window top plates 808 may alternatively be in the shape of a t-bar. The center flange of the t-bar may have a length ranging from 1 foot 6 inches to 5 feet, a width ranging from 1 inch to 4 inches and a thickness ranging from 1/16 inch to ¼ inches. The top flange may have a length ranging from 1 foot 6 inches to 5 feet, a width ranging from 1 inch to 8 inches and a thickness ranging from 1/16 inch to ¼ inches. The t-bar top plate may be installed with the center flange resting over top of the window frame 802 and the top flange inserted down into the opening on top of the window frame 802. The t-bar top plates may be attached to window top panel 310 and the top of window frame 802 using screws or nuts and bolts of various sizes.

In some embodiments, the edges of windows 800 may be sealed as necessary to prevent water and air from leaking through any remaining gaps. A waterproof sealant or similar may be used to seal the edges and/or any remaining space around the perimeter of the windows 800, the opening between wall panels 300 and/or the frame assembly 900. Additionally, there may be extra components attached along the perimeter of the window 800 to seal the frame 802 as necessary.

FIG. 9A-9D illustrates an example exploded view of a corner casting 910, column corner 920, short side lower frame 930, short side upper frame 940, long side lower frame 950, long side upper frame 960, and forklift pocket 970 of the frame 110, illustrated in FIG. 1B. The illustrated connections of components may be assembled in accordance with the floor assembly 200, wall panels 300, roof assembly 400, exterior roof assembly 500, exterior siding panels 600, doors 700 and windows 800. The components of frame assembly 900 may include, corner casting 910, column corner 920, short side lower frame 930, short side upper frame 940, long side lower frame 950, long side upper frame 960, and forklift pocket 970. Not all components of the frame assembly 900 may be assembled first or entirely at the same time but may be assembled in sections based on the construction progress of the floor, walls and roof. Frame assembly 900 may be assembled in an order that may result in greater structural stability during completion of the rest of the modular building unit 100. The frame assembly 900 may be assembled in the order as described or in an alternative order as determined by the installer or circumstances.

In some embodiments, one or more components of frame assembly 900 may be welded together prior to being transported to the site to simplify assembly. In an alternative assembly method, the frame assembly 900 may be partially or entirely assembled to minimize the amount of remaining components that may be attached upon arrival to the site. The frame assembly 900 may be transported to site with one or more floor assembly 200, wall panels 300, roof assembly 400, exterior roof assembly 500, exterior siding panels 600, doors 700 and/or windows 800 already installed into the frame.

In some embodiments, the frame assembly 900 may be made of any material including steel, iron, aluminum and metal or any combination of the listed materials or other materials. For example, in some embodiments, the frame assembly 900 may be made from steel. In these and other embodiments, the frame assembly 900 may be individually constructed or constructed from a mold at a manufacturing facility. The frame assembly 900 may be standard sizes of members or custom sizes. Frame assembly 900 may be altered or adjusted during construction as necessary to include cutting, bending, welding, drilling, or any other change which may be made to the component's material. By using steel, the frame provides strength to the building for a long lasting and durable structure which may be reused for many years. A forklift may be used to move frame assembly 900 into place or a group of people may lift components together to be positioned into place. The components of frame assembly 900 may weigh 1 pound to 500 pounds per component.

FIG. 9A illustrates an example frame assembly 900 for a modular building unit 100. The frame may be assembled in different sections such as the corner casting 910, column corner 920, short side lower frame 930, short side upper frame 940, long side lower frame 950, long side upper frame 960, and forklift pocket 970. The frame assembly 900 may be assembled in the order of creating structural stability for the rest of the structure.

In some embodiments, the components of the column corner 920, short side lower frame 930, short side upper frame 940, long side lower frame 950, long side upper frame 960, and forklift pocket 970 may have one or more holes drilled through and/or one or more welded nuts or bolts on one or more enclosed ends and/or sides which may allow other frame components to be attached. The drilled holes and/or welded nuts or bolts may be completed during the manufacturing process or on site during assembly as necessary. Alternatively, there may be holes drilled through the components of the column corner 920, short side lower frame 930, short side upper frame 940, long side lower frame 950, long side upper frame 960, and forklift pocket 970 to allow MEP systems to be installed within the unit.

FIG. 9B illustrates an example exploded view of a forklift pocket 970 and column corner 920 of the frame assembly 900. The forklift pocket 970 may include forklift HSS tube 970*a* and forklift plates 970*b*. The column corner 920 may include corner castings 910, HSS column 920*a*, *c*-channel 920*b* and 920*c*, and corner angle trim 920*d*.

In some embodiments, forklift HSS tube 970*a* may be inserted into the rectangular opening in bottom angle 950*a*. The forklift HSS tube 970*a* may be welded to or attached to the bottom flange of bottom angle 950*a* with screws or nuts and bolts of various sizes. Forklift plates 970*b* may be welded to or attached to the bottom of forklift HSS tube 970*a* with screws or nuts and bolts of various sizes. The bottom length of forklift HSS tube 970*a* may be covered by the forklift plates 970*b* by ½ inch to 6 inches. The forklift plates 970*b* may align the ends of the plate perpendicular to the lower flange of bottom angle 950*a*. The forklift pocket 970 may be aligned perpendicular to bottom angle 950*a*.

In some embodiments, the forklift HSS tube 970*a* may have a length ranging from 1 foot to 10 feet, a width ranging from 6 inches to 2 feet, a depth ranging from 2 inches to 8 inches and a thickness ranging from ⅛ inch to ½ inch. Forklift HSS tube 970*a* may allow typical forklift arms to be inserted inside to support the weight of the modular building unit 100. Forklift HSS tube 970*a* may be used with a standard forklift to transport, stack or position a modular building unit 100.

In some embodiments, the forklift plates 970*b* may have a length ranging from 1 foot to 10 feet, a width ranging from 2 inches to 8 inches and a thickness ranging from ⅛ inch to ½ inch. Forklift plates 970*b* may be attached to forklift HSS tube 970*a* and may support the weight of floor assembly 200.

In some embodiments, corner casting 910 may be welded to or attached to HSS column 920*a* with screws or nuts and bolts of various sizes. The corner casting 910 may be configured according to the international organization for standardization (ISO) such that the corner casting 910 may be compatible with other corner castings of various types.

In some embodiments, the corner casting 910 may align with the inner corner of HSS column 920*a*. The openings of corner casting 910 may face out from the modular building unit 100. HSS column 920*a* may have a corner casting 910 on both ends of the column. C-channel 920*b* may be attached to HSS column 920*a* on the inner short side of a frame, such as the frame 110 of FIG. 1B. C-channel 920*b* may align with the inner corner of HSS column 920*a*. The inner web of c-channel 920*b* may be welded to or attached to HSS column 920*a* with screws or nuts and bolts of various sizes. C-channel 920*c* may be attached to HSS column 920*a* on the inner long side of the frame 110. C-channel 920*c* may align with the inner corner of HSS column 920*a*. The inner web of c-channel 920*c* may be welded to or attached to HSS column 920*a* with screws or nuts and bolts of various sizes. Corner angle trim 920*d* may be installed on the inside of the modular building unit 100 once the floor assembly 200 is installed. The corner angle trim 920*d* may be installed on top of floor assembly 200. The corner angle trim 920*d* may be placed in the corners of the inside of the modular building unit 100 and the flanges may be welded to or attached to the flanges of c-channels 920*b* and 920*c* with screws or nuts and bolts of various sizes. The corner angle trim 920*d* may be used to seal the corners of the inside of the modular building unit 100. Corner angle trim 920*d* may be used to create a smooth surface around the edges and corners of the interior of the space and may be preferred to be attached after the installation of the floor assembly 200.

In some embodiments, the corner castings 910 may have a length ranging from 2 inches to 10 inches, a width ranging from 2 inches to 10 inches and a depth ranging from 2 inches to 8 inches. The corner castings 910 may have openings in one or more sides and may have rounded edges. The openings of corner casting 910 may face out from the modular building unit 100. The openings of corner casting 910 may be in the shape of an oval and may have a length ranging from 2 inches to 8 inches, a width ranging from 2 inches to 8 inches and a radius on the ends ranging from ½ inch to 3 inches. Corner castings 910 may be attached at one or more ends of HSS columns 920*a*. There may be one or more holes drilled through one or more sides of corner castings 910 to insert one or more bolts through to attach frame components such as, corner column 920*a*, HSS tube 930*a*, HSS tube 940*a*, bottom angle 950*a*, and top angle 960*a*. Corner castings 910 may be standard industry dimensions and may support the weight of the modular building unit 100. The corner castings 910 may be mirrored or rotated according to the corner of the modular container 100 to which the corner castings 910 are attached. Corner castings 910 may be attached to one or more corners of the modular container 100 including the top, bottom, left and right sides.

In some embodiments, corner castings 910 may be used with standard shipping container industry equipment and machinery. Corner castings 910 may allow the modular building unit 100 to be transported the same as a standard shipping container by sea, air, land and rail. Corner castings 910 may also allow the modular building unit 100 to be easily lifted and moved onto a cargo ship, cargo plane, truck trailer and railway trailer. Other components such as a twist lock may be used with corner casting 910 to attach other alike containers together or various additional components.

In some embodiments, the HSS column 920*a* may have a length ranging from 1 foot to 10 feet and a thickness ranging from ⅛ inch to ½ inch. HSS column 920*a* may be a square or rectangle with side dimensions ranging from 2 inches to 8 inches. The openings on both sides of HSS column 920*a* may be enclosed with a plate. The additional plate may be welded on as part of HSS column 920*a*. HSS column 920*a* may have one or more holes drilled through and/or one or more welded nuts or bolts on one or both enclosed ends which may allow corner castings 910 to be attached. There may be one or more holes drilled through and/or one or more welded nuts or bolts along one or more sides of corner column 920*a* to attach frame components such as, c-channel 920*b* and 920*c*, *c*-channel tube 940*c*, and top angle 960*a*. HSS column 920*a* may support the weight of the modular building unit 100.

In some embodiments, the c-channel 920*b* and 920*c* may have a length ranging from 1 foot to 10 feet and a thickness ranging from ⅛ inch to ½ inch. C-channel 920*b* and 920*c* may have a width ranging from 2 inches to 8 inches with side flanges ranging from 2 inches to 8 inches. C-channel 920*b* and 920*c* may be attached to HSS column 920*a*. C-channel 920*b* and 920*c* may have one or more holes drilled through and/or one or more welded nuts or bolts along the inner web to attach to frame components such as, HSS column 920*a*.

In some embodiments, the corner angle trim 920*d* may have a length ranging from 1 foot to 10 feet and a thickness ranging from 1/32 inch to ¼ inch. Corner angle trim 920*d* may have side flanges ranging from 1 inch to 8 inches. Corner angle trim 920*d* may attach to the interior flanges of c-channels 920*b* and 920*c* with screws or nuts and bolts of various sizes.

FIG. 9C illustrates an example exploded view of short side lower frame 930 and short side upper frame 940 of the frame assembly 900. The short side lower frame 930 may include corner castings 910, HSS tube 930*a*, bottom trim plates 930*b*, bottom c-channel 930*c* and angle base trim 930*d*. The short side upper frame 940 may include corner castings 910, HSS tube 940*a*, roof drip edge 940*b*, *c*-channel tube 940*c*, top trim plates 940*d* and top c-channel 940*e*.

In some embodiments, corner casting 910 may be welded to or attached to HSS tube 930*a* with screws or nuts and bolts of various sizes. The HSS tube 930*a* may align with the inner most corner of corner casting 910. The openings of corner casting 910 may face out from the modular building unit 100. HSS tube 930*a* may have a corner casting 910 on both ends of the HSS tube. The offset ends of the bottom trim plates 930*b* may be welded to or attached perpendicular to the flanges on the base of c-channel 920*b* with screws or nuts and bolts of various sizes. Bottom trim plates 930*b* may be attached to the inside and/or outside flanges of the c-channel 920*b*. Bottom trim plates 930*b* may be installed before or after the wall panels 300 are assembled. The taller plate or flange of bottom c-channel 930*c* may be welded to or attached parallel to the exterior bottom trim plate 930*b* with screws or nuts and bolts of various sizes. Bottom c-channel 930*c* may be attached on the exterior side of the frame assembly 900. The angle base trim 930*d* may be welded to or attached parallel to HSS tube 930*a* with screws or nuts and bolts of various sizes. Angle base trim 930*d* may be attached to HSS tube 930*a* on the inside of the frame assembly 900 before the floor assembly 200 is installed. The bottom flange of angle base trim 930*d* may support the weight of floor assembly 200 which may rest on top.

In some embodiments, the HSS tube 930*a* may have a length ranging from 1 foot to 10 feet and a thickness ranging from ⅛ inch to ½ inch. HSS tube 930*a* may be a square or rectangle with side dimensions ranging from 2 inches to 8 inches. The openings on both sides of HSS tube 930*a* may be enclosed with a plate. The additional plate may be welded on as part of HSS tube 930*a*. HSS tube 930*a* may have one or more holes drilled though and/or one or more welded nuts or bolts on one or both enclosed ends which may allow corner castings 910 to be attached. There may be one or more holes drilled through and/or welded nuts or bolts along one or more sides of HSS tube 930*a* to attach frame components such as angle base trim 930*d*. HSS tube 930*a* may support the weight of the modular building unit 100.

In some embodiments, the bottom trim plates 930*b* may have a length ranging from 1 foot to 10 feet, a width ranging from 1 inch to 6 inches and a thickness ranging from 1/16 inch to ½ inch. The ends of bottom trim plates 930*b* may be offset from the main length by 1/16 inch to 1 inch and may have an offset end length ranging from 1 inch to 8 inches. The offset ends of bottom trim plates 930*b* may be welded to or attached to the bottom of c-channel 920*b* and/or corner angle trim 920*d* with screws or nuts and bolts of various sizes. Bottom trim plates 930*b* may seal the edges of wall panels 300 from water.

In some embodiments, the bottom c-channel 930*c* may have a length ranging from 1 foot to 10 feet and a thickness ranging from 1/16 inch to ½ inch. Bottom c-channel 930*c* may have a width ranging from ¼ inch to 4 inches with side flanges ranging from ¼ inch to 6 inches. Bottom c-channel 930*c* may have flanges of different lengths. The longer flange of bottom c-channel 930*c* may be welded to or attached to the base of the exterior bottom trim plate 930*b* and/or *c*-channel 920*b* with screws or nuts and bolts of various sizes. The ends of the bottom c-channel 930*c* may be enclosed with a welded plate if necessary. Bottom c-channel 930*c* may allow exterior siding panels 600 to be inserted inside the channel opening of the bottom c-channel 930*c* to hold the exterior siding panels 600 in place.

In some embodiments, the angle base trim 930*d* may have a length ranging from 1 foot to 10 feet and a thickness ranging from 1/16 inch to 1/2 inch. Angle base trim 930*d* may have side flanges ranging from 1 inch to 8 inches. Angle base trim 930*d* may have flanges of equal or different lengths. Angle base trim 930*d* may be welded to or attached to HSS tube 930*a* with screws or nuts and bolts of various sizes. There may be one or more holes drilled through and/or one or more welded nuts or bolts along one or more flanges of angle base trim 930*d* to attach frame components such as, HSS tube 930*a*. Angle base trim 930*d* may support the weight of floor assembly 200.

In some embodiments, corner casting 910 may be welded to or attached to HSS tube 940*a* with screws or nuts and bolts of various sizes. The HSS tube 940*a* may align with the inner most corner of corner casting 910. The openings of corner casting 910 may face out from the modular building unit 100. HSS tube 940*a* may have a corner casting 910 on both ends of the HSS tube. The horizontal flange of roof drip edge 940*b* may be welded to or attached parallel to the base of HSS tube 940*a* with screws or nuts and bolts of various sizes. The vertical flange of roof drip edge 940*b* may extend down the outer side of c-channel tube 940*c*. The short flange of c-channel tube 940*c* may be welded to or attached parallel to the base of the horizontal flange of roof drip edge 940*b* and HSS tube 940*a* with screws or nuts and bolts of various sizes. The offset ends of the top trim plates 940*d* may be welded to or attached perpendicular to the top of c-channel 920*b* with screws or nuts and bolts of various sizes. Top trim plates 940*d* may be attached to the inside and/or outside flanges of the c-channel 920*b*. Top trim plates 940*d* may be installed before or after the wall panels 300 are assembled. The taller plate or flange of top c-channel 940*e* may be welded to or attached parallel to the exterior top trim plate 940*d* with screws or nuts and bolts of various sizes. Top c-channel 940*e* may be attached on the exterior side of the frame assembly 900.

In some embodiments, the HSS tube 940*a* may have a length ranging from 1 foot to 10 feet and a thickness ranging from 1/8 inch to 1/2 inch. HSS tube 940*a* may be a square or rectangle with side dimensions ranging from 2 inches to 8 inches. The openings on both sides of HSS tube 940*a* may be enclosed with a plate. The additional plate may be welded on as part of HSS tube 940*a*. There may be one or more circular openings through the side of HSS tube 940*a*. The circular openings may have a radius ranging from 1/2 inch to 3 inches and the inside of HSS tube 940*a* may be sealed around the circular opening by welding a round HSS tube with a radius matching the circular opening radius. HSS tube 940*a* may have one or more holes drilled through and/or one or more welded nuts or bolts on one or both enclosed ends which may allow corner castings 910 to be attached. There may be one or more holes drilled through and/or one or more welded nuts or bolts along one or more sides of HSS tube 940*a* to attach frame components such as, roof drip edge 940*b* and *c*-channel tube 940*c*. HSS tube 940*a* may support the weight of the modular building unit 100.

In some embodiments, the roof drip edge 940*b* may have a length ranging from 1 foot to 10 feet and a thickness ranging from 1/32 inch to 1/4 inch. Roof drip edge 940*b* may have side flanges ranging from 1 inch to 10 inches. The end of the flange down the outside of c-channel tube 940*c* may be angled ranging from 5 degrees to 90 degrees with a length ranging from 1/2 inch to 4 inches. The angled end of roof drip edge 940*b* may have an angled edge ranging from 5 degrees to 90 degrees. The roof drip edge 940*b* may be welded to or attached to the bottom of HSS tube 940*a* and/or the top flange of c-channel tube 940*c* with screws or nuts and bolts of various sizes. There may be one or more holes drilled through and/or one or more welded nuts or bolts along one or more flanges of roof drip edge 940*b* to attach to frame components such as, HSS tube 940*a* and *c*-channel tube 940*c*. The roof drip edge 940*b* may seal the short side of the frame 110 from water.

In some embodiments, the c-channel tube 940*c* may have a length ranging from 1 foot to 10 feet and a thickness ranging from 1/8 inch to 1/2 inch. C-channel tube 940*c* may have a width ranging from 2 inches to 10 inches with side flanges ranging from 2 inches to 16 inches. C-channel tube 940*c* may have flanges of different lengths. The shorter flange of c-channel tube 940*c* may be welded to or attached to the bottom of roof drip edge 940*b* and/or HSS tube 940*a* with screws or nuts and bolts of various sizes. The ends of the c-channel tube 940*c* may be enclosed with a welded plate which may only partially enclose the ends. For example, the ends of the c-channel tube 940*c* may only enclose up to the length of the shorter flange. C-channel tube 940*c* may have one or more holes drilled through and/or one or more welded nuts or bolts on one or both enclosed ends which may allow it to be attached to HSS columns 920*a*. There may be one or more holes drilled through and/or one or more welded nuts or bolts along one or more sides of c-channel tube 940*c* to attach to frame components such as, HSS tube 940*a* and roof drip edge 940*b*. C-channel tube 940*c* may allow roof end filler panels 410 to be inserted inside the opening of the c-channel tube 940*c*.

In some embodiments, the top trim plates 940*d* may have a length ranging from 1 foot to 10 feet, a width ranging from 2 inch to 8 inches and a thickness ranging from 1/16 inch to 1/2 inch. The ends of top trim plates 940*d* may be offset from the main length by 1/16 inch to 1 inch and have an offset end length ranging from 1 inch to 8 inches. The ends of top trim plates 940*d* may be welded to or attached to the top of c-channel 920*b* and/or corner angle trim 920*d* with screws or nuts and bolts of various sizes. Top trim plates 940*d* may seal the edges of wall panels 300 from water.

In some embodiments, the top c-channel 940*e* may have a length ranging from 1 foot to 10 feet and a thickness ranging from 1/16 inch to 1/2 inch. Top c-channel 940*e* may have a width ranging from 1/4 inch to 4 inches with side flanges ranging from 1/2 inch to 8 inches. Top c-channel 940*e* may have flanges of equal lengths. Top c-channel 940*e* may have one flange which also extends 1/2 inch to 4 inches past the width of the base. The flange with the extension on one side of top c-channel 940*e* may be welded to or attached to the top of the exterior top trim plate 940*d* and/or *c*-channel 920*b* with screws or nuts and bolts of various sizes. The ends of the top c-channel 940*e* may be enclosed with a welded plate if necessary. Top c-channel 940*e* may allow exterior siding panels 600 to be inserted inside the channel opening of the top c-channel 940*e* to hold the exterior siding panels 600 in place.

Figure 9D:
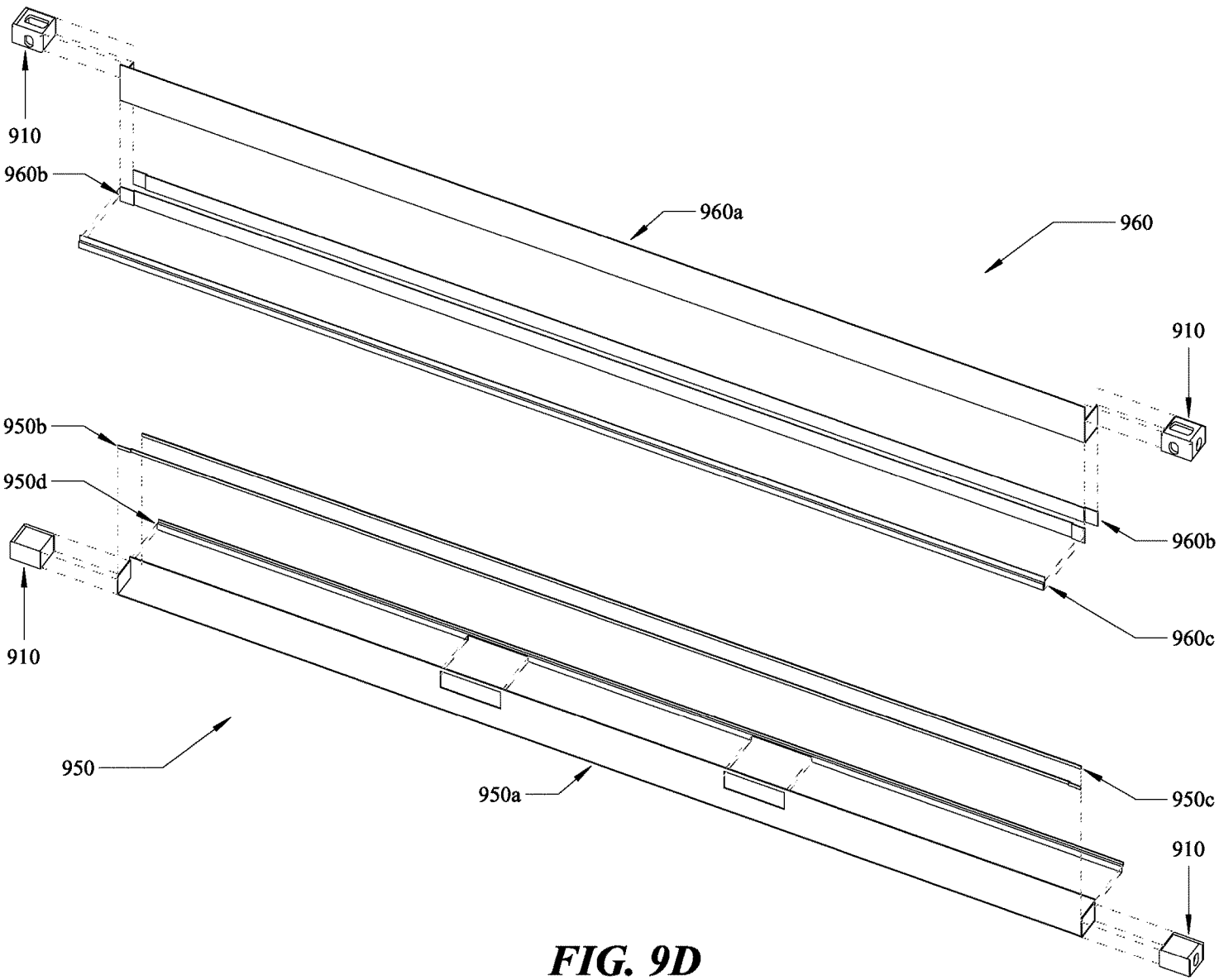
FIG. 9D illustrates an example exploded view of the bottom and top frame assembly on the long side of the modular building unit.

FIG. 9D illustrates an example exploded view of long side lower frame 950 and long side upper frame 960 of the frame assembly 900. The long side lower frame 950 may include corner castings 910, bottom angle 950*a*, bottom trim plates 950*b* and 950*c* and bottom channel plate 950*d*. The long side upper frame 960 may include corner castings 910, top angle 960*a*, top trim plates 960*b*, and top channel plate 960*c*.

In some embodiments, corner castings 910 may be welded to or attached to bottom angle 950*a* with screws or nuts and bolts of various sizes. The bottom angle 950*a* may align with the inner corner of corner casting 910 and align with the base height of HSS tube 930*a*. The openings of corner casting 910 may face out from the modular building unit 100. Bottom angle 950*a* may have a corner casting on both ends of the angle. The bottom angle 950*a* may be installed first before floor end panels 202 and floor panels 204 may be installed. The bottom flange of bottom angle 950*a* may support the weight of floor assembly 200. The offset ends of the bottom trim plate 950*b* may be welded to or attached perpendicular to the inside base flange of c-channel 920*c* with screws or nuts and bolts of various sizes. Bottom trim plate 950*b* may be attached to the inside flange of the c-channel 920*c*. Bottom trim plate 950*c* may align parallel with the outside flange of c-channel 920*c*. Bottom trim plates 950*b* and 950*c* may be installed before or after the wall panels 300 are assembled. The lower plate or flange of bottom channel plate 950*d* may be welded to or attached parallel to the top flange of bottom angle 950*a* with screws or nuts and bolts of various sizes.

In some embodiments, the bottom angle 950*a* may have a length ranging from 2 feet to 20 feet and a thickness ranging from ⅛ inch to ½ inch. Bottom angle 950*a* may have side flanges ranging from 2 inches to 10 inches. Bottom angle 950*a* may have flanges of different lengths. The ends of bottom angle 950*a* may be enclosed with a plate which may not cover the entire flange lengths. The additional plate may be welded on as part of bottom angle 950*a*. Bottom angle 950*a* may have one or more holes drilled through and/or one or more welded nuts or bolts on one or both enclosed ends which may allow corner castings 910 to be attached. There may be one or more rectangular openings in bottom angle 950*a* for forklift HSS tube 970*a* to be inserted into. The openings in bottom angle 950*a* may have a length ranging from 6 inches to 2 feet and a width ranging from 2 inches to 8 inches. The rectangular openings in bottom angle 950*a* may begin 1/16 inch to 2 inches above the bottom flange and may end 1/16 inch to 2 inches below the top flange. The rectangular openings may begin within 2 feet to 10 feet of the ends in the length of the bottom angle 950*a* and the placement may be centered and located for the standard width of a forklift. Forklift HSS tubes 970*a* may be aligned with the rectangular openings and welded or attached to the bottom flange of bottom angle 950*a* with screws or nuts and bolts of various sizes. Bottom angle 950*a* may support the weight of the modular building unit 100.

In some embodiments, the bottom trim plates 950*b* may have a length ranging from 1 foot to 20 feet, a width ranging from 1 inch to 4 inches and a thickness ranging from 1/16 inch to ½ inch. The ends of bottom trim plates 950*b* may be offset from the main length by 1/16 inch to 1 inch and have an offset end length ranging from 1 inch to 8 inches. The ends of bottom trim plates 950*b* may be welded to or attached to the bottom of c-channel 920*c* and/or corner angle trim 920*d* with screws or nuts and bolts of various sizes. Bottom trim plates 950*b* may seal the edges of wall panels 300 from water.

In some embodiments, the bottom trim plates 950*b* may differ from bottom trim plates 950*c* due to the additional offset ends of bottom trim plates 950*b*. The offset ends of bottom trim plates 950*b* may cover the interior base flange of c-channel 920*c* from the inside of the frame assembly 900.

In some embodiments, the bottom trim plates 950*c* may have a length ranging from 1 foot to 20 feet, a width ranging from 1 inch to 4 inches and a thickness ranging from 1/16 inch to ½ inch. The ends of bottom trim plates 950*c* may align next to the exterior flange of c-channel 920*c* and may be welded to or attached to the top flange of bottom angle 950*a* with screws or nuts and bolts of various sizes. Bottom trim plates 950*c* may seal the edges of wall panels 300 from water.

In some embodiments, the bottom trim plates 950*c* may differ from bottom trim plates 950*b* due to the straight ends of bottom trim plates 950*c*. The straight ends of bottom trim plates 950*c* may meet directly next to the exterior flange of c-channel 920*c* from the outside of the frame assembly 900. Bottom trim plates 950*c* may be placed directly next to the top flange of bottom angle 950*a* to support the wall panels 300 in place.

In some embodiments, the bottom channel plate 950*d* may have a length ranging from 1 foot to 20 feet and a thickness ranging from 1/16 inch to ½ inch. Bottom channel plate 950*d* may have a lower plate width ranging from ¼ inch to 6 inches with an offset length ranging from 1/16 inch to 1 inch and extending from the offset length may be an upper plate with a width ranging from ¼ inch to 6 inches. Bottom channel plate 950*d* may have an upper plate and lower plate of different lengths. The lower plate of bottom channel plate 950*d* may be welded to or attached to the top flange of bottom angle 950*a* with screws or nuts and bolts of various sizes. There may be one or more rectangular openings in bottom channel plate 950*d* to match the opening of forklift HSS tube 970*a*. The openings in bottom channel plate 950*d* may have a length ranging from 6 inches to 2 feet and a width ranging from 2 inches to 8 inches. The rectangular openings in bottom channel plate 950*d* may begin at the base of the lower plate and may end 1/16 inch to 1 inch below the top of the lower plate. The rectangular openings may begin within 2 feet to 10 feet of the ends in the length of the bottom channel plate 950*d* and the placement may be centered and located for the standard width of a forklift. The ends of the bottom channel plate 950*d* may be enclosed with a welded plate if necessary. Bottom channel plate 950*d* may allow exterior siding panels 600 to be inserted inside the channel opening of the bottom channel plate 950*d* to hold the exterior siding panels 600 in place.

In some embodiments, corner casting 910 and HSS column 920*a* may be welded to or attached to top angle 960*a* with screws or nuts and bolts of various sizes. The top angle 960*a* may align with the inner corner of corner casting 910 and align with the base height of c-channel tube 940*c*. The openings of corner casting 910 may face out from the modular building unit 100. Top angle 960*a* may have a corner casting on both ends of the angle. The top angle 960*a* may be installed first before the roof top end panels 402, roof panels 404, and roof bottom end panels 406 may be installed. The bottom flange of top angle 960*a* may support the weight of roof assembly 400. The offset ends of the top trim plates 960*b* may be welded to or attached perpendicular to the top flanges of c-channel 920*c* with screws or nuts and bolts of various sizes. Top trim plates 960*b* may be attached to the inside and/or outside flanges of the c-channel 920*c*. Top trim plates 960*b* may be installed before or after the wall panels 300 are assembled. The upper plate or flange of top channel plate 960*c* may be welded to or attached parallel to the top flange of top angle 960*a* with screws or nuts and bolts of various sizes.

In some embodiments, the top angle 960*a* may have a length ranging from 2 feet to 20 feet and a thickness ranging from ⅛ inch to ½ inch. Top angle 960*a* may have side flanges ranging from 2 inches to 16 inches. Top angle 960*a* may have flanges of different lengths. The ends of top angle 960*a* may be enclosed with a plate which may not cover the entire flange lengths. The additional plate may be welded on as part of top angle 960*a*. Top angle 960*a* may have one or more holes drilled through and/or one or more welded nuts or bolts on one or both enclosed ends which may allow HSS column 920*a* and/or corner castings 910 to be attached. Top angle 960*a* may support the weight of the modular building unit 100.

In some embodiments, the top trim plates 960*b* may have a length ranging from 1 foot to 20 feet, a width ranging from 2 inches to 8 inches and a thickness ranging from 1/16 inch to ½ inch. The ends of top trim plates 960*b* may be offset from the main length by 1/16 inch to 1 inch and have an offset end length ranging from 1 inch to 8 inches. The ends of top trim plates 960*b* may be welded to or attached to the top of c-channel 920*c* and/or corner angle trim 920*d* with screws or nuts and bolts of various sizes. Top trim plates 960*b* may seal the edges of wall panels 300 from water.

In some embodiments, the top channel plate 960*c* may have a length ranging from 1 foot to 20 feet and a thickness ranging from 1/16 inch to ½ inch. Top channel plate 960*c* may have a lower plate width ranging from ½ inch to 8 inches with an offset length ranging from 1/16 inch to 1 inch and extending from the offset length may be an upper plate with a width ranging from ½ inch to 8 inches. Top channel plate 960*c* may have an upper plate and lower plate of different lengths. The upper plate of top channel plate 960*c* may be welded to or attached to the top flange of top angle 960*a* with screws or nuts and bolts of various sizes. The ends of the top channel plate 960*c* may be enclosed with a welded plate if necessary. Top channel plate 960*c* may allow exterior siding panels 600 to be inserted inside the channel opening of the top channel plate 960*c* to hold the exterior siding panels 600 in place.

FIGS. 10A-10F illustrates sections through the modular container unit 100. Each section illustrates multiple parts of the unit assembled together. FIGS. 10A-10F may include parts from FIGS. 2A-9D to illustrate their connections to each other and placement within the frame 110.

Figure 10A:
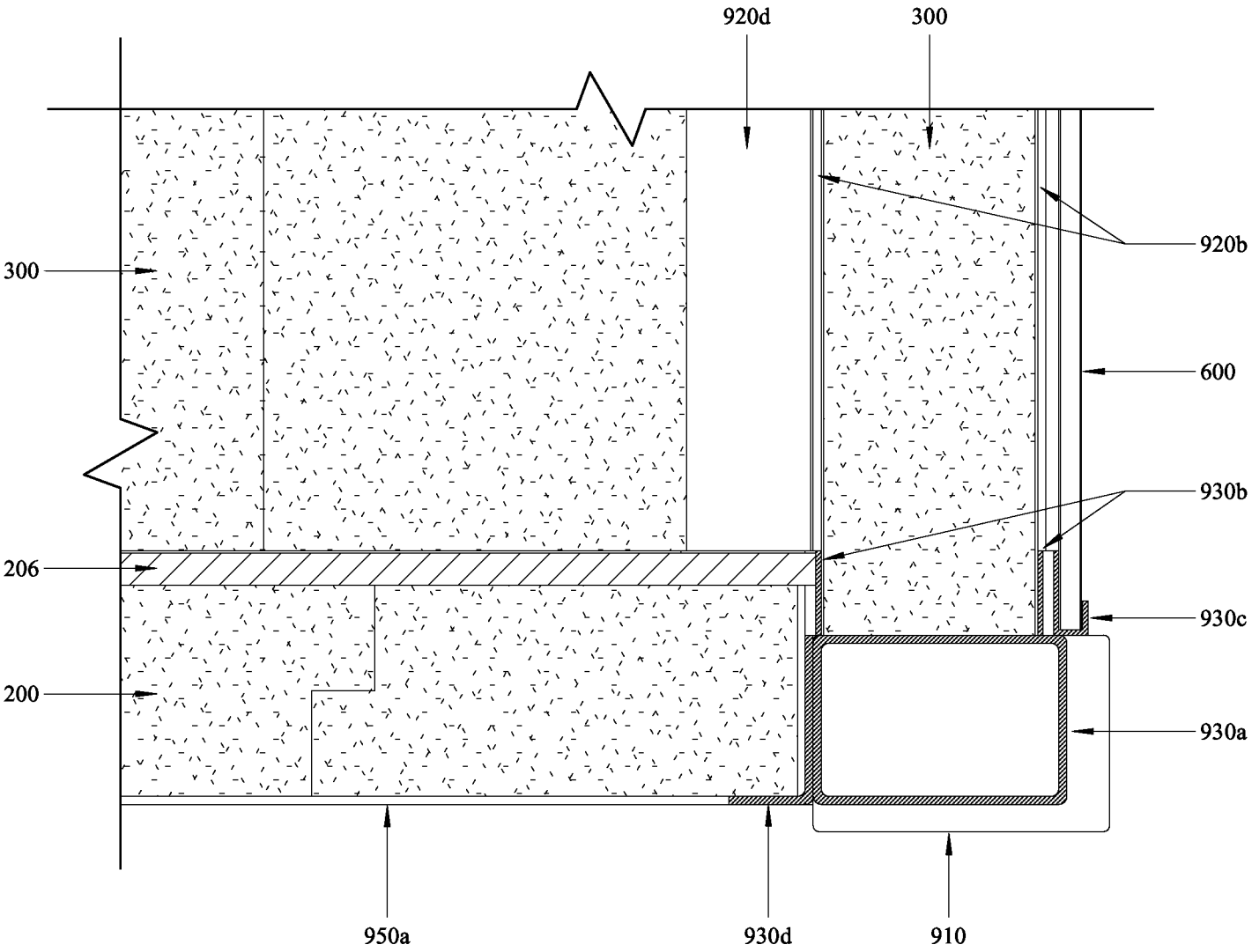
FIG. 10A illustrates an example section view of the bottom of a frame assembly on the short side of the modular building unit.

FIG. 10A illustrates a section of the base of the short side frame of a modular building unit. This illustration may include the connections of the floor assembly 200, wall panels 300, exterior siding panels 600 and the frame assembly 900.

Figure 10B:
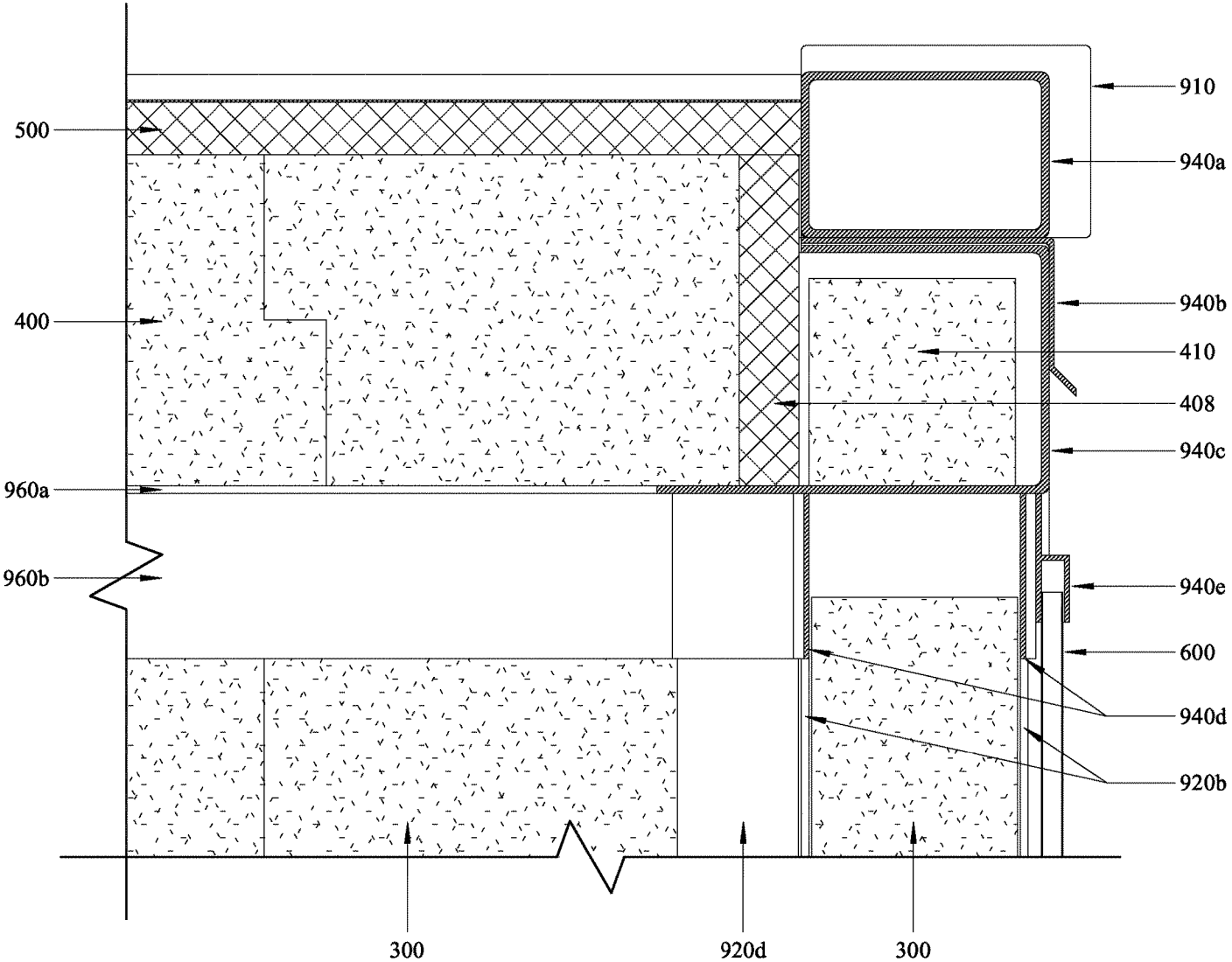
FIG. 10B illustrates an example section view of the top of a frame assembly on the short side of the modular building unit.

FIG. 10B illustrates a section of the top of the short side frame of a modular building unit. This illustration may include the connections of the wall panels 300, roof assembly 400, exterior roof assembly 500, exterior siding panels 600 and the frame assembly 900.

Figure 10C:
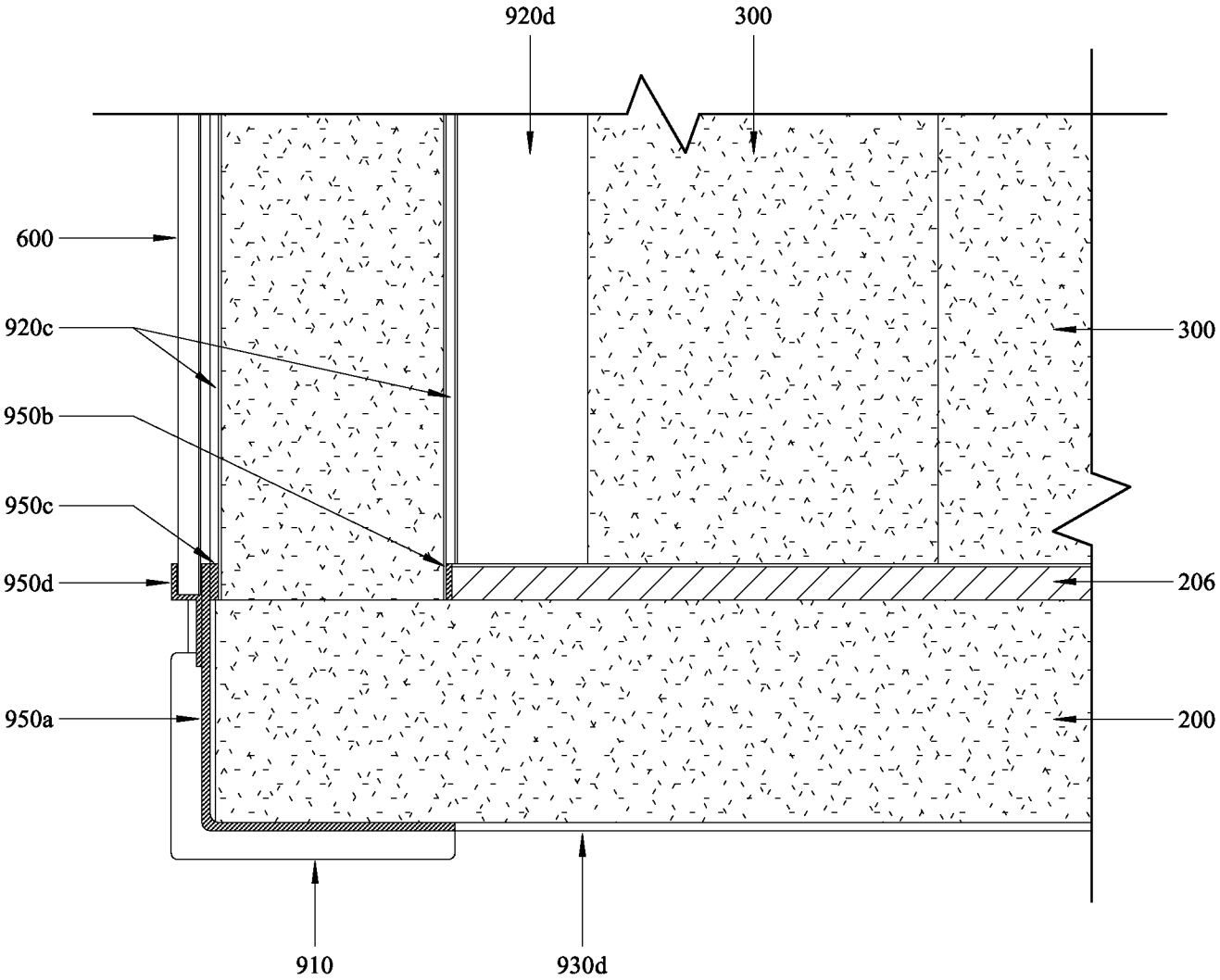
FIG. 10C illustrates an example section view of the bottom of a frame assembly on the long side of the modular building unit.

FIG. 10C illustrates a section of the base of the long side frame of a modular building unit. This illustration may include the connections of the floor assembly 200, wall panels 300, exterior siding panels 600 and the frame assembly 900.

Figure 10D:
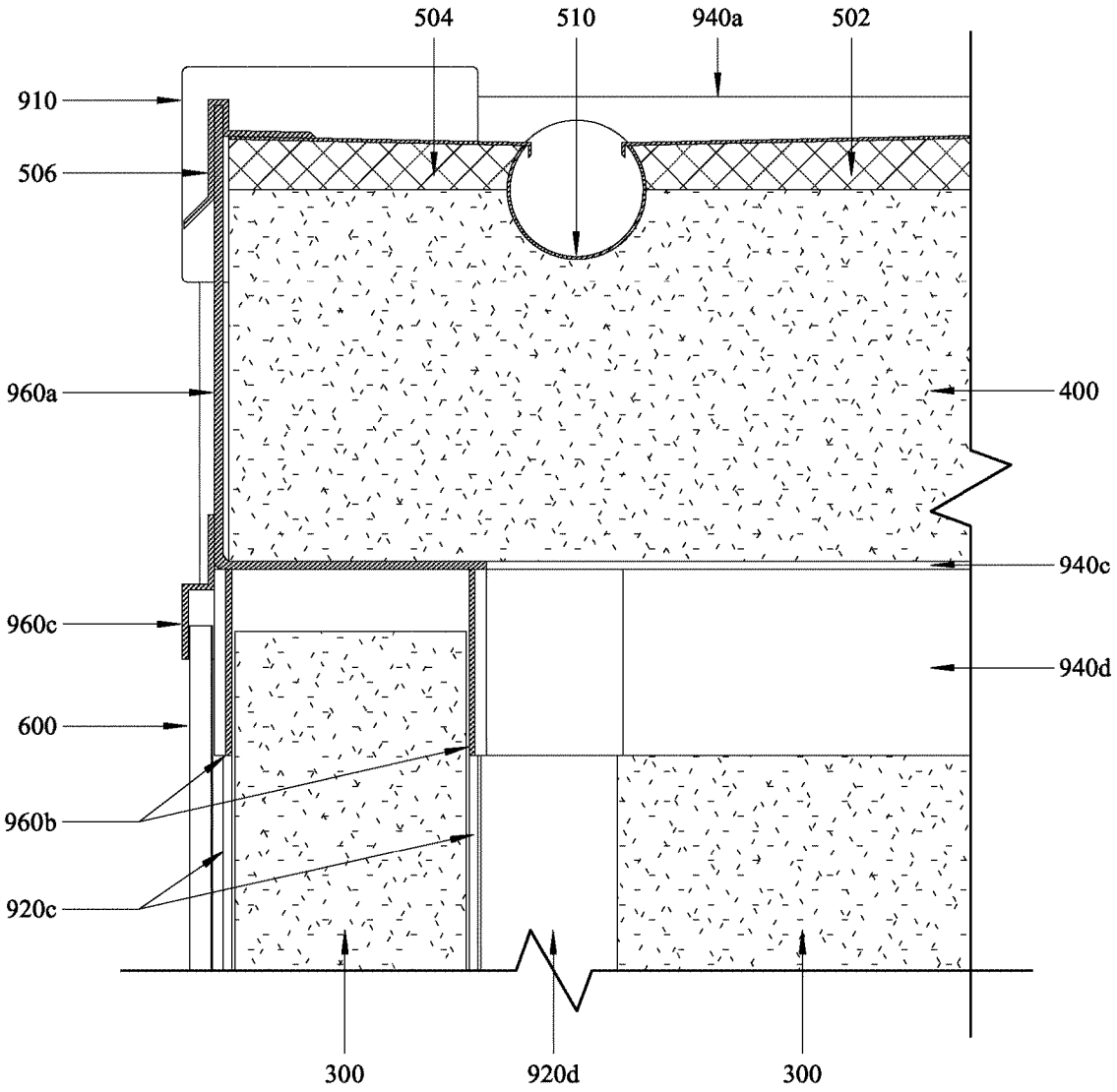
FIG. 10D illustrates an example section view of the top of a frame assembly on the long side of the modular building unit.

FIG. 10D illustrates a section of the top of the long side frame of a modular building unit. This illustration may include the connections of the wall panels 300, roof assembly 400, exterior roof assembly 500, exterior siding panels 600 and the frame assembly 900.

Figure 10E:
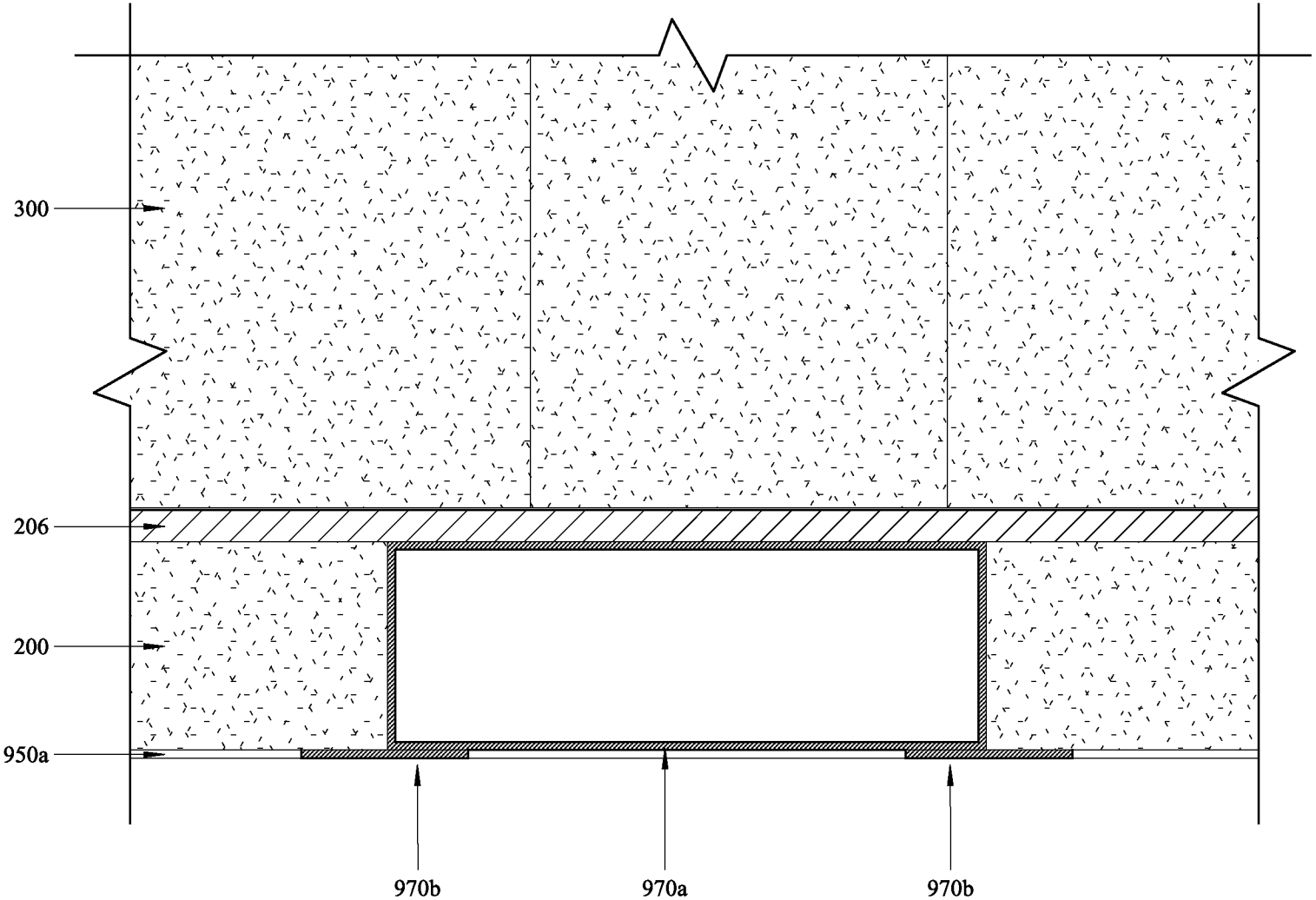
FIG. 10E illustrates an example section view of the forklift pocket assembly on the modular building unit.

FIG. 10E illustrates a section of the forklift pocket of a modular container unit. This illustration may include the connections of the floor assembly 200, wall panels 300, and the frame assembly 900.

Figure 10F:
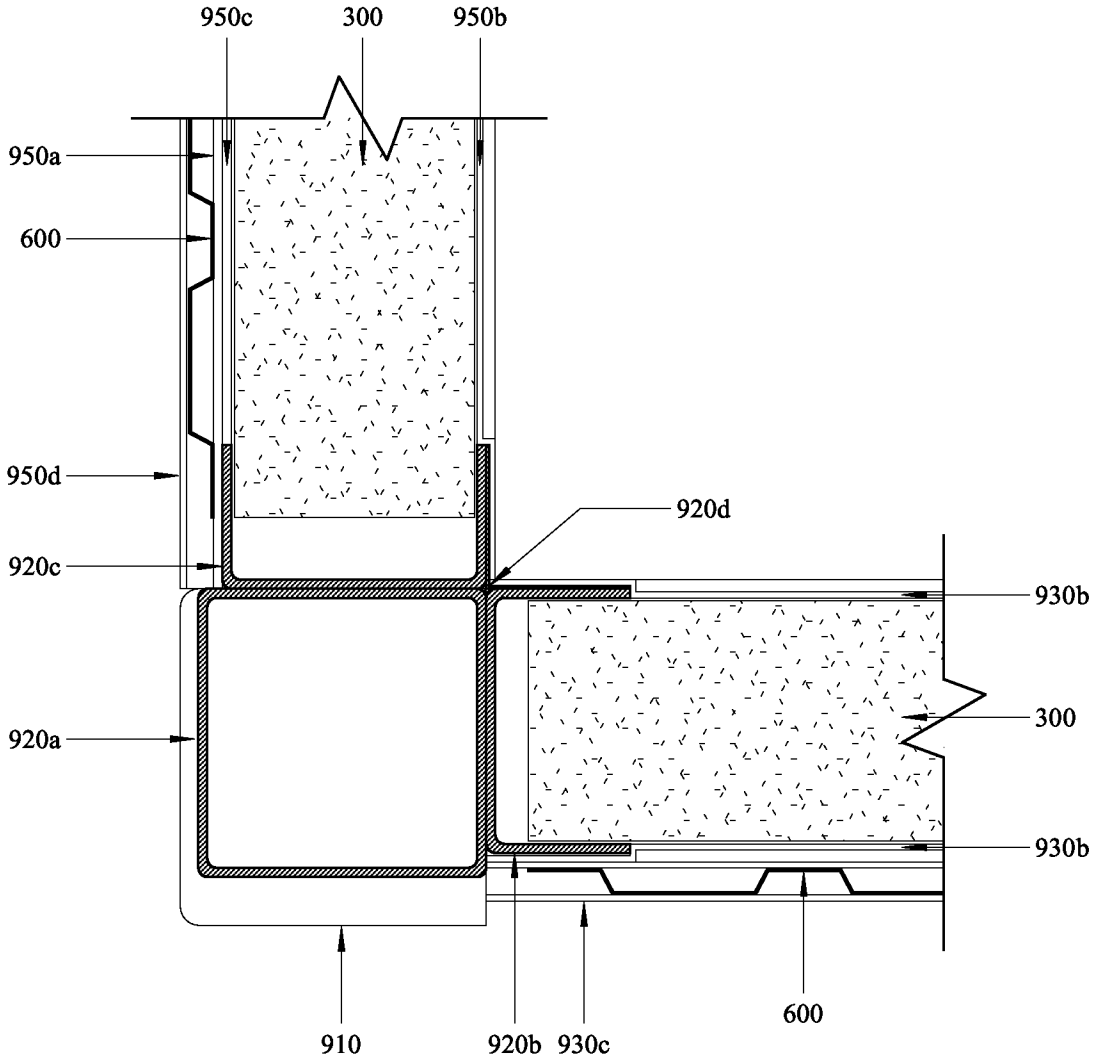
FIG. 10F illustrates an example section view of the corner column assembly on the modular building unit.

FIG. 10F illustrates a section of the corners of a modular container unit. This illustration may include the connections of the wall panels 300, exterior siding panels 600, and the frame assembly 900.

In some embodiments, there may be one or more small openings within the assembly in order to keep a standard size floor, wall and roof panel increment. The overall standard increment of the floor, wall and roof panels may have a length ranging from 1 foot to 10 feet, a width ranging from 4 inches to 4 feet, and a depth ranging from 2 inches to 14 inches. To keep a consistent overall panel size which may be assembled in frame 110, this may result in a few areas which have remaining openings. The openings may be used for space to attach screws or nuts and bolts of various sizes to not interfere with the panels or the openings may be filled using any material of choice and may be fitted to the necessary size of the opening. There may be one or more edges around the perimeter of components which may be sealed from water using any vapor barrier material of choice.

FIGS. 11A-11D illustrates floor plans of example building functions. Modular building units may be used for multiple building functions. Each modular building unit 100 may be set up for various purposes including but not limited to housing, offices, medical, armory and storage. Each unit may be set up for one function but have the ability to be altered for a different purpose if desired in the future, thus creating a multifunctional space. Having the same container be arranged in different ways extends the use of the container and allows it to be used in multiple different ways over the course of many years. This minimizes the need for a new building to be constructed since the singular modular building unit 100 can be rearranged and used for any purpose desired.

Figure 11A:
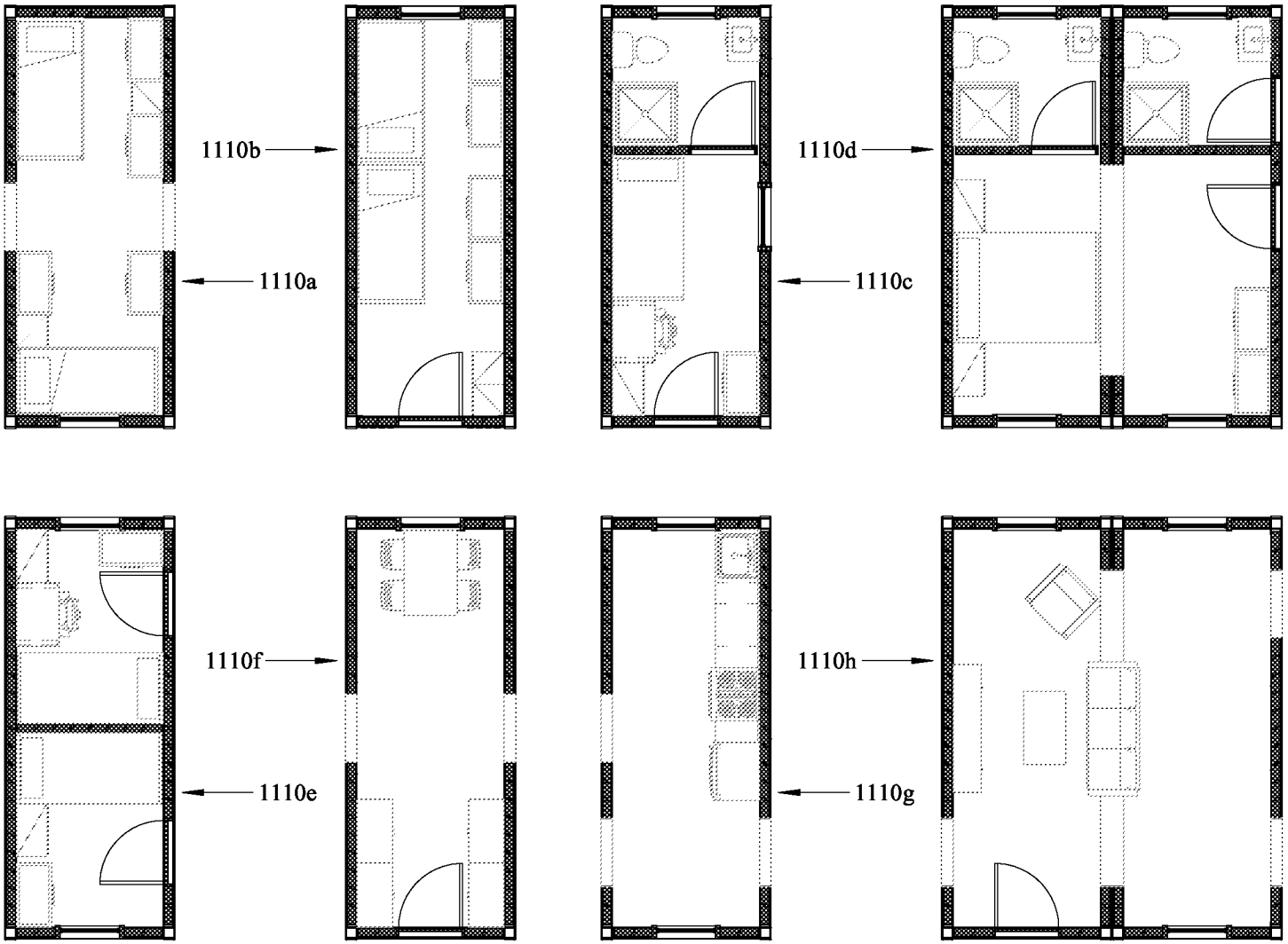
FIG. 11A illustrates an example plan view of interior housing unit layouts of modular building units.

FIG. 11A illustrates example floor plans of housing units. The example housing units 1110 may be arranged as shown in the figure or altered as necessary for the function of the unit. The furniture inside the units are shown as an example layout and may not be the actual layout when constructed. Furniture and installations inside the housing units 1110 may vary in size and may include beds, nightstands, dressers, desks, chairs, and storage cabinets. Décor inside the housing units 1110 may vary based on the occupants and may be installed as desired. Housing units 1110 may include one or more attached units for rooms including but not limited to a bedroom 1110*a*-1110*e*, a bathroom 1110*c* and 1110*d*, storage and dining room 1110*f*, kitchen 1110*g*, and living room 1110*h*. A bedroom unit 1110*a*-1110*e* may include but not be limited to furniture of various sizes such as beds, night stands, dressers, desks, and chairs. A bathroom unit 1110*c* and 1110*d* may include installations including but not limited to various sizes of a toilet, sink, vanity, and shower. A storage unit 1110*f* may include but not be limited to furniture of various sizes such as storage cabinets and shelving. A dining room unit 1110*f* may include but not be limited to furniture of various sizes such as tables and chairs. A kitchen unit 1110*g* may include but not be limited to various sizes of installations such as a range or oven, hood or vent, refrigerator and freezer, sink, dishwasher, and cabinets. A living room unit 1110*h* may include but not be limited to furniture of various sizes such as sofas, tables, chairs, and storage cabinets.

In some embodiments, the example housing units 1110 may be arranged to accommodate one or more functional spaces. For example, a bedroom unit 1110*c* and 1110*d* may also have a bathroom 1110*c* and 1110*d*, a kitchen unit 1110*g* may also have a dining room 1110*f*, a storage room 1110*f* may also have a dining room 1110*f*, and a living room 1110*h* may also have a storage room 1110*f*. One or more modular building units may share the same rooms for example, in housing units 1110, there may be one or more bedroom units 1110*a*-1110*e* which share one or more bathroom 1110*c* and 1110*d*, storage and dining room 1110*f*, kitchen 1110*g*, and living room 1110*h*. Some rooms may be two attached units to create one larger room. For example, a bedroom 1110*d* and/or living room 1110*h* may be two attached units for a larger and more open room for the occupants.

Figure 11B:
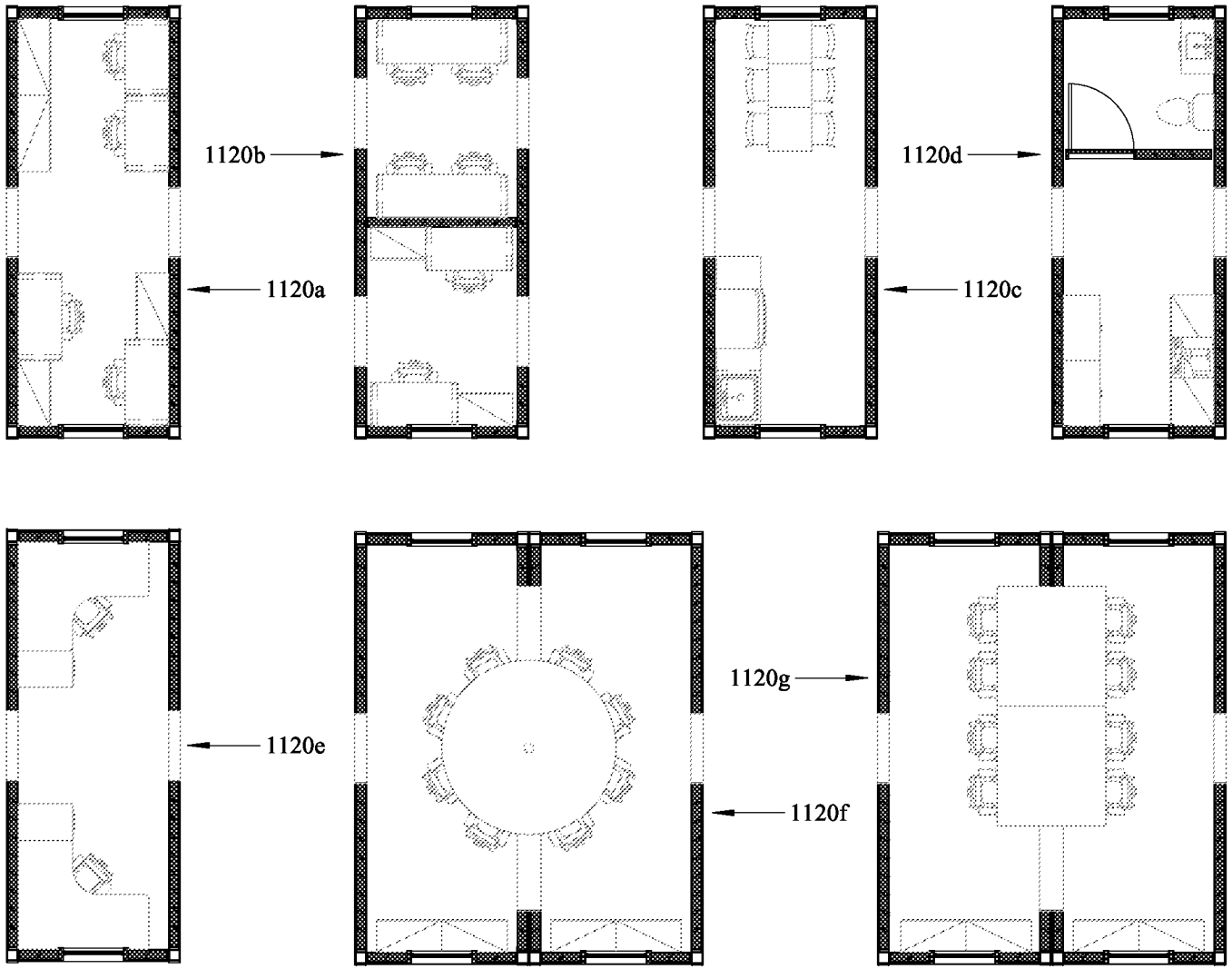
FIG. 11B illustrates an example plan view of interior office unit layouts of modular building units.

FIG. 11B illustrates example floor plans of office units. The example office units 1120 may be arranged as shown in the figure or altered as necessary for the function of the unit. The furniture inside the units are shown as an example layout and may not be the actual layout when constructed. Furniture and installations inside the office units 1120 may vary in size and may include tables, desks, chairs, and storage cabinets. Décor inside the office units 1120 may vary based on the occupants and may be installed as desired. Office units 1120 may include one or more attached units for rooms including but not limited to work desk rooms 1120*a* and 1120*b*, a kitchen and break room 1120*c*, bathroom and storage room 1120*d*, private offices 1120*e*, and conference rooms 1120*f* and 1120*g*. A work desk room 1120*a* and 1120*b* may include but not be limited to furniture of various sizes such as desks, chairs, and storage cabinets. A kitchen 1120*c* may include but not be limited to various sizes of installations such as a range or oven, hood or vent, refrigerator and freezer, sink, dishwasher, and cabinets. A break room 1120*c* may include but not be limited to furniture of various sizes such as tables and chairs. A bathroom 1120*d* may include installations including but not limited to various sizes of a toilet, sink, and vanity. A storage room 1120*d* may include but not be limited to furniture of various sizes include storage cabinets and shelving. A private office 1120*e* may include but not be limited to furniture of various sizes such as tables, desks, chairs and storage cabinets. A conference room 1120*f* and 1120*g* may include but not be limited to furniture of various sizes such as tables, chairs, and storage cabinets.

In some embodiments, the example office units 1120 may be arranged to accommodate one or more functional spaces. For example, a kitchen 1120*c* may also have a break room 1120*c* and a bathroom 1120*d* may also have a storage room 1120*d*. One or more modular building units may share the same rooms for example, in office units 1120, there may be one or more works desk rooms 1120*a* and 1120*b* which share one or more kitchen and break room 1120*c*, bathroom and storage room 1120*d*, private offices 1120*e*, and conference rooms 1120*f* and 1120*g*. Some rooms may be two attached units to create one larger room. For example, a conference room 1120*f* and 1120*g* may be two attached units for a larger and more open room for the occupants.

Figure 11C:
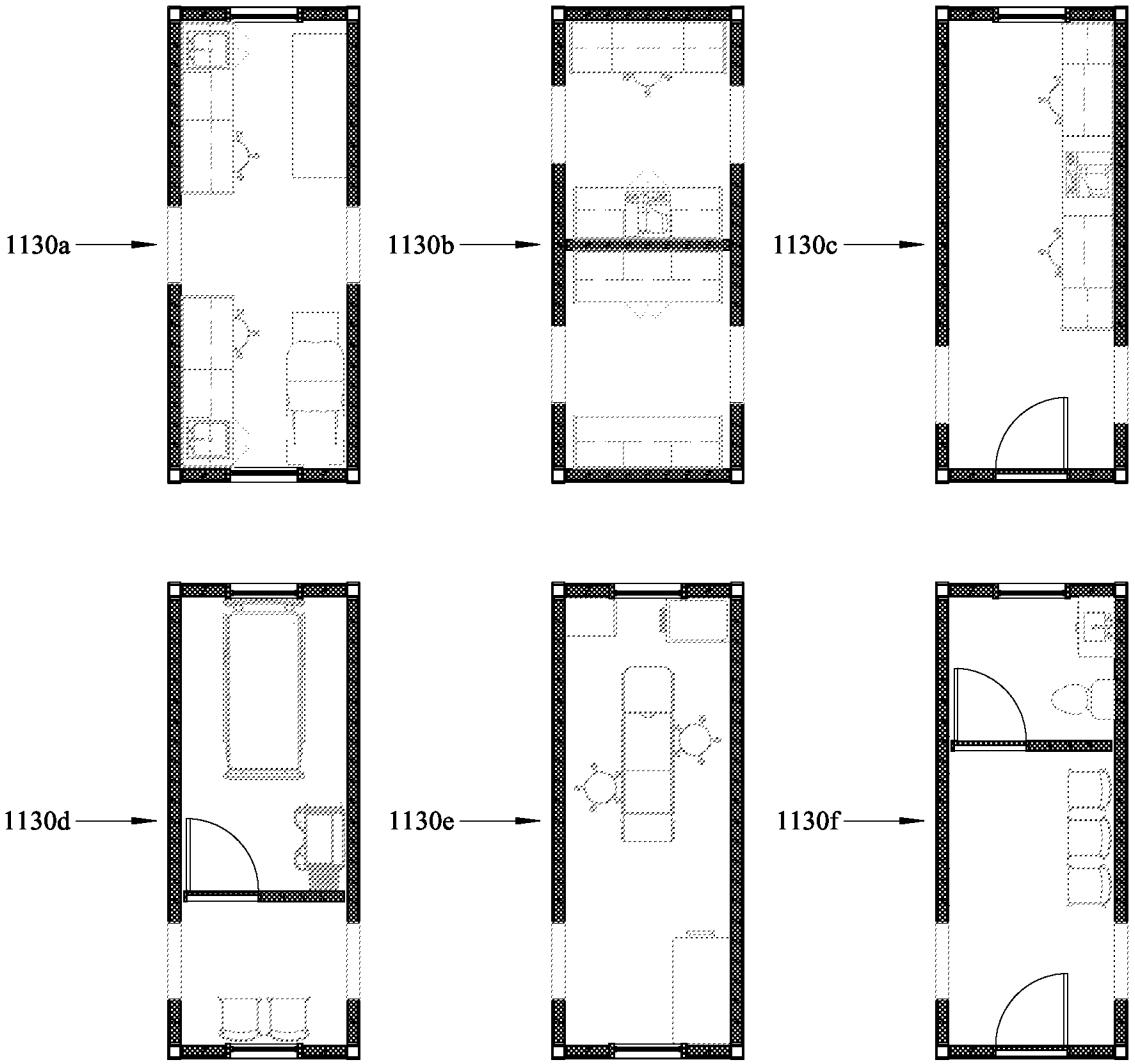
FIG. 11C illustrates an example plan view of interior medical unit layouts of modular building units.

FIG. 11C illustrates example floor plans of medical units. The example medical units 1130 may be arranged as shown in the figure or altered as necessary for the function of the unit. The furniture inside the units are shown as an example layout and may not be the actual layout when constructed. Furniture and installations inside the medical units 1130 may vary in size and may include tables, desks, chairs, stools, storage cabinets, shelving, recovery beds, and medical equipment cabinets. Décor inside the medical units 1130 may vary based on the occupants and may be installed as desired. Medical units 1130 may include one or more attached units for rooms including but not limited to an exam room 1130*a*, pharmacy and medical storage room 1130*b*, nurses station 1130*c*, recovery room 1130*d*, operation room 1130*e*, and bathroom and waiting room 1130*f*. An exam room 1130*a* may include installations and furniture including but not limited to various sizes of an exam table, medical equipment cabinets, sinks, desks, chairs, and stools. A pharmacy 1130*b* may include but not be limited to furniture of various sizes such as tables, desks, chairs, stools, storage cabinets and shelving. A medical storage room 1130*b* may include but not be limited to furniture of various sizes such as storage cabinets and shelving. A nurses station 1130*c* may include but not be limited to furniture of various sizes such as medical equipment cabinets, desks, chairs and stools. A recovery room 1130*d* may include but not be limited to furniture of various sizes of such as a recovery bed, medical equipment cabinets, and chairs. An operation room 1130*e* may include but not be limited to furniture of various sizes such as an operation table, medical equipment cabinets, stools and chairs. A bathroom 1130*f* may include installations including but not limited to various sizes of a toilet, sink, and vanity. A waiting room 1130*f* may include but not be limited to furniture of various sizes such as tables and chairs.

In some embodiments, the example medical units 1130 may be arranged to accommodate one or more functional spaces. For example, a recovery room 1130*d* may also have a waiting room 1130*f*, and a nurses station 1130*c* and/or a waiting room 1130*f* may also have a bathroom 1130*f*. One or more modular building units may share the same rooms for example, in medical units 1130, there may be one or more exam rooms 1130*a* which share one or more pharmacy and medical storage room 1130*b*, nurses station 1130*c*, recovery room 1130*d*, operation room 1130*e*, and bathroom and waiting room 1130*f*. Some rooms may be two attached units to create one larger room. For example, a pharmacy and/or medical storage room 1130*b* may be two attached units for a larger and more open room for the occupants.

Figure 11D:
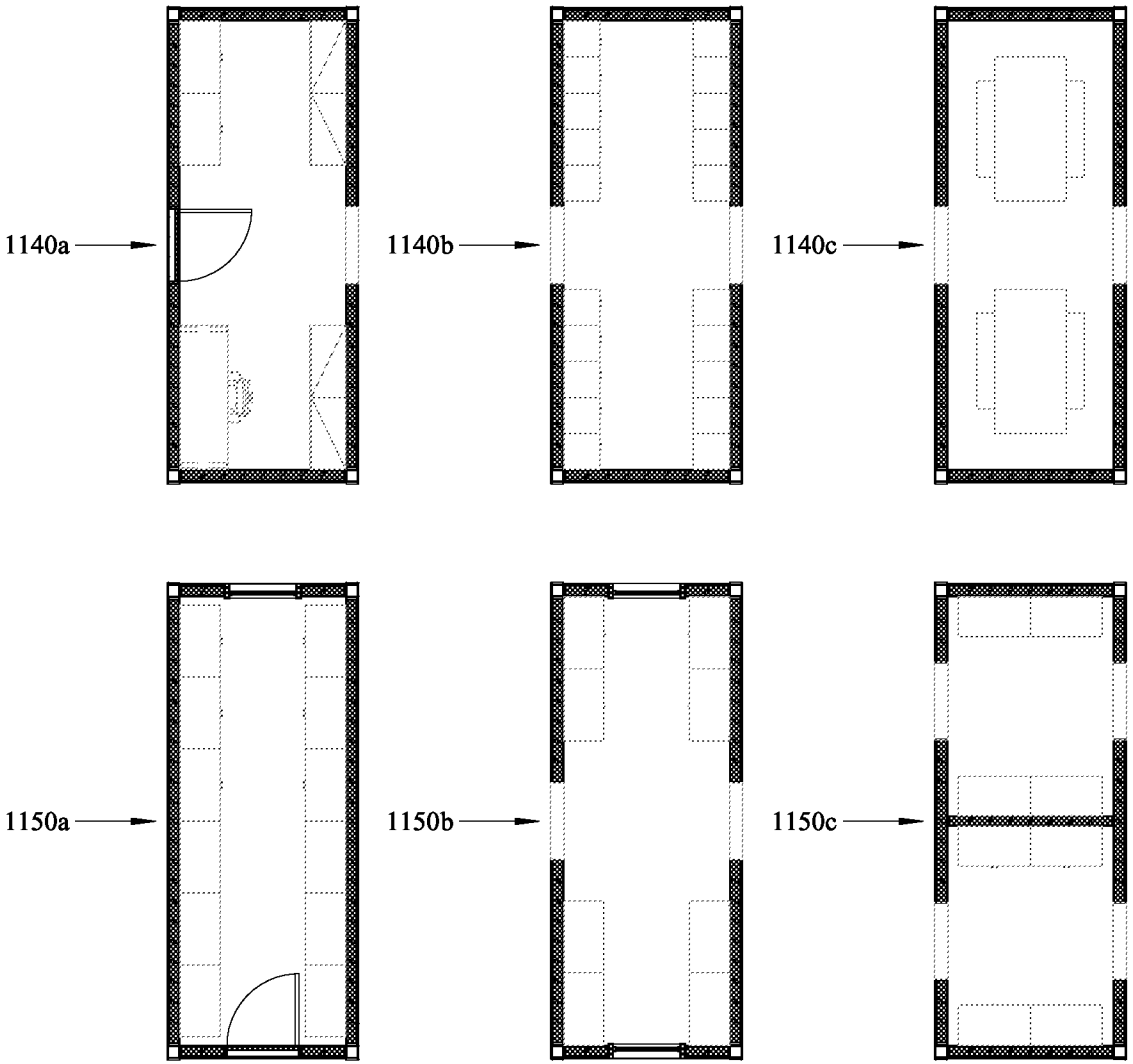
FIG. 11D illustrates an example plan view of interior armory and storage unit layouts of modular building units.

FIG. 11D illustrates example floor plans of armory units 1140 and storage units 1150. In some embodiments, the example armory units 1140 may be arranged as shown in the figure or altered as necessary for the function of the unit. The furniture inside the units are shown as an example layout and may not be the actual layout when constructed. Furniture inside the armory units 1140 may vary in size and may include tables, desks, benches, chairs, lockers, storage cabinets and shelving. Décor inside the armory units 1140 may vary based on the occupants and may be installed as desired. Armory units 1140 may include one or more attached units for spaces including but not limited to an office 1140*a*, locked storage rooms 1140*b*, and workspaces 1140*c*. An office 1140*a* may include but not be limited to furniture of various sizes such as desks, chairs and storage cabinets. A locked storage room 1140*b* may include but not be limited to furniture of various sizes such as lockers, storage cabinets and shelving. A workspace 1140*c* may include but not be limited to furniture of various sizes such as tables, benches and chairs.

In some embodiments, the example armory units 1140 may be arranged to accommodate one or more functional spaces. For example, a locked storage space 1140*b* may also have a workspace 1140*c*. One or more modular building units may share the same rooms for example, in armory units 1140, there may be one or more offices 1140*a* which share one or more locked storage rooms 1140*b* and workspaces 1140*c*. Some rooms may be two attached units to create one larger room. For example, a locked storage room 1140*b* or workspace 1140*c* may be two attached units for a larger and more open room for the occupants.

In some embodiments, the example storage units 1150 may be arranged as shown in the figure or altered as necessary for the function of the unit. The furniture inside the units are shown as an example layout and may not be the actual layout when constructed. Furniture inside the storage units 1150 may vary in size and may include lockers, storage cabinets and shelving. Décor inside the storage units 1150 may vary based on the occupants and may be installed as desired. Storage units 1150 may include more attached units for rooms including but not limited to open and locked storage rooms 1150*a*-1150*c*. An open or locked storage room 1150*a*-1150*c* may include but not be limited to furniture of various sizes such as lockers, storage cabinets and shelving.

In some embodiments, the example storage units 1150 may be arranged to accommodate one or more functional spaces. For example, an open storage room 1150*a*-1150*c* may also have a locked storage room 1150*a*-1150*c*. One or more modular building units may share the same rooms for example, in storage units 1150, there may be one or more open storage rooms 1150*a*-1150*c* which share one or more locked storage rooms 1150*a*-1150*c*. Some rooms may be two attached units to create one larger room. For example, an open or locked storage room 1150*a*-1150*c* may be two attached units for a larger and more open room for the occupants.

In some embodiments, the modular building units 100 may be altered as necessary to incorporate mechanical, electrical and plumbing systems (MEP) inside to improve the function of the units. Components of a modular building unit 100 may be altered to accommodate the function of MEP systems inside. There may be multiple variations of the modular building unit components which may be designed for functional MEP systems. MEP systems may be used for specific building layouts as illustrated in FIGS. 11A-11D including but not limited to bathrooms and kitchens.

In some embodiments, to incorporate MEP systems within the design of the modular building unit 100, the floor assembly 200, wall panels 300, and roof assembly 400 may have hollow channels within the depth of the panels to accommodate piping including but not limited to PEX, PVC, steel and/or copper. The channels may be designed into the panel molds during manufacturing or may be drilled through the panels on site as necessary. The channels may be in standardized locations on the panels to allow for easy assembly. The floor assembly 200, wall panels 300, and roof assembly 400 may have additional standard panel types with MEP channels inside for quick and efficient manufacturing along with the solid panels. The channels may extend partially or entirely through the length, width or depth of the panel in a vertical or horizontal direction. The diameter of the channels and piping inside may range from ¼ inch to 6 inches. The piping inside the panels may be used to connect to a water, sewer and/or gas line as well as electrical wiring.

In some embodiments, hot and cold water piping as well as gas lines may be extended through one or more panels to reach locations for valves on the interior of the unit. The valves may be installed through round and/or rectangular openings cut on one side of the panels which connect to the piping within the panel. The sewer line may extend through the panels and down to exit the unit into pipelines in the ground. Electrical wires may be run through the channels or PVC piping within the panels to any location. An electrical panel may be installed in a rectangular opening or on the surface of one side of wall panels 300 to connect and power all of the electrical lines. The channels of piping in the panels 300 may extend across one or more panels to reach locations necessary for electrical equipment such as light switches, outlets, lights, smoke detectors and carbon monoxide detectors. Electrical equipment may be wired and installed as necessary through round and/or rectangular openings cut on one side of the panels 300 which connect to the electrical piping channel. The exterior roof assembly 500, exterior siding panels 600 and frame assembly 900 may have round or rectangular openings of various sizes cut through one or more components to allow piping to extend through. Channels of piping may extend through the floor, walls and/or roof into another unit and/or to the outside of the building to connect to a main line in the ground.

In some embodiments, below a modular building unit there may be piping which extends into the ground and may connect to a main line. The ground below the units may be prepared beforehand for the installation of MEP systems. Preparation of the ground may include, digging trenches below for access to piping mains, determining locations for MEP systems access into the unit based on the floor plan layout, leveling the ground surface, compacting the ground material below, and/or pouring a concrete slab. Below the modular building units 100, the ground may be soil, gravel, sand and/or a combination of such materials, or may be a concrete slab of various thicknesses.

In some embodiments, modular building units 100 may be placed directly on the ground surface material or may be placed on a raised structural support. The raised structural support may be footings in each corner on which the corner castings 910 of the unit rest on. Alternatively, bricks or concrete masonry units (CMU) may be used as a foundation underneath the perimeter of the modular building unit 100. The raised structural support may be various different structural supports of various materials including steel, concrete, wood, brick, CMU or any combination of the listed materials or other materials. A foundation may be constructed of various materials including brick, CMU, concrete or any combination of the listed materials or other materials. Modular building units 100 placed on a raised structural support may have stairs constructed up to the first floor level. The stairs may be constructed of materials including, metals such as, aluminum and steel, brick, CMU, concrete, wood or any combination of the listed materials or other materials. The stairs may be constructed in accordance with the building code in the modular building units site location.

In some embodiments, singular modular building units may be connected together into double wide units along the short or long sides of the frame to create a larger room for the occupants as illustrated in FIG. 11A and FIG. 11B. One or more modular building units 100 may be aligned next to each other to connect one or more of the spaces inside and create a larger scale building 1200. The units may be connected with a door or an open passageway in between the two units. One or more modular building units 100 may be connected together with what may be referred to as, container connectors and roof connection covers, which may be used to close the gap of open space between one or more units and seal the units from water. The container connectors and roof connection covers may be of different shapes and sizes based on the desired function of the space inside. For example, a container connector and/or a roof connection cover may be in the shape of a c-channel or an angle which is attached over the wall panels 300, exterior roof assembly 500 and frame assembly 900 and used similarly to capping the ends of an opening. The container connectors and roof connection covers may be cut and fitted into place during construction based on the alignment of the modular building units.

In some embodiments, a single modular building unit 100 may be constructed the same as one or more modular building units 100 connected together. A single modular building unit 100 may be constructed and be altered afterwards to connect to another modular building unit 100. To alter a single unit, one or more wall panels 300 and exterior siding panels 600 may be removed as necessary based on the opening size between the units. Once the wall panels 300 and exterior siding panels 600 are removed to the desired opening size, container connectors may be installed around the perimeter of the opening to seal the edges of the units together. Alternatively, a door 700 may be installed within the opening to allow access in between one or more modular building units 100. To connect the roof of one or more modular building units 100 together, the roof drip edge covers 506 may be removed from one or more sides as necessary. Once the roof drip edge covers 506 are removed, roof connection covers may be installed over top angles 960*a* and attached to exterior roof assembly 500 and/or frame assembly 900 using screws or nuts and bolts of various sizes. The modular building units 100 may be altered overtime based on their desired functional use.

In some embodiments, the container connectors and roof connection covers may be made of any material including wood, aircrete, high density foam, silicone, steel, aluminum and metal or any combination of the listed materials or other materials. For example, in some embodiments, the container connectors and roof connection covers may be made from aluminum. In these and other embodiments, the container connectors and roof connection covers may be individually constructed or constructed from a mold at a manufacturing facility. The container connectors and roof connection covers may be standard sizes of members or custom sizes. Container connectors and roof connection covers may be altered or adjusted during construction as necessary to include cutting, bending, welding, drilling, or any other change which may be made to the component's material. By using aluminum, the container connectors and roof connection covers provide strength and flexibility to the connections of the modular building unit 100. A singular person or group of people may lift container connectors and roof connection covers together to be positioned into place. Container connectors and roof connection covers may weigh 0.5 pounds to 50 pounds per component.

In some embodiments, the container connector may have a length ranging from 1 foot to 20 feet and a thickness ranging from 1/16 inch to 4 inches. The container connector may have a width ranging from 2 inches to 16 inches with side flanges ranging from 1/4 inch to 8 inches. The container connector may have one or more flanges which may help secure the component in place on the frame 110. The container connector may be attached to the wall panels 300 and/or the frame assembly 900 with screws or nuts and bolts of various sizes.

In some embodiments, the container connectors may be attached along the bottom of the one or more units similar to a threshold, along the sides of one or more units similar to the trim of an opening and to the top of one or more units similar to a header of an opening. When the container connectors are attached to the frame 110 of one or more units, a waterproof sealant or similar may be used to seal the edges and/or any remaining space between components. By using the container connectors around the opening of one or more connecting units, it caps the ends of visible components within the opening and creates a smooth surface to transition into another unit.

In some embodiments, the roof connection cover may have a length ranging from 1 foot to 20 feet and a thickness ranging from 1/16 inch to 4 inches. The roof connection cover may have a width ranging from 2 inches to 16 inches with side flanges ranging from 1/4 inch to 8 inches. There may be additional flanges extending out perpendicular from the side flanges which may have a length ranging from 1 inch to 8 inches. The additional flanges may have a slope ranging from 0 inches to 4 inches per 1 foot to match the slope of the exterior end roof panel 504. The additional flanges may have an angled edge ranging from 5 degrees to 90 degrees and may serve a function as a drip edge into the roof gutter channel 510. The roof connection cover may have one or more flanges which may help secure the component in place on the exterior end roof panels 504 and frame assembly 900. The roof connection covers may be attached to the exterior end roof panels 504 and/or the frame assembly 900 with screws or nuts and bolts of various sizes.

In some embodiments, the roof connection cover may be attached over the top angles 960*a* which are positioned next to each other as modular building units 100 are placed side by side. When the roof connection covers are attached to the exterior roof end panels 504 and/or frame assembly 900 of the one or more units, a waterproof sealant or similar may be used to seal the edges and/or any remaining space between components. By using the roof connection covers over the top angles 960*a* of one or more connecting units, it caps the roof opening between one or more modular building units 100 connected next to each other. Roof connection covers may serve a function to seal the roof opening between one or more modular building units 100 from water.

In some embodiments, modular building units 100 may have interior walls which create one or more interior rooms within a unit as illustrated in FIGS. 11A-11D. One or more interior rooms may be constructed within a unit by using wall trim angles. One or more modular building units 100 may use wall trim angles to secure wall panels 300 in place for interior rooms within a unit. The wall trim angles may be cut and fitted into place during construction as needed to install the interior walls.

In some embodiments, the wall trim angles may be made of any material including steel, aluminum and metal or any combination of the listed materials or other materials. For example, in some embodiments, the wall trim angles may be made from steel. In these and other embodiments, the wall trim angles may be individually constructed or constructed from a mold at a manufacturing facility. The wall trim angles may be standard sizes of members or custom sizes. Wall trim angles may be altered or adjusted during construction as necessary to include cutting, bending, welding, drilling, or any other change which may be made to the component's material. By using steel, the wall trim angles provide strength to the interior walls of the modular building unit 100. A singular person or group of people may lift wall trim angles together to be positioned into place. Wall trim angles may weigh 0.5 pounds to 50 pounds per component.

In some embodiments, the wall trim angles may have a length ranging from 1 foot to 10 feet and a thickness ranging from 1/16 inch to 1/4 inch. The wall trim angles may have side flanges ranging from 1 inch to 8 inches. The wall trim angles may have side flanges of equal or different lengths. The flanges of wall trim angles may be welded to or attached to the floor assembly 200, wall panels 300, roof assembly 400 and/or the frame assembly 900 with screws or nuts and bolts of various sizes. Wall trim angles may seal an interior room from the main space in the unit.

In some embodiments, the wall trim angles may be attached along the base, sides and/or top of both sides of the wall panels 300. The wall trim angles may be attached before the secondary flooring 206 is installed. Wall trim angles may be similar to corner angle trim 920*d* with the purpose of sealing the edges of the interior space of wall panels 300. Wall trim angles around the perimeter of the interior walls may secure the wall panels and create a separate room from the main unit.

In some embodiments, one or more modular building units 100 may have door and window trim, baseboards and/or crown moldings installed to finish the inside of the unit. The door and window trim, baseboards and crown moldings may be cut and fitted into place during construction as needed to install over the interior walls. The door and window trim, baseboards and/or crown moldings may be in various shapes and sizes based on the desired appearance. The door and window trim, baseboards and crown moldings may create a finished appearance to the interior walls.

In some embodiments, the door and window trim, baseboards and crown moldings may be made of any material including wood, steel, aluminum or any combination of the listed materials or other materials. For example, in some embodiments, the door and window trim, baseboards and crown moldings may be made from aluminum. In these and other embodiments, the door and window trim, baseboards and crown moldings may be individually constructed or constructed from a mold at a manufacturing facility. The door and window trim, baseboards and crown moldings may be standard sizes of members or custom sizes. Door and window trim, baseboards and crown moldings may be altered or adjusted during construction as necessary to include cutting, bending, welding, drilling, or any other change which may be made to the component's material. By using aluminum, the door and window trim, baseboards and crown moldings provide strength and flexibility to the corners of the interior walls of the modular building units 100. A singular person or group of people may lift door and window trim, baseboards and crown moldings together to be positioned into place. Door and window trim, baseboards and crown moldings may weigh 0.5 pounds to 50 pounds per component.

In some embodiments, the door and window trim, baseboards and crown moldings may have a length ranging from 1 foot to 20 feet, a width ranging from 1 inch to 8 inches and a thickness ranging from 1/16 inch to 4 inches. The door and window trim, baseboards and crown moldings may be welded to or attached to the floor assembly 200, wall panels 300, roof assembly 400, doors 700, windows 800, and/or the frame assembly 900 with screws or nuts and bolts of various sizes. Door and window trim, baseboards and crown moldings may seal the edges around the interior perimeter of a room, door, window or passageway within a unit.

In some embodiments, the door trim may be attached around the perimeter of the doors 700 and/or around the perimeter of the opening between wall panels 300 in a passageway. The window trim may be attached around the perimeter of the windows 800. The baseboards may be attached along the base of wall panels 300. The crown moldings may be attached along the top of wall panels 300. The door and window trim may be attached after the doors 700 and windows 800 are installed. The baseboards and crown moldings may be attached after the secondary flooring 206 is installed. By using door and window trim, baseboards and crown moldings around the perimeter of the interior walls, doors, windows, and/or passageways it may create a finished appearance inside a modular building unit 100.

Figure 12A:
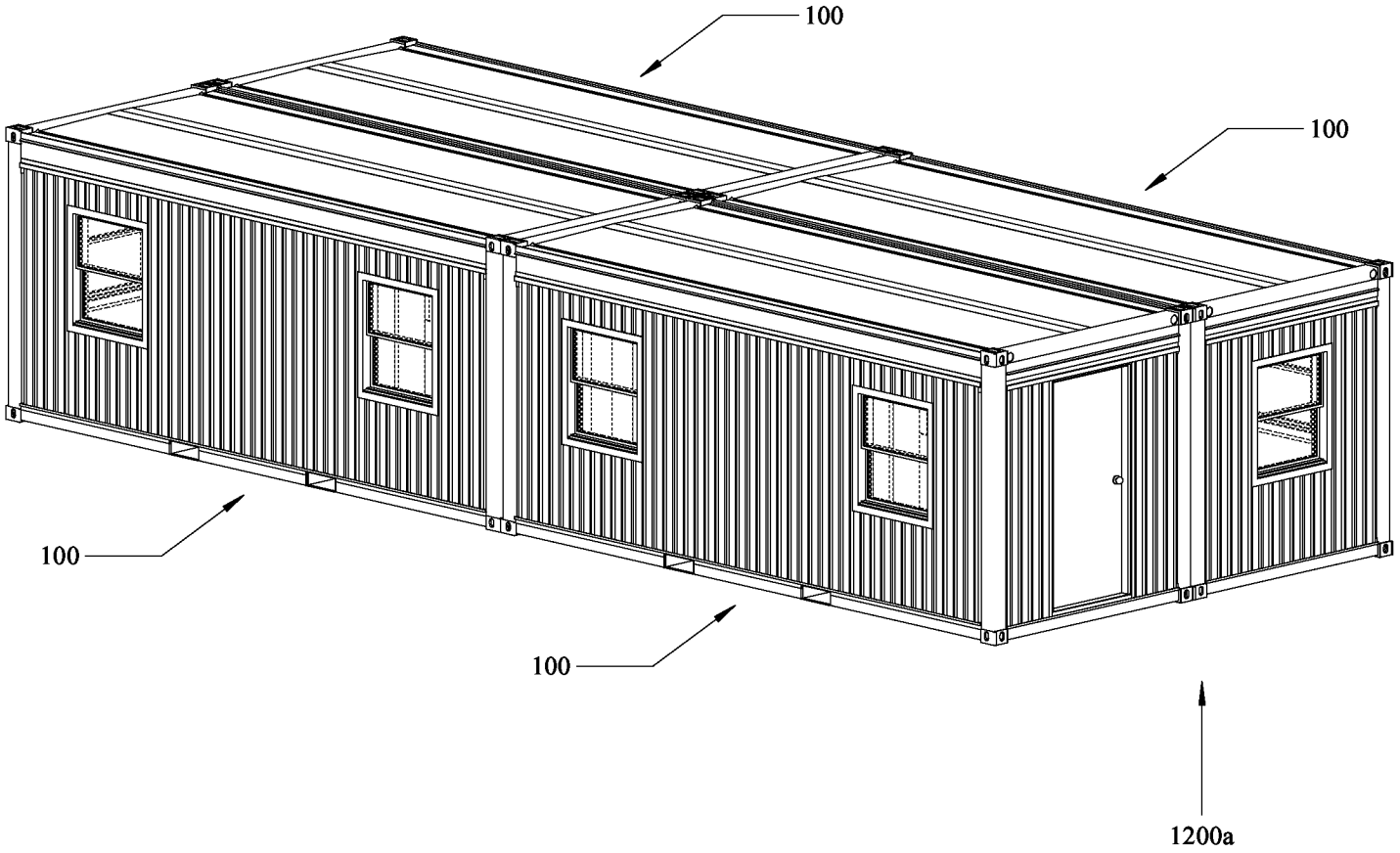
FIG. 12A illustrates an example large scale modular building with modular building units connected horizontally.
Figure 12B:
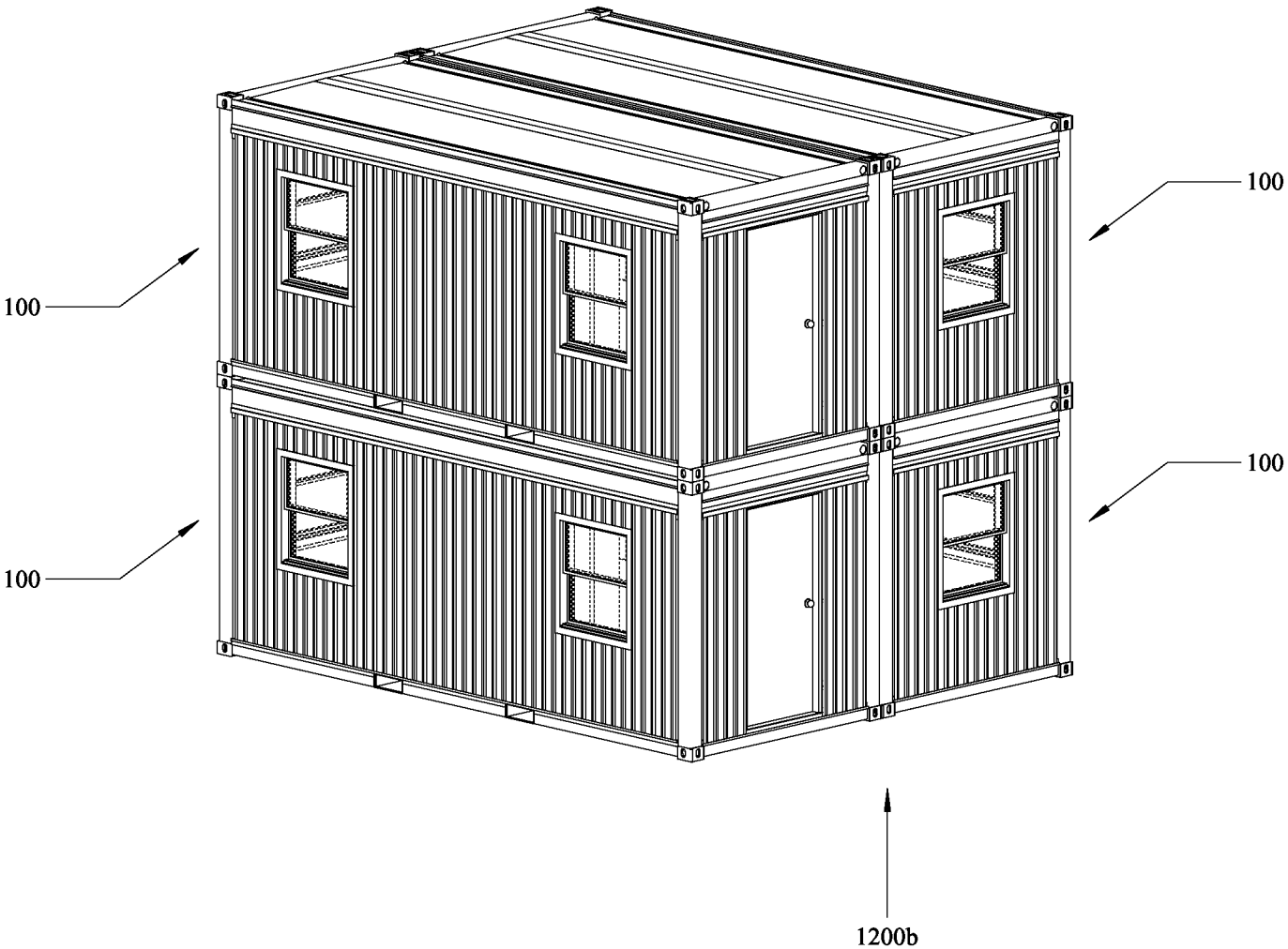
FIG. 12B illustrates an example large scale modular building with modular building units connected vertically.

FIGS. 12A-12B illustrates an example perspective view of modular building units 100 connected horizontally and stacked together vertically. One or more modular building units 100 may be arranged into larger scale buildings 1200 by connecting units horizontally and/or stacking units together vertically. Buildings may be made up of one or more modular building units 100 as desired for the building's occupants and function.

FIG. 12A illustrates an example large scale modular building with modular building units connected horizontally. One or more modular building units 100 may be connected together along the long and/or short sides of the unit to create a larger building in length and/or width such as larger scale building 1200*a*.

FIG. 12B illustrates an example large scale modular building with modular building units connected vertically. One or more modular building units 100 may be stacked on top of one another to create a larger building in height such as, larger scale building 1200*b*.

In some embodiments, when stacking units on top of one another, standard industry vertical shipping container twist locks may be used to secure the units in place. The twist locks may be used in accordance with the corner castings 910 in standard industry practice. The twist locks may be used on all top corner castings of a modular building unit 100 and may connect into all of the bottom corner castings of a modular building unit 100 being stacked on top of the lower unit. The twist lock may be placed over the top and bottom opening of a corner casting 910 and rests directly in between. The twist lock may secure each of the corner castings 910 of the modular building units 100 together. A lever on the twist lock may release the secured units when necessary to allow them to be separated for transportation or other purposes.

In some embodiments, when connecting units next to each other, standard industry horizontal shipping container twist locks or clamps may be used to secure the units in place. The twist locks or clamps may be used in accordance with the corner castings 910 in standard industry practice. The twist locks or clamps may be used on all corner castings of a modular building unit 100 and may connect into all of the corner castings of a modular building unit 100 next to the unit. The twist lock or clamp may be placed into the side openings of a corner casting 910 and rests directly in between. The twist lock or clamp may secure each of the corner castings 910 of the modular building units 100 together. A lever on the twist lock or clamp may release the secured units when necessary to allow them to be separated for transportation or other purposes.

In some embodiments, when connecting units to the ground below, standard industry shipping container twist locks or tie downs may be used to secure the units in place. The twist locks or tie downs may be used in accordance with the corner castings 910 in standard industry practice. The twist locks or tie downs may be used on all bottom corner castings of a modular building unit 100 on the ground level. The twist locks or tie downs may be placed into the side openings of a corner casting 910 and rests directly on the ground below. The opening in the twist lock or tie down may be used to secure the unit to the ground below with screws or nuts and bolts of various sizes.

In some embodiments, the modular building units 100 may be aligned and connected directly next to each other or staggered in various distances. For example, modular building units 100 may be aligned directly next to each other with the sides of the units aligned. Alternatively, the modular building units 100 may be aligned next to each other where only half of their long sides touch from opposite sides to stagger the units. Staggered alignment may vary in distances along each side of a modular building unit 100. Larger scale buildings 1200 may consist of units with one or more alignment techniques such as, direct alignment and/or staggered alignment. The modular building units 100 may be altered as necessary in order to connect units together and create larger scale buildings 1200 to serve their desired function on site.

In some embodiments, larger scale buildings 1200 which have multiple levels may need stairs to access the second floor and above. To access multiple levels, a modular staircase may be installed and attached to the exterior of a larger scale building 1200. The modular staircase may be attached to the modular building units 100 at the corner castings 910 and/or the frame 110. The staircase may be constructed of materials including, wood, aluminum, steel, or any combination of the listed materials or other materials. The stairs may be constructed in accordance with the building code in the modular building units 100 site location.

In some embodiments, above the modular building units 100 there may be solar panels attached on the roof or on an overhead structure. The amount and size of solar panels may be determined based on the site location and scale of the entire building. Solar panels may be attached and installed directly onto the roof and connected into the electrical system of the units. Alternatively, solar panels may be attached to an overhead structure. There may be an overhead structure above the entire building to attach solar panels or to provide extra protection from the weather. This overhead structure may be supported by columns in the ground around the perimeter with a roof which may be angled on one or more sides for runoff water and/or snow. Alternatively, the overhead structure may be attached to the top of the modular building units 100 with structural supports connected to each of the corner castings 910 to support the overhead loads. The height of the structure may be determined based on the height of the entire building below.

In some embodiments, the overhead structure may be constructed of any material including steel, iron, aluminum, metal, wood, fabric, polyester, vinyl or any combination of the listed materials or other materials. Based on the materials used, the structure may be load bearing or non-load bearing. On a load bearing overhead structure, solar panels may be installed and connected to the electrical grid to power the units attached. The overhead structure may be built with the purpose of providing additional roof coverage to the building unit below to protect the unit from weather damage including sun, rain and snow. Alternatively, the overhead structure may be built with the purpose of shading or camouflage and concealment where an overhead canopy material may be used to shade the units and may be in a color or pattern to blend into the surrounding environment.

In accordance with common practice, the various features illustrated in the drawings may not be drawn to scale. The illustrations presented in the present disclosure are not meant to be actual views of any particular apparatus (e.g., device, system, etc.) or method, but are merely idealized representations that are employed to describe various embodiments of the disclosure. Accordingly, the dimensions of the various features may be arbitrarily expanded or reduced for clarity. In addition, some of the drawings may be simplified for clarity. Thus, the drawings may not depict all of the components of a given apparatus (e.g., device) or all operations of a particular method.

Terms used herein and especially in the appended claims (e.g., bodies of the appended claims) are generally intended as "open" terms (e.g., the term "including" should be interpreted as "including, but not limited to," the term "having" should be interpreted as "having at least," the term "includes" should be interpreted as "includes, but is not limited to," etc.).

Additionally, if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to embodiments containing only one such recitation, even when the same claim includes the introductory phrases "one or more" or "at least one" and indefinite articles such as "a" or "an" (e.g., "a" and/or "an" should be interpreted to mean "at least one" or "one or more"); the same holds true for the use of definite articles used to introduce claim recitations.

In addition, even if a specific number of an introduced claim recitation is explicitly recited, it is understood that such recitation should be interpreted to mean at least the recited number (e.g., the bare recitation of "two recitations," without other modifiers, means at least two recitations, or two or more recitations). Furthermore, in those instances where a convention analogous to "at least one of A, B, and C, etc." or "one or more of A, B, and C, etc." is used, in general such a construction is intended to include A alone, B alone, C alone, A and B together, A and C together, B and C together, or A, B, and C together, etc. For example, the use of the term "and/or" is intended to be construed in this manner.

Further, any disjunctive word or phrase presenting two or more alternative terms, whether in the description, claims, or drawings, should be understood to contemplate the possibilities of including one of the terms, either of the terms, or both terms. For example, the phrase "A or B" should be understood to include the possibilities of "A" or "B" or "A and B."

Additionally, the use of the terms "first," "second," "third," etc., are not necessarily used herein to connote a specific order or number of elements. Generally, the terms "first," "second," "third," etc., are used to distinguish between different elements as generic identifiers. Absence a showing that the terms "first," "second," "third," etc., connote a specific order, these terms should not be understood to connote a specific order. Furthermore, absence a showing that the terms first," "second," "third," etc., connote a specific number of elements, these terms should not be understood to connote a specific number of elements. For example, a first widget may be described as having a first side and a second widget may be described as having a second side. The use of the term "second side" with respect to the second widget may be to distinguish such side of the second widget from the "first side" of the first widget and not to connote that the second widget has two sides.

All examples and conditional language recited herein are intended for pedagogical objects to aid the reader in understanding the invention and the concepts contributed by the inventor to furthering the art, and are to be construed as being without limitation to such specifically recited examples and conditions. Although embodiments of the present disclosure have been described in detail, it should be understood that the various changes, substitutions, and alterations could be made hereto without departing from the spirit and scope of the present disclosure.

The invention claimed is:

1. A building system, comprising:

a frame including:

a plurality of columns;

a plurality of bottom supports, each of the bottom supports coupled to at least one of the plurality of columns and each including a flange extending into the frame;

a plurality of top supports, each of the top supports coupled to at least one of the plurality of columns and each including a flange extending into the frame; and a trim plate pair including two parallel trim plates and the trim plate pair coupled between two of the plurality of columns;

a plurality of floor panels, each of the floor panels including a first floor panel edge and a second floor panel edge that are each configured to span between the flange of a first one of the bottom supports to the flange of a second one of the bottom supports, each of the plurality of floor panels including a first floor joining piece extending along the first floor panel edge and a second floor joining piece extending along the second floor panel edge, each of the first floor joining pieces configured to contact and support the second flooring joining piece of another one of the plurality of floor panels;

a plurality of roof panels, each of the roof panels including a first roof panel edge and a second roof panel edge that are each configured to span between the flange of a first one of the top supports to the flange of a second one of the top supports, each of the plurality of roof panels including a first roof joining piece extending along the first roof panel edge and a second roof joining piece extending along the second roof panel edge, each of the first roof joining pieces configured to contact and support the second roof joining piece of another one of the plurality of roof panels; and a plurality of wall panels, each of the plurality of wall panels include a first end, a second end opposite the first end, a first wall panel edge, a second wall panel edge, a first wall joining piece extending along the first wall panel edge, and a second wall joining piece extending along the second wall panel edge, each of the first wall joining pieces configured to contact and support the second wall joining piece of another one of the plurality of wall panels and the first end of each of the plurality of wall panels configured to rest between the two parallel trim plates of the trim plate pair, wherein the first end of at least one of the plurality of wall panels is in direct contact with at least one of the plurality of floor panels.

2. The building system of claim 1, further comprising a second trim plate pair including two parallel trim plates and the second trim plate pair coupled between the two of the plurality of columns, wherein the second end of each of the plurality of wall panels is configured to rest between the two parallel trim plates of the second trim plate pair.

3. The building system of claim 1, wherein the plurality of roof panels includes a first end and a second end opposite the first end, the first end configured to be supported by the flange of the first one of the top supports and the second end configured to be supported by the flange of the second one of the top supports and the plurality of roof panels include a first channel along the first end and a second channel along the second end, the first channel and the second channel extending perpendicular to the first roof panel edge and the second roof panel edge.

4. The building system of claim 1, wherein each of the bottom supports includes a first opening and a second opening spaced apart from the first opening, wherein the first opening of a first bottom support is aligned with the first opening of a second bottom support.

5. The building system of claim 1, wherein the frame further comprises a c-shaped channel extending along one of the bottom supports and the building system further comprises a plurality of siding panels configured to cover one or more of plurality of wall panels and to rest in the c-shape channel.

6. The building system of claim 1, further comprising a plurality of corner attachments coupled to ends of the plurality of columns, wherein the building system further comprises a second frame that is coupled to the frame using the plurality of corner attachments.

7. The building system of claim 1, wherein a width, a length, and a thickness of each of the plurality of floor panels is the same.

8. The building system of claim 7, wherein the first floor joining piece extending along the first floor panel edge is symmetrical to the second floor joining piece extending along the second floor panel edge.

9. The building system of claim 1, wherein each of the plurality of floor panels, the plurality of roof panels, and the plurality of wall panels are formed of aircrete.

10. A building system, comprising:

a frame including:

a plurality of columns;

a plurality of bottom supports, each of the bottom supports coupled to at least one of the plurality of columns and each including a flange extending into the frame; and a plurality of top supports, each of the top supports coupled to at least one of the plurality of columns and each including a flange extending into the frame;

a plurality of floor panels, each of the floor panels including a first floor panel edge and a second floor panel edge that are each configured to span between the flange of a first one of the bottom supports to the flange of a second one of the bottom supports;

a plurality of roof panels, each of the roof panels including a first roof panel edge and a second roof panel edge that are each configured to span between the flange of a first one of the top supports to the flange of a second one of the top supports; and a plurality of wall panels, each of the plurality of wall panels configured to span between the plurality of top supports and the plurality of bottom supports each of the plurality of wall panels including:

a first wall panel side;

a second wall panel side opposite the first wall panel side;

a first wall panel edge that extends between the first wall panel side and the second wall panel side and includes a first wall panel flange that extends out and along the first wall panel edge along the first wall panel side; and a second wall panel edge that extends between the first wall panel side and the second wall panel side and is opposite the first wall panel edge and includes a second wall panel flange that extends out and along the second wall panel edge along the second wall panel side, the second wall panel flange being symmetrical to the first wall panel flange, wherein when two of the plurality of wall panels are joined together a first surface of the first wall panel flange of a first of the two of the plurality of wall panels mates a second surface of the second wall panel flange of a second of the two of the plurality of wall panels, the first surface and the second surface mating in a plane that includes two of the plurality of columns between which the two of the plurality of wall panels are located.

11. The building system of claim 10, wherein the frame further includes a trim plate pair including two parallel trim plates and the trim plate pair coupled between two of the plurality of columns.

12. The building system of claim 11, wherein the plurality of wall panels are configured to rest between the two parallel trim plates.

13. The building system of claim 10, wherein each of the plurality of floor panels has the same shape as each of the plurality of wall panels.

14. The building system of claim 13, wherein each of the plurality of roof panels has the same shape as each of the plurality of wall panels.

15. The building system of claim 13, wherein a thickness of each of the plurality of wall panels and each of the plurality of floor panels is the same.

16. The building system of claim 10, wherein each of the bottom supports includes a first opening and a second opening spaced apart from the first opening, wherein the first opening of a first bottom support is aligned with the first opening of a second bottom support.

17. The building system of claim 10, further comprising a plurality of corner attachments coupled to ends of the plurality of columns, wherein the building system further comprises a second frame that is coupled to the frame using the plurality of corner attachments.

18. The building system of claim 15, wherein a width of each of the plurality of roof panels and each of the plurality of floor panels is the same and a length of each of the plurality of roof panels and each of the plurality of floor panels is the same.

19. The building system of claim 18, wherein the frame further includes a trim plate pair including two parallel trim plates and the trim plate pair coupled between two of the plurality of columns, wherein the plurality of wall panels are configured to rest between the two parallel trim plates and first end of at least one of the plurality of wall panels is in direct contact with at least one of the plurality of floor panels.

20. A building system, comprising:

a frame including:

a plurality of columns;

a plurality of corner attachments coupled to ends of the plurality of columns and configured to couple the frame to a second frame of the building system;

a plurality of bottom supports, each of the bottom supports coupled to at least one of the plurality of columns and each including a flange extending into the frame and each of the bottom supports includes a first opening and a second opening spaced apart from the first opening;

a plurality of top supports, each of the top supports coupled to at least one of the plurality of columns and each including a flange extending into the frame;

a trim plate pair including two parallel trim plates and the trim plate pair coupled between two of the plurality of columns;

a second trim plate pair including two parallel trim plates and the second trim plate pair coupled between the two of the plurality of columns;

a plurality of floor panels, each of the floor panels including a first floor panel edge and a second floor panel edge that are each configured to span between the flange of a first one of the bottom supports to the flange of a second one of the bottom supports, each of the plurality of floor panels including a first floor joining piece extending along the first floor panel edge and a second floor joining piece extending along the second floor panel edge and each of the first floor joining pieces is configured to contact and support the second flooring joining piece of another one of the plurality of floor panels, wherein a width, a length, and a thickness of each of the plurality of floor panels is the same and the first floor joining piece extending along the first floor panel edge is symmetrical to the second floor joining piece extending along the second floor panel edge;

a plurality of roof panels, each of the roof panels including a first roof panel edge and a second roof panel edge that are each configured to span between the flange of a first one of the top supports to the flange of a second one of the top supports, each of the plurality of roof panels including a first roof joining piece extending along the first roof panel edge and a second roof joining piece extending along the second roof panel edge, each of the first roof joining pieces configured to contact and support the second roof joining piece of another one of the plurality of roof panels and the plurality of roof panels includes a first end and a second end opposite the first end, the first end configured to be supported by the flange of the first one of the top supports and the second end configured to be supported by the flange of the second one of the top supports and the plurality of roof panels include a first channel along the first end and a second channel along the second end, the first channel and the second channel extending perpendicular to the first roof panel edge and the second roof panel edge, wherein a width, a length, and a thickness of each of the plurality of roof panels is the same and the first roof joining piece extending along the first roof panel edge is symmetrical to the second roof joining piece extending along the second roof panel edge; and a plurality of wall panels, each of the plurality of wall panels include a first end, a second end opposite the first end, a first wall panel edge, a second wall panel edge, a first wall joining piece extending along the first wall panel edge, and a second wall joining piece extending along the second wall panel edge, each of the first wall joining pieces configured to contact and support the second wall joining piece of another one of the plurality of wall panels and the first end of each of the plurality of wall panels configured to rest between the two parallel trim plates of the trim plate pair and the second end of each of the plurality of wall panels is configured to rest between the two parallel trim plates of the second trim plate pair, wherein a width, a length, and a thickness of each of the plurality of wall panels is the same and the first wall joining piece extending along the first wall panel edge is symmetrical to the second wall joining piece extending along the second wall panel edge, wherein each of the plurality of floor panels, the plurality of roof panels, and the plurality of wall panels are formed of aircrete.

* * * * *